US006057073A

United States Patent [19]

Hagiwara

[11] Patent Number: 6,057,073

[45] **Date of Patent: *May 2, 2000**

[54] TONER FOR DEVELOPING ELECTROSTATIC IMAGE, IMAGE FORMING METHOD, DEVELOPING APPARATUS UNIT, AND PROCESS CARTRIDGE

[75] Inventor: Kazuyoshi Hagiwara, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/670,023

[22] Filed: Jun. 25, 1996

[30] Foreign Application Priority Data

| | | | |
|---|---|---|---|
| Jun. 27, 1995 | [JP] | Japan | 7-182267 |
| Oct. 13, 1995 | [JP] | Japan | 7-290634 |
| Oct. 13, 1995 | [JP] | Japan | 7-290635 |

[51] Int. Cl.[7] ..... G03G 9/00

[52] U.S. Cl. ..... 430/110; 430/111; 399/252; 399/343; 399/111

[58] Field of Search ..... 430/110, 111; 399/252, 343, 111

[56] References Cited

U.S. PATENT DOCUMENTS

| | | | |
|---|---|---|---|
| 4,851,960 | 7/1989 | Nakamura et al. | 361/225 |
| 5,139,914 | 8/1992 | Tomiyama et al. | 430/106.6 |
| 5,210,617 | 5/1993 | Tomiyama et al. | 358/300 |
| 5,215,854 | 6/1993 | Yamazaki et al. | 430/137 |
| 5,270,143 | 12/1993 | Tomiyama et al. | 430/109 |
| 5,270,770 | 12/1993 | Kukimoto et al. | 355/274 |
| 5,307,122 | 4/1994 | Ohno et al. | 355/245 |
| 5,319,424 | 6/1994 | Tomiyama et al. | 355/273 |
| 5,354,637 | 10/1994 | Shimamura et al. | 430/106.6 |
| 5,406,357 | 4/1995 | Nakahara et al. | 355/245 |
| 5,436,701 | 7/1995 | Shimojo et al. | 355/219 |
| 5,450,180 | 9/1995 | Ohzeki et al. | 355/274 |
| 5,470,686 | 11/1995 | Suematsu et al. | 430/111 |
| 5,489,498 | 2/1996 | Ohno et al. | 430/110 |
| 5,501,931 | 3/1996 | Hirama et al. | 430/109 |
| 5,534,981 | 7/1996 | Ohno et al. | 355/245 |

FOREIGN PATENT DOCUMENTS

| | | | |
|---|---|---|---|
| 0395061 | 10/1990 | European Pat. Off. | G03G 15/16 |
| 0410457 | 1/1991 | European Pat. Off. | G03G 9/087 |
| 0523654 | 1/1993 | European Pat. Off. | G03G 9/097 |
| 63-149669 | 6/1988 | Japan | 361/225 |
| 2-123385 | 5/1990 | Japan | G03G 15/16 |
| 3-121462 | 5/1991 | Japan | G03G 15/16 |

OTHER PUBLICATIONS

English Abstract of JP 6–130716, May 13, 1994.
English Abstract of JP 6–27722, Feb. 4, 1994.
English Abstract of JP 2–42452, Feb. 13, 1990.
English Abstract of JP 1–219764, Sep. 1, 1989.
English Abstract of JP 1–219766, Sep. 1, 1989.
English Abstract of JP 1–219771, Sep. 1, 1989.
English Abstract of JP 1–219849, Sep. 1, 1989.
English Abstract of JP 61–275860, Dec. 5, 1986.
English Abstract of JP 59–200251, Nov. 1984.
English Abstract of JP 59–200264, Nov. 1984.

*Primary Examiner*—Nam Nguyen
*Assistant Examiner*—Steven H. Ver Steeg
*Attorney, Agent, or Firm*—Fitzpatric, Cella, Harper & Scinto

[57] ABSTRACT

A toner for developing an electrostatic image has toner particles containing at least a binder resin and a colorant, and an inorganic fine powder. The inorganic fine powder has been treated with a silicone oil having, in its molecular weight distribution as measured by gel permeation chromatography, at least one peak value in the region of molecular weight of from 500 to 15,000 and having at least one peak value or shoulder in the region of molecular weight of from 3,000 to 100,000 at a value greater than the former peak value.

100 Claims, 6 Drawing Sheets

TONER FOR DEVELOPING ELECTROSTATIC IMAGE, IMAGE FORMING METHOD, DEVELOPING APPARATUS UNIT, AND PROCESS CARTRIDGE

BACKGROUND OF THE INVENTION

1. Field of the Invention

This invention relates to a toner for developing electrostatic images which is used in printers, copying machines, facsimile machines and so forth employing electrophotography, and an image forming method, a developing apparatus unit and a process cartridge which make use of the toner.

2. Related Background Art

A number of methods are conventionally known for electrophotography. Copies are commonly obtained by forming an electrostatic latent image by various means on a photosensitive member having a photoconductive material, subsequently developing the latent image by the use of a toner to form a visible image (a toner image), transferring the toner image to a transfer medium such as paper if necessary, and thereafter fixing the toner image to the transfer medium by heat and pressure.

In recent years, image forming apparatus employing electrophotography have come to be used not only as conventional copying machines but also as printers and facsimile image output means, and are now in use in ordinary offices and homes.

Copying machines used in offices are always sought to be made more high-speed and stable, and it has become important to ensure stable image density and image quality in their use at a high speed, at the initial stage and even after long-term service. In particular, it is required to deliver stable image quality in an environment of high humidity/high temperature and an environment of low humidity/low temperature, stable image quality immediately after switch-on of the apparatus main body and stable image quality before and after the feeding of toner.

Developing systems for electrophotography are conventionally known to include one-component type developing systems and two-component type developing systems. In particular, one-component type developing systems are being employed in view of the advantage that developing assemblies can be made simple in structure while ensuring a high reliability.

In the one-component type developing systems, however, the toner must be uniformly coated in thin layer on the surface of a roll-shaped toner carrying member such as a developing sleeve by means of a toner layer thickness control member. Hence, a strong rubbing frictional force is applied to the toner to tend to cause deterioration of the toner or deterioration of the surface of the toner carrying member as a result of long-term service, and it is required as a subject to more prevent operating performance from deteriorating. Thus, it is sought to provide a technique for further improving this operating performance.

As charging means in electrophotography, it has been common to use means utilizing corona discharging. Since, however, the use of corona discharging causes ozone in a large quantity, the appratus must have a filter, and there have been the problems that the apparatus must be made large in size and the cost increases.

As techniques for solving such problems, charging methods have been commercialized in which a charging member such as a roller or a blade is brought into contact with the surface of a photosensitive member so as to form a narrow space in the vicinity of the contact portion, and a discharge as can be explained by what is called Paschen's law is formed so that the generation of ozone can be prevented as much as possible. In particular, a roller charging system making use of a charging roller as the charging member is preferably used in view of the stability of charging.

Such contact charging methods and contact transfer methods are disclosed in, for example, Japanese Patent Applications Laid-open No. 63-149669 and No. 2-123385. In these methods, a conductive elastic roller is brought into contact with an electrostatic latent image bearing member, and the electrostatic latent image bearing member is uniformly charged while applying a voltage to the conductive roller, which is then subjected to exposure and developing steps to obtain a toner image. Thereafter, while another conductive roller to which a voltage is applied is pressed against the electrostatic latent image bearing member, a transfer medium is passed between them to transfer to the transfer medium the toner image held on the electrostatic latent image bearing member, followed by the step of fixing to obtain a copied image.

Even in such contact charging methods, however, their fundamental charging mechanisms utilize the phenomenon of discharge from the charging member to the photosensitive member, and hence the voltage necessary for charging as stated above must be at a value beyond the surface potential of the photosensitive member. Moreover, when AC charging is carried out for the purpose of achieving uniform charging, the electric field of AC voltage may cause significant vibration of the charging member and photosensitive member, and noise (hereinafter "AC charging noise"), and the discharge may cause substantial deterioration of the surface of the photosensitive member. This involves another problem of melt adhesion or filming where toner or part of toner components adheres to the surface of the photosensitive member.

In roller transfer systems not employing such corona discharging, a transfer member such as a roller is brought into contact with the photosensitive member via a transfer medium such as paper, and hence filming may also occur because the roller rubs against the toner adhering to the photosensitive member, when the photosensitive member runs idle before and after paper feed, or partial faulty transfer, what is called blank areas caused by poor transfer (hereinafter often "transfer blanks" or "blank images"), may occur because the toner image receives a pressure when the toner image formed on the photosensitive member is transferred to the transfer medium, bringing about great problems on the image quality.

To solve such problems, in Japanese Patent Application Laid-open No. 3-121462, an image forming apparatus is proposed which employs a developer containing a hydrophobic inorganic fine powder treated with silicone oil. However, no improvement has been satisfactorily achieved with respect to thick transfer paper such as post cards and Kent paper having a basis weight of 100 g/m$^2$ or more and OHP sheets, and it is sought to achieve a much higher image quality.

Since these contact charging member and contact transfer member come in contact with the photosensitive member, lines or uneven tones may also appear in halftone images because the toner remaining after transfer or the toner having escaped from a cleaner adheres to the charging member and the transfer member to inhibit uniform charging and uniform transfer when accumulated in a large quantity.

Toner particles not transferred to the transfer medium and remaining on the photosensitive member are removed in the step of cleaning. In this step of cleaning, blade cleaning, fur brush cleaning or roller cleaning has been conventionally used. These cleaning methods, however, are those in which the toner remaining after transfer is mechanically scraped off or blocked up so that it is collected in a waste toner container. Hence, a cleaning member used therefor which is brought into pressure contact with the surface of the photosensitive member has caused problems. For example, bringing the cleaning member into strong pressure contact causes the surface of the photosensitive member to wear, so that scratches may be produced on the photosensitive member and their marks may appear in images, the toner tends to stick (melt adhere) to the drum surface, and external additives such as silica liberated from the toner may adhere to the drum surface (i.e., filming).

SUMMARY OF THE INVENTION

An object of the present invention is to provide a toner for developing electrostatic images that has solved the problems discussed above; and an image forming method, a developing apparatus unit and a process cartridge which make use of such a toner.

Another object of the present invention is to provide a toner for developing electrostatic images that promises a stable image density from the initial stage and can obtain images free of fog and unevenness and having a uniform density even in an environment of low humidity or high humidity; and an image forming method, a developing apparatus unit and a process cartridge which make use of such a toner.

Still another object of the present invention is to provide a toner for developing electrostatic images that has a high fluidity and can form images at high resolution, being very sharp and faithful to an original; and an image forming method, a developing apparatus unit and a process cartridge which make use of such a toner.

A further object of the present invention is to provide a toner for developing electrostatic images that can form images uniform and free of coarseness even in halftone images and solid images; and an image forming method, a developing apparatus unit and a process cartridge which make use of such a toner.

A still further object of the present invention is to provide a toner for developing electrostatic images that can be transferred in a high efficiency without any transfer blanks and without any broken images even in the image forming method employing contact charging means; and an image forming method, a developing apparatus unit and a process cartridge which make use of such a toner.

A still further object of the present invention is to provide a toner for developing electrostatic images that prevents its sticking, melt adhesion or filming to the photosensitive member and causes less scrape and scratch of the photosensitive member than ever even when used for a long period of time; and an image forming method, a developing apparatus unit and a process cartridge which make use of such a toner.

To achieve the above objects, the present invention provides a toner for developing an electrostatic image, comprising toner particles containing at least a binder resin and a colorant, and an inorganic fine powder, wherein;

the inorganic fine powder has been treated with a silicone oil having, in its molecular weight distribution as measured by GPC, at least one peak value in the region of molecular weight of from 500 to 15,000 and having at least one peak value or shoulder in the region of molecular weight of from 3,000 to 100,000 at a value greater than the former peak value.

The present invention also provides an image forming method comprising the steps of;

electrostatically charging an electrostatic latent image bearing member by means of a charging member;

forming on the electrostatic latent image bearing member thus charged an electrostatic latent image through a latent image forming means;

developing the electrostatic latent image by the use of a toner to form a toner image; the toner comprising toner particles containing at least a binder resin and a colorant, and an inorganic fine powder, wherein;

the inorganic fine powder has been treated with a silicone oil having, in its molecular weight distribution as measured by GPC, at least one peak value in the region of molecular weight of from 500 to 15,000 and having at least one peak value or shoulder in the region of molecular weight of from 3,000 to 100,000 at a value greater than the former peak value; and transferring the toner image to a transfer medium by means of a transfer member.

The present invention still also provides a developing apparatus unit comprising;

a toner for developing an electrostatic latent image;

a toner container for holding the toner; and a toner carrying member for carrying the toner held in the toner container and transporting the toner to a developing zone where the electrostatic latent image is developed;

wherein the toner comprises toner particles containing at least a binder resin and a colorant, and an inorganic fine powder;

the inorganic fine powder having been treated with a silicone oil having, in its molecular weight distribution as measured by GPC, at least one peak value in the region of molecular weight of from 500 to 15,000 and having at least one peak value or shoulder in the region of molecular weight of from 3,000 to 100,000 at a value greater than the former peak value.

The present invention still also provides a process cartridge detachably mountable to the main body of an image forming apparatus, comprising;

an electrostatic latent image bearing member for holding thereon an electrostatic latent image; and a developing assembly for developing the electrostatic latent image held on the electrostatic latent image bearing member;

the developing assembly comprising;

a toner for developing an electrostatic latent image;

a toner container for holding the toner; and a toner carrying member for carrying the toner held in the toner container and transporting the toner to a developing zone where the electrostatic latent image is developed;

wherein the toner comprises toner particles containing at least a binder resin and a colorant, and an inorganic fine powder;

the inorganic fine powder having been treated with a silicone oil having, in its molecular weight distribution as measured by GPC, at least one peak value in the region of molecular weight of from 500 to 15,000 and having at least one peak value or shoulder in the region of molecular weight of from 3,000 to 100,000 at a value greater than the former peak value.

DESCRIPTION OF THE PREFERRED EMBODIMENTS

Figure 1:
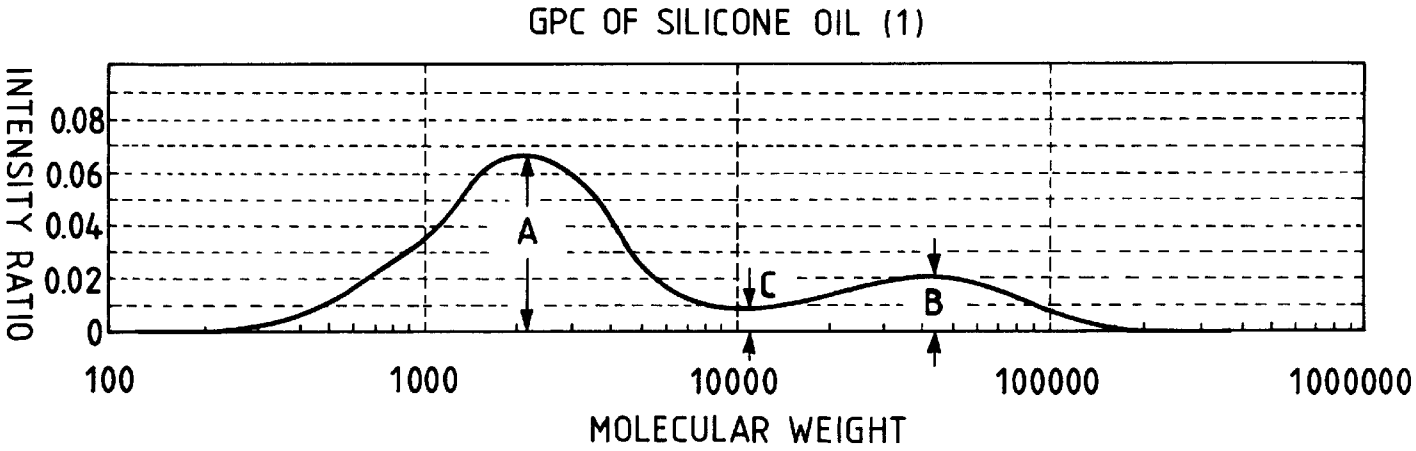
FIG. 1 shows a GPC chromatogram of silicone oil (1) used in Example 1 of the present invention.

As a result of extensive studies, the present inventors have discovered that a toner can have a high fluidity and, at the time of development, the toner can provide a swift rise of charge and a stable image density in the course of operation, can form sharp images free of fog and coarseness, may cause no fog and density decrease even in an environment of low humidity or high humidity, can be uniformly coated on the toner carrying member, and can form images faithful to latent images and having a high resolution, when an inorganic fine powder having been treated with a silicone oil having, in its molecular weight distribution as measured by GPC, at least one peak value in the region of molecular weight of from 500 to 15,000 and having at least one peak value or shoulder in the region of molecular weight of from 3,000 to 100,000 at a value greater than the former peak value, is externally added to toner particles.

The present inventors have also discovered that, when the above toner is used in the image forming method employing the contact charging means, lines and uneven images due to uneven charging and uneven transfer can be prevented, uniform halftone images can be formed and also the filming or toner melt-adhesion to the surface of the photosensitive member can be prevented because the toner causes no transfer blanks and provides a high transfer efficiency without causing broken images and because the toner and other additives cause less contamination of the charging member and transfer member.

The present inventors have still also discovered that, when the above toner is used in a one component type developing assembly, any developer carrying member as exemplified by the developing sleeve used in the one component type developing system can be free from contamination, and, also in the method in which the toner is coated on the developing sleeve by an elastic blade, uniform images free of white lines even in halftone images and solid images can be formed and images with a uniform image density can be formed in continuous copying of solid black images.

The present inventors have still also discovered that, when toner images formed using the above toner are fixed, black spots around line images and character images can be prevented at the time of fixing and electrostatic offset resistance can also be improved.

The present inventors also studied silicone oil-treated inorganic fine powders to be externally added to toner particles. As a result, they have discovered that the properties of toners greatly change depending on the molecular weight of the silicone oil with which the inorganic fine powder is treated, where the charge quantity increases with an increase in molecular weight, bringing about a better releasability of toner from the photosensitive member.

However, with an increase in the molecular weight of silicone oil, it becomes difficult to carry out uniform treatment when the inorganic fine powder is treated, causing lumps or resulting in a decrease in hydrophobic properties of the treated fine powder, and the toner obtained by its addition may cause fog. The lumps may cause uneven coating when the toner is coated on the toner carrying member sleeve in an environment of low humidity and may cause fog, also causing blank spots in solid black images. The decrease in hydrophobic properties causes a decrease in image density in the course of running in an environment of high humidity.

In the present invention, the inorganic fine powder is treated with a silicone oil containing both a high-molecular weight component and a low-molecular weight component, and hence, the resulting inorganic fine powder can be prevented from causing lumps and can have sufficient hydrophobic properties. Also, the toner obtained by its addition not only may cause less fog but also can have a high charge quantity, provide a swift rise of charge and have a good releasability to the photosensitive member.

The reason for the above is unclear, and it is presumed that the presence of the low-molecular weight component makes the coat of the high-molecular weight component on the particles of the inorganic fine powder uniform and also the presence of the low-molecular weight component brings out the swift-rise charging performance and the high releasability to the photosensitive member which are attributable to the high-molecular weight component.

The silicone oil used in the present invention has, in its molecular weight distribution as measured by GPC (gel permeation chromatography), at least one peak value in the region of molecular weight of from 500 to 15,000, preferably in the region of molecular weight of from 1,000 to 15,000, and more preferably in the region of molecular weight of from 2,000 to 10,000, and has at least one peak value or shoulder in the region of molecular weight of from 3,000 to 100,000, preferably in the region of molecular weight of from 5,000 to 100,000 and more preferably in the region of molecular weight of from 10,000 to 100,000, at a value greater than the former peak value. This makes it possible to prevent the filming or toner melt-adhesion to the surface of the photosensitive member and also to prevent the contamination of the toner carrying member developing sleeve.

If the peak value on the low-molecular weight side is not present in the region of molecular weight of from 500 to 15,000 but in the region of molecular weight less than 500, the silicone oil may have so large a quantity of non-volatile component that the quantity of silicone oil imparted to the particle surfaces of the inorganic fine powder can not be stable to tend to cause uneven charging. If the peak value on the low-molecular weight side is not present in the region of molecular weight of from 500 to 15,000 but in the region of molecular weight more than 15,000, the high-molecular weight component of the silicone oil can not be uniformly imparted to the particle surfaces of the inorganic fine powder to cause lumps, or the inorganic fine powder treated may have low hydrophobic properties to cause a decrease in image density in an environment of high humidity.

Also, if the peak value or shoulder on the high-molecular weight side is not present in the region of molecular weight of from 3,000 to 100,000 but in the region of molecular weight less than 3,000, the releasability from the photosensitive member tends to lower. If the peak value or shoulder on the high-molecular weight side is present in the region of molecular weight more than 100,000, it is difficult for the high-molecular weight component of the silicone oil to be uniformly imparted to the particle surfaces of the inorganic fine powder.

The silicone oil used in the present invention may preferably have, in its molecular weight distribution as measured by GPC, the ratio of weight average molecular weight to number average molecular weight (Mw/Mn) in the range of from 2 to 40, more preferably from 2 to 30, and still more preferably form 2 to 20, in order to prevent the filming or melt-adhesion from occurring. If the Mw/Mn is less than 2, the density decrease may occur when the toner is supplied in an environment of high temperature/high humidity. If the Mw/Mn is more than 40, the lumps tend to occur to cause filming or melt-adhesion of toner in some cases.

The silicone oil used in the present invention may preferably have, in its molecular weight distribution as measured by GPC, the ratio of z-average molecular weight to number average molecular weight (Mz/Mn) in the range of from 3 to 100, and more preferably from 4 to 30.

More specifically, the component having a peak value in the region of molecular weight of from 500 to 15,000 in the silicone oil has a low viscosity by itself, and hence moves from the particle surfaces of the inorganic fine powder to the surface of the developing sleeve and adheres thereto at the time of development, so that image density may decrease with repetition of the image formation. However, it is presumed that the silicone oil on the particles of the inorganic fine powder comes to have a viscosity high enough to adhere to the developing sleeve with difficulty when it contains the high-molecular weight component having a peak value in the region of molecular weight of from 3,000 to 100,000 and also has an Mz/Mn of 3 or more in its molecular weight distribution as measured by GPC. Hence, the inorganic fine powder treated with this silicone oil having an Mz/Mn of 3 or more makes the lumps occur less frequently and enables uniform treatment to decrease inorganic fine powder liberated from toner particles, so that the inorganic fine powder can be prevented from adhering to the photosensitive member to prevent the filming or melt-adhesion of toner from occurring. It is also presumed that, since the rise of charge can be accelerated and thereby the quantity of toner laid on line images can be decreased, the height of toner on line images can be small before fixing and hence the toner less scatters at the time of fixing and its offset may also less occur.

Since the Mz/Mn is not more than 100, the silicone oil can provide a good lubricity at the cleaner, and hence the scratches that may be produced on the photosensitive member can be reduced.

If the Mz/Mn is less than 3, the developing sleeve may become contaminated to cause a decrease in image density. If the Mz/Mn is more than 100, the scratches tend to be produced on the photosensitive member.

In the present invention, as shown in FIG. 1, in the molecular weight distribution as measured by GPC of the silicone oil, when the peak value is present in the region of molecular weight of from 500 to 15,000 and the peak value is present in the region of molecular weight of from 3,000 to 100,000, the distance from the vertex to its base line, corresponding to the peak value present in the region of molecular weight of from 500 to 15,000, is represented by A, the distance from the vertex to its base line, corresponding to the peak value present in the region of molecular weight from 3,000 to 100,000 at a value greater than the former peak value, is represented by B, and the distance from the bottom point to its base line, corresponding to the bottom value present between the peak value present in the region of molecular weight of from 500 to 15,000 and the peak value present in the region of molecular weight of from 3,000 to 100,000, is represented by C, these A, B and C may preferably fulfill the following condition:

A:B:C=1:0.01 to 1.0:0.001 to 0.70 and more preferably fulfill the following condition:

A:B:C=1:0.08 to 0.5:0.02 to 0.45.

In the relationship between A, B and C in the case of having 2 peaks, if A to B is 1 to less than 0.01, the high-molecular weight component is in so small a quantity that the high charging performance attributable to the high-molecular weight component can not be expected. If A to B is 1 to more than 1.0, the high-molecular weight component is in so large a quantity that it becomes difficult to make uniform treatment on the inorganic fine powder to tend to cause lumps and a decrease in hydrophobic properties. If A to C is 1 to less than 0.001, it becomes difficult to uniformly disperse the high-molecular weight component to the inorganic fine powder, to tend to cause fog or blotch due to uneven charging. If A to C is 1 to more than 0.5, the high-molecular weight component is consequently in so large a quantity that lumps tend to occur.

Figure 2:
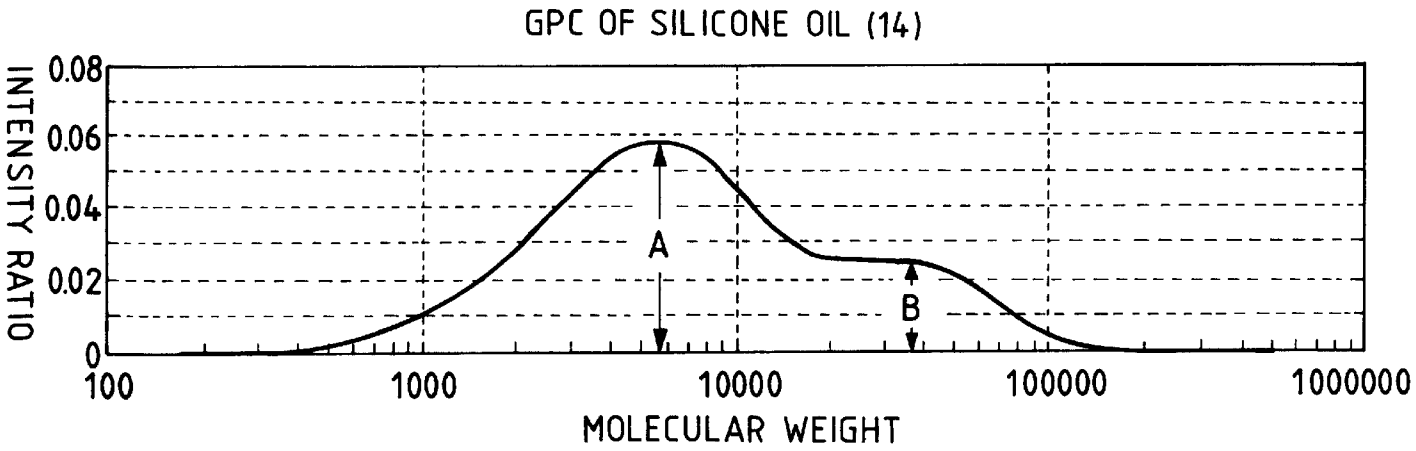
FIG. 2 shows a GPC chromatogram of silicone oil (14) used in Example 10 of the present invention.

Further, in the present invention, as shown in FIG. 2, in molecular weight distribution as measured by GPC of the silicone oil, when the peak value is present in the region of molecular weight of from 500 to 15,000 and the shoulder is present in the region of molecular weight of from 3,000 to 100,000 at a value greater than the former peak value, the distance from the vertex to its base line, corresponding to the peak value present in the region of molecular weight of from 500 to 15,000, is represented by A, and the distance from the inflection point of the shoulder present in the region of molecular weight of from 3,000 to 100,000 at a value greater than the former peak value to its base line, is represented by B, these A and B may preferably fulfill the following condition:

A:B=1:0.1 to 0.7 and more preferably fulfill the following condition:

A:B=1:0.1 to 0.5.

In the relationship between A and B in the case of having the peak value and the shoulder, if A to B is 1 to less than 0.1, the high-molecular weight component is in so small a quantity that the charging performance may lower. If A to B is 1 to more than 0.7, the high-molecular weight component is in so large a quantity that the uniform treatment on the inorganic fine powder may become poor to tend to cause lumps and a decrease in hydrophobic properties.

In the present invention, when a plurality of peak values or shoulder are present in the respective molecular weight regions in the above molecular weight distribution as measured by GPC, a vertex corresponding to the greatest peak value or the inflection point of the shoulder in the respective molecular weight regions is regarded as A or B. When a plurality of bottom values are present, a bottom point of the smallest bottom value is regarded as C.

The shoulder according to the present invention is judged on the basis of the point at which a differential value of the GPC chromatogram curve comes to be maximum, i.e., the inflection point.

In the present invention, the molecular weight distribution in the chromatogram obtained by GPC (gel permeation chromatography) of the silicone oil is measured under the following conditions, using toluene as a solvent.

More specifically, columns are stabilized in a heat chamber of 40° C. To the columns kept at this temperature, toluene as a solvent is flowed at a flow rate of 1 ml per minute, and about 50 to 300 $\mu$l of toluene sample solution is injected thereinto to make measurement. The molecular weight distribution ascribed to the sample is calculated from the relationship between the logarithmic value and count number of a calibration curve prepared using several kinds of monodisperse polystyrene standard samples. In that case, as the standard polystyrene samples used for the preparation of the calibration curve, it is suitable to use samples with molecular weights of from $1\times10^2$ to $1\times10^7$, which are available from Toso Co., Ltd., and to use at least about 10 standard polystyrene samples. An RI (refractive index) detector is used as a detector. Columns should be used in combination of a plurality of commercially available polystyrene gel columns. A combination of Shodex K-80M and K-802 (which are available from Showa Denko Co., Ltd.) is used.

The sample is prepared in the following way: The sample is put in toluene, and is left to stand for 30 minutes, followed by thorough shaking so as to be well mixed with the toluene, which is further left to stand for at least 1 hour. Thereafter, the solution having been passed through a sample-treating filter (for example, MAISHORI DISK H-13-5, available from Toso Co., Ltd. or EKICHRO DISK 25CR, available from German Science Japan, Ltd., may be utilized) is used as the sample for GPC. The sample is so adjusted to have sample components in a concentration of from 0.5 to 5 mg/ml.

The silicone oil used in the present invention is a silicone oil represented by the following Formula (1).

(1)

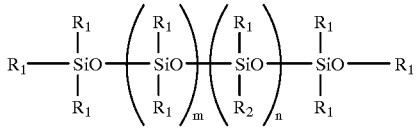

wherein $R_1$ represents a methyl group, any other alkyl group, an aryl group or a hydrogen atom, and independently therefrom $R_2$ represents a methyl group, any other alkyl group, an aryl group, a vinyl group, an alkyl group having a functional group, an aryl group having a functional group, or a hydrogen atom; and m and n each represent an integer.

The functional group may include, for example, an amino group, an OH group, an alkoxyl group, a polyether group, an ester group, and halogen atoms such as F, Cl and Br.

Preferable silicone oils may include, for example, dimethylsilicone oil, methylphenylsilicone oil, methylhydrogensilicone oil, alkyl-modified silicone oils, chloroalkyl-modified silicone oils, chlorophenyl-modified silicone oils, fatty acid-modified silicone oils, polyether-modified silicone oils, alkoxy-modified silicone oils, carbinol-modified silicone oils, amino-modified silicone oils and fluorine-modified silicone oils.

In particular, in view of the prevention of transfer blanks, dimethylsilicone oil, methylphenylsilicone oil, methylhydrogensilicone oil, fluorine-modified silicone oils and alkyl-modified silicone oils are preferred.

The silicone oil may preferably have a viscosity of from 2 cSt to 1,000,000 cSt.

The silicone oil used in the present invention can be prepared by conventionally known methods. The low-molecular weight component may be polymerized in the presence of the high-molecular weight component, or the high-molecular weight component may be polymerized in the presence of the low-molecular weight component. Alternatively, two or more kinds of silicone oil having different molecular weights may be blended.

In the case when the toner of the present invention is used as a positively chargeable toner, the silicone oil used therein may preferably have an apparent amine equivalent weight in the range of from 300 to 10,000, and more preferably in the range of from 1,000 to 6,000.

If the silicone oil has an amine equivalent weight less than 300, the charge quantity may become excessively high in an environment of low temperature/low humidity to cause uneven coating of toner on the developing sleeve. If the silicone oil has an amine equivalent weight more than 10,000, the charge quantity may become low in an environment of high temperature/high humidity to cause a decrease in image density.

In the present invention, as the silicone oil having an amine equivalent weight of from 300 to 10,000, it is preferable to use an amino-modified silicone oil having at least a unit structure represented by the following Formula (2):

(2)

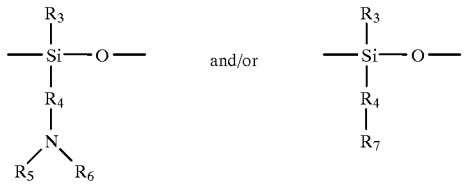

wherein $R_3$ represents a hydrogen atom, an alkyl group, an aryl group or an alkoxyl group; $R_4$ represents an alkylene group or a phenylene group; $R_5$ and $R_6$ each represent a hydrogen atom, an alkyl group or an aryl group; and $R_7$ represents a nitrogen-containing heterocyclic group. These unit structures may be included in the terminal of the silicone oil.

In the above formula, the alkyl group, aryl group, alkylene group and phenylene group may each have an organo group having a nitrogen atom, or may have a substituent such as a halogen so long as the charge performance is not damaged.

The organo group having at least one nitrogen atom can be exemplified by an amino group having an organic group as a substituent, a nitrogen-containing heterocyclic group, or a group having a nitrogen-containing heterocyclic group.

The nitrogen-containing heterocyclic group includes unsaturated heterocyclic groups and saturated heterocyclic groups, and known groups can be applied for these.

The unsaturated heterocyclic groups can be exemplified by the following:

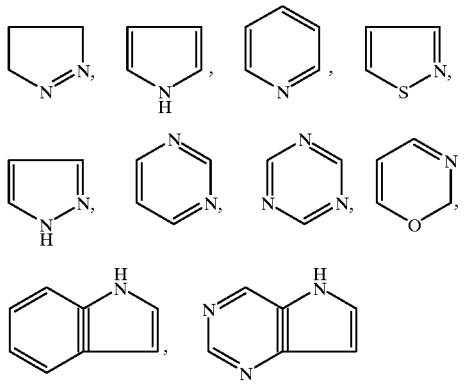

The saturated heterocyclic groups can be exemplified by the following:

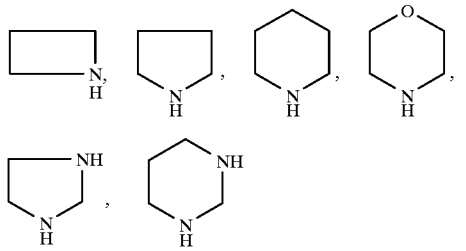

The heterocyclic groups used in the present invention may preferably be those of structure of 5 members or 6 members, taking account of stability.

The amino-modified silicone oil may preferably have a viscosity of from 2 cSt to 1,000,000 cSt.

In the present invention, as the silicone oil having an amine equivalent weight in the range of from 300 to 10,000, it is preferable to use in combination the above amino-modified silicone oil and a silicone oil having no amino group, in order to make transfer blanks less occur.

The silicone oil having no amino group, used in combination with the amino-modified silicone oil may include, for example, dimethylsilicone oil, methylphenylsilicone oil, methylhydrogensilicone oil, alkyl-modified silicone oils and vinyl group-containing silicone oils.

The dimethylsilicone oil, methylphenylsilicone oil, methylhydrogensilicone oil, alkyl-modified silicone oils and vinyl group-containing silicone oils used in the present invention are represented by the following Formula (3).

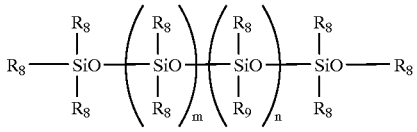

(3)

wherein $R_8$ represents a methyl group, any other alkyl group, an aryl group or a hydrogen atom, and independently therefrom $R_9$ represents a methyl group, any other alkyl group, an aryl group, a vinyl group, an alkyl group or aryl group which may have a hydroxyl group, or a hydrogen atom; and m and n each represent an integer.

Of these, from the viewpoint of preventing blank images, dimethylsilicone oil, methylphenylsilicone oil and methylhydrogensilicone oil are preferred, and dimethylsilicone oil is particularly preferred.

In the present invention, the amino-modified silicone oil and the silicone oil having no amino group may be mixed in a proportion of from 1:20 to 10:1.

The silicone oil formed by mixing the amino-modified silicone oil and the silicone oil having no amino group may preferably have a viscosity of from 2 cSt to 1,000,000 cSt.

In the present invention, the amount of the silicone oil with which the inorganic fine powder is treated is affected also by the specific surface area of the inorganic fine powder, and can not be specified in a definite form. The silicone oil may be used in an amount of from 5 to 70 parts by weight, and preferably from 7 to 40 parts by weight, based on 100 parts by weight of the inorganic fine powder. If it is used in an amount less than 5 parts by weight, it is difficult to obtain sufficient hydrophobic properties. If it is used in an amount more than 70 parts by weight, the lumps may occur or the specific surface area becomes small, resulting in a poor fluidity.

The inorganic fine powder used in the present invention may include metal oxides of metals such as silicon, titanium, aluminum, germanium, magnesium, zinc, cerium, cobalt, iron, zirconium, chromium, manganese, strontium, tin, antimony, molybdenum and tungsten; oxides such as boron oxide; nitrides such as silicon nitride and germanium nitride; composite metal oxides such as calcium titanate, magnesium titanate, strontium titanate, tungstophosphoric acid and molybdophosphoric acid; metal salts such as calcium carbonate, magnesium carbonate and aluminum carbonate; clay minerals such as kaolin; phosphorus compounds such as apatite; carbides such as silicon carbide and titanium carbide; silicon compounds; and carbon powders such as carbon black and graphite.

As specific examples of these, they may include silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, calcium titanate, magnesium titanate, strontium titanate, tungstophosphoric acid, molybdophosphoric acid, calcium carbonate, magnesium carbonate and aluminum carbonate.

Of these inorganic fine powders, silicon oxide, aluminum oxide and titanium oxide are preferred. These have various forms and types. In particular, fine silica powder represented by $SiO_2$, fine alumina powder represented by $Al_2O_3$ and fine titania powder represented by $TiO_2$ are preferred. Fine silica powder is particularly preferred.

As the inorganic fine powder, inorganic fine powders produced by the dry process and those produced by the wet process may be used. The dry process herein referred to is a process for producing inorganic fine powder formed by vapor phase oxidation of a halogen compound. For example, it is a process that utilizes heat decomposition oxidation reaction in the oxyhydrogen of halide gas. The reaction basically proceeds as shown by the following scheme, Formula (4).

$$MX_n+\tfrac{1}{2}nH_2+\tfrac{1}{4}.nO_2 \rightarrow MO_{n/2}+nHX \quad (4)$$

In this reaction scheme, M represents a metal or semi-metal element, X represents a halogen element, and n represents an integer. Stated specifically, when $AlCl_3$, $TiCl_4$, $GeCl_4$, $SiCl_4$, $POCl_3$ or $BBr_3$ is used, $Al_2O_3$, $TiO_2$, $GeO_2$, $SiO_2$, $P_2O_5$ or $B_2O_3$, respectively, are obtained. Here, composite compounds are obtained when halides are used by mixture.

As in other processes for producing inorganic fine powders, the fine powder can be obtained by applying a production process such as thermal CVD or plasma-assisted CVD. In particular, $SiO_2$, $Al_2O_3$ and $TiO_2$ may preferably be used.

As methods by which the inorganic fine powder used in the present invention is produced by the wet process, conventionally known various methods can be used. For example, they include a method in which sodium silicate is decomposed using an acid, as shown by the following reaction scheme, Formula (5);

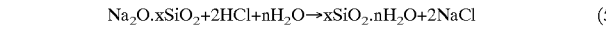

$$Na_2O.xSiO_2+2HCl+nH_2O \rightarrow xSiO_2.nH_2O+2NaCl \quad (5)$$

a method in which sodium silicate is decomposed using an ammonium salt or alkali salt; a method in which an alkaline earth metal silicate is produced from sodium silicate followed by decomposition using an acid to form silicic acid; a method in which an aqueous sodium silicate solution is passed through an ion-exchange resin to form silicic acid; and a method making use of naturally occurring silicic acid or silicate is utilized. Besides, they also include a method in which a metal alkoxide is hydrolyzed. The general reaction scheme thereof, Formula (6), is shown below.

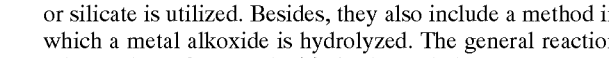

$$M(OR)_nO+\tfrac{1}{2}nH_2O \rightarrow MO_2+nROH \quad (6)$$

In this reaction scheme, M represents a metal or semi-metal element, R represents an alkyl group, and n represents an integer. Here, composite compounds are obtained when two or more metal alkoxides are used.

The inorganic fine powder may preferably have an average particle diameter, in terms of number average particle diameter of primary particles, in the range of from 0.001 to 2.0 $\mu$m, and particularly preferably in the range of from 0.002 to 0.2 $\mu$m.

The inorganic fine powder used in the present invention, before it is treated, may preferably have a specific surface area, as measured by the BET method using nitrogen gas absorption, of 30 $m^2/g$ or more, and particularly in the range of from 50 to 500 $m^2/g$.

The specific surface area of the untreated inorganic fine powder is measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

In the present invention, methods for the treatment of the inorganic fine powder with silicone oil may include, for example, a method in which the untreated inorganic fine powder is directly mixed with the silicone oil by means of a mixer such as a Henschel mixer; a method in which the untreated inorganic fine powder, serving as a base, is sprayed with the silicone oil; and a method in which the silicone oil is dissolved or dispersed in a suitable solvent and thereafter the untreated inorganic fine powder is added, followed by mixing and then removal of the solvent.

The inorganic fine powder having been treated may preferably have a specific surface area, as measured by the BET method using nitrogen gas absorption, in the range of from 40 to 400 $m^2/g$.

The inorganic fine powder thus treated may preferably have a hydrophobicity of 60% or above, and may more preferably be 80% or above. Use of those having a hydrophobicity less than 60% may cause a decrease in image density in an environment of high humidity.

The hydrophobicity is measured in the following way: 1.0 g of a sample and 100 g of ion-exchanged water are put in a 200 ml bottle, which are then vigorously stirred for 1 minute. Thereafter, the resulting dispersion is left to stand for 5 minutes, and then dispensed in a UV cell of 10 mm thick. Using the ion-exchanged water as reference, light transmittance at 500 nm is measured, and this light transmittance is regarded as the hydrophobicity.

The inorganic fine powder treated with the silicone oil, used in the present invention, may preferably be used in an amount of from 0.01 to 10 parts by weight, more preferably from 0.1 to 5 parts by weight, and particularly preferably from 0.2 to 3 parts by weight, based on 100 parts by weight of the toner particles. Its use in an amount less than 0.01 part by weight can be less effective for preventing the toner from agglomerating, and its use in an amount more than 10 parts by weight tends to cause the problems of toner scatter causing black spots around fine-line images, in-machine contamination, and scratches or wear of photosensitive members.

The inorganic fine powder used in the present invention may be optionally treated with a silane coupling agent, or with an organosilicon compound for the purpose of making hydrophobic. As methods for such treatment, known methods may be used, and the inorganic fine powder may be treated with the treating agent, capable of reacting with or physically adhering to the inorganic fine powder. The treating agent may include, for example, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, $\alpha$-chloroethyltrichlorosilane, $\beta$-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, and 1,3-diphenyltetramethyldisiloxane. Any of these may be used alone or in the form of a mixture of two or more kinds.

The toner of the present invention has toner particles containing a binder resin and a colorant. As the binder resin used in the present invention, it may include, for example, homopolymers of styrene and its derivatives such as polystyrene, poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl $\alpha$-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. In particular, styrene copolymers are preferred.

Comonomers copolymerizable with styrene monomers in the styrene copolymers may preferably be vinyl monomers. The vinyl monomers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether.

In the present invention, cross-linking agents may be used in the styrene copolymers. As the cross-linking agents, compounds having at least two polymerizable double bonds may be used. For example, they include aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups; any of which may be used alone or in the form of a mixture.

Of the above styrene copolymers, styrene-acrylic copolymers are particularly preferred which are formed chiefly using, as comonomers, acrylate, acrylic acid, acrylic acid amide, methacrylate, methacrylic acid, or methacrylic acid amide.

Styrene-acrylic terpolymers containing maleic acid, a maleate or a maleic anhydride are also one of preferred embodiments.

The binder resin used in the present invention may preferably have, in its molecular weight distribution as measured by GPC, at least one peak (Pa) in the region of molecular weight of from 5,000 to 50,000 and at least one peak or shoulder (Pb) in the region of molecular weight of 100,000 or more.

In the present invention, the molecular weight distribution in the chromatogram obtained by GPC (gel permeation chromatography) of the binder resin is measured under the following conditions.

More specifically, columns are stabilized in a heat chamber of 40° C. To the columns kept at this temperature, THF (tetrahydrofuran) as a solvent is flowed at a flow rate of 1 ml per minute, and about 100 $\mu$l of THF sample solution is injected thereinto to make measurement. The molecular weight distribution ascribed to the sample is calculated from the relationship between the logarithmic value and count number of a calibration curve prepared using several kinds of monodisperse polystyrene standard samples. In that case, as the standard polystyrene samples used for the preparation of the calibration curve, it is suitable to use samples with molecular weight of from $1\times10^2$ to $1\times10^7$, which are available from Toso Co., Ltd. or Showa Denko Co., Ltd., and to use at least about 10 standard polystyrene samples. An RI (refractive index) detector is used as a detector. Columns should be used in combination of a plurality of commercially available polystyrene gel columns. For example, a combination of Shodex GPC KF-801, 802, 803, 804, 805, 806, 807 and 800P which are available from Showa Denko Co., Ltd., or a combination of TSK gel G1000H($H_{XL}$), G2000H($H_{XL}$), G3000H($H_{XL}$), G4000H($H_{XL}$), G5000H ($H_{XL}$), G6000H($H_{XL}$), G7000H($H_{XL}$) and TSK guardcolumn which are available from Toso Co., Ltd. is used.

The sample is prepared in the following way: The sample is put in THF, and is left to stand for several hours, followed by thorough shaking so as to be well mixed with the THF (until agglomerate of the sample is not remained), which is further left to stand for at least 12 hours. At this time, the sample in the THF should be left to stand for at least 24 hours. Thereafter, the solution having been passed through a sample-treating filter (pore size is 0.45 to 0.5 $\mu$m, for example, MAISHORI DISK H-25-5, available from Toso Co., Ltd. or EKICHRO DISK 25CR, available from German Science Japan, Ltd., may be utilized) is used as the sample for GPC. The sample is so adjusted to have resin components in a concentration of from 0.5 to 5 mg/ml.

As methods for synthesizing the binder resin according to the present invention, bulk polymerization, solution polymerization, suspension polymerization and emulsion polymerization may be utilized.

In the bulk polymerization, low-molecular weight polymers can be obtained by carrying out the polymerization at a high temperature and accelerating the rate of termination reaction. There, however, is the problem of a difficulty in reaction control. In the solution polymerization, low-molecular weight polymers can be readily obtained under mild conditions by utilizing a difference in chain transfer of radicals which is ascribable to solvents, and controlling the amount of polymerization initiators and the reaction temperature. The latter is preferred when a low-molecular weight polymer is obtained which is contained in the binder resin used in the present invention.

As solvents used in the solution polymerization, xylene, toluene, cumene, cellosolve acetate, isopropyl alcohol, benzene or the like may be used. In the case of a mixture of styrene monomers, xylene, toluene or cumene is preferred. These are appropriately selected in accordance with polymers to be produced by the polymerization.

When carboxylic acid monomers or anhydride monomers are used, it is preferable to use bulk polymerization or solution polymerization in view of the properties of the monomers.

As the binder resin for the toner, when used in pressure fixing, it may include low-molecular weight polyethylene, low-molecular weight polypropylene, an ethylene-vinyl acetate copolymer, an ethylene-acrylate copolymer, higher fatty acids, polyamide resins and polyester resins. These may preferably be used either alone or in combination.

In the present invention, as the colorant contained in the toner particles, conventionally known inorganic or organic dyes and pigments may be used, as exemplified by, carbon black, aniline black, acetylene black, Naphthol Yellow, Hanza Yellow, Rhodamine Lake, Alizarine Lake, red iron oxide, Phthalocyanine Blue and Indanethrene Blue. Usually, any of these may be used in an amount of from 0.5 part by weight to 20 parts by weight based on 100 parts by weight of the binder resin.

In the toner of the present invention, a magnetic material may be optionally used as the colorant.

The magnetic material used in the present invention may include iron oxides such as magnetite, γ-iron oxide, ferrite, and iron-excess type ferrite; magnetic metals such as iron, cobalt and nickel; composite metal oxides, alloys or mixtures of iron oxides or magnetic metals with metals such as cobalt, tin, titanium, copper, lead, zinc, magnesium, manganese, aluminum and silicon.

Such magnetic particles may preferably have an average particle diameter in the range of from 0.05 to 1.0 $\mu$m, more preferably in the range of from 0.1 to 0.6 $\mu$m, and still more preferably in the range of from 0.1 to 0.4 $\mu$m. The magnetic particles may have a BET specific surface area, as measured by nitrogen gas absorption, in the range of from 1 to 20 $m^2/g$, and particularly in the range of from 2.5 to 12 $m^2/g$, and also may preferably have a Mohs hardness in the range of from 5 to 7.

As the shape of such magnetic particles, they may be octahedral, hexahedral, spherical, acicular or flaky.

Octahedral, hexahedral or spherical ones are preferred as having less anisotropy.

In the case when used as a magnetic toner, magnetic toner particles containing the magnetic material may be contained in an amount of from 10 to 150 parts by weight, and preferably from 20 to 120 parts by weight, based on 100 parts by weight of the binder resin.

In the toner of the present invention, a charge control agent may preferably be used by compounding it into toner particles (internal addition) or blending it with toner particles (external addition). The charge control agent enables control of optimum charge quantity in conformity with developing systems. Particularly in the present invention, it can make more stable the balance between particle size distribution and charge quantity.

As charge control agents capable of controlling the toner to be negatively chargeable, organic metal complexes or chelate compounds are effective, which include monoazo metal complexes, acetylacetone metal complexes, and metal complexes of an aromatic hydroxycarboxylic acid type or aromatic dicarboxylic acid type. Besides, they include aromatic hydroxycarboxylic acid, aromatic mono- or polycarboxylic acids and metal salts thereof, anhydrides thereof or esters thereof, and phenol derivatives such as bisphenol.

Charge control agents capable of controlling the toner to be positively chargeable include Nigrosine and products modified with a fatty acid metal salt; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds.

The charge control agents described above may preferably be used in the form of fine particles. Such fine-particle charge control agents may preferably have a number average particle diameter of 4 $\mu$m or smaller, and more preferably 3 $\mu$m or smaller. In the case when the charge control agent is internally added to the toner particles, it may preferably be contained in an amount of from 0.1 to 20 parts by weight, and particularly from 0.2 to 10 parts by weight, based on 100 parts by weight of the binder resin.

For the purposes of improving releasability from fixing members at the time of fixing and improving fixing performance, it is preferable to incorporate a wax in the toner particles. The wax include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives include oxides, block copolymers with vinyl monomers, and graft modified products of vinyl monomers.

Besides, the waxes may further include alcohols, fatty acids, acid amides, esters, ketones, hardened caster oil and derivatives thereof, vegetable waxes, animal waxes, mineral waxes and petrolatum.

In the toner of the present invention, other additives may also be used in a small quantity so long as they substantially do not adversely affect the toner. Such additives may include, for example, lubricant powders such as Teflon powder, stearic acid zinc powder and vinylidene polyfluoride powder; abrasives such as cerium oxide powder, silicon carbide powder and strontium titanate powder; fluidity-providing agents such as titanium oxide powder and aluminum oxide powder, or anti-caking agents; conductivity-providing agents such as carbon black powder, zinc oxide powder and tin oxide powder; and reverse-polarity organic fine particles or inorganic fine particles.

The toner of the present invention can be produced by known methods, for example, by thoroughly mixing the binder resin, the pigment or dye as the colorant, the magnetic material, and optionally the charge control agent, the wax, the metal salts or metal complex and other additives by means of a mixing machine such as a Henschel mixer or a ball mill, thereafter melt-kneading the mixture using a heat kneading machine such as a heat roll, a kneader or an extruder to make the binder resin and so forth melt one another, dispersing or dissolving the metal compound, the pigment or dye and the magnetic material in the molten product, and solidifying the resulting dispersion or solution by cooling, followed by pulverization and classification to obtain toner particles. Thereafter, the toner particles thus obtained, the inorganic fine powder treated with silicone oil and optionally any desired additives are well blended by means of a mixer such as a Henschel mixer. Thus the toner according to the present invention can be obtained.

The toner of the present invention may be used as a one component type developer as it is, or blended with a carrier so as to be used as a two component type developer.

The carrier used when the toner is used in two-component development, carrier particles conventionally known may be used. Stated specifically, the carrier (carrier particles) may include metals such as iron, cobalt, nickel, manganese, chromium and rare earth elements and alloys or oxides thereof, which have been surface-oxidized or unoxidized. The carrier may preferably have an average particle diameter in the range of from 20 to 300 $\mu$m.

In the present invention, a coated carrier comprising any of these carrier particles on or to the surfaces of which a resin is coated or adhered may be used.

As a binder resin to be coated on or adhered to the surfaces of the carrier particles, it may include styrenes such as styrene and chlorostyrene; monoolefins such as ethylene, propylene, butylene and isobutylene; vinyl esters such as vinyl acetate, vinyl propionate, vinyl benzoate and vinyl lactate; $\alpha$-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as methyl vinyl ether, ethyl vinyl ether and butyl vinyl ether; vinyl ketones such as methyl vinyl ketone, hexyl vinyl ketone and isopropenyl vinyl ketone; and homopolymers or copolymers of these. In particular, as typical binder resins, it may include polystyrene, styrene-alkyl acrylate copolymers, a styrene-acrylonitrile copolymer, a styrene-butadiene copolymer, a styrene-maleic anhydride copolymer, polyethylene and polypropylene, in view of dispersibility of conductive fine particles, film forming properties as coat layers, prevention of toner-spent, productivity and so forth. It may further include polycarbonate, phenol resins, polyesters, polyurethanes, epoxy resins, polyolefins, fluorine resins, silicone resins and polyamides. Especially from the viewpoint of the prevention of toner-spent, it is more preferable to contain a resin having a small critical surface tension, as exemplified by polyolefin resin, fluorine resin and silicone resin.

The resin having a small critical surface tension may preferably be contained in an amount of from 1.0 to 60% by weight, and particularly preferably in an amount of from 2.0 to 40% by weight, as its proportion to the total weight of the binder. If it is contained in an amount less than 1.0% by weight, the surface modification can not be well effective and can not be effective against the toner-spent. If it is in an amount more than 60% by weight, the both components can be uniformly dispersed with difficulty to cause a partial non-uniformity in volume resistivity, resulting in a poor charging performance.

The fluorine resin used as the binder resin for the coating of carrier particles may include, for example, solvent-soluble copolymers of vinyl fluoride, vinylidene fluoride, trifluoroethylene, chlorotrifluoroethylene, dichlorodifluoroethylene, tetrafluoroethylene or hexafluoropropylene with other monomers.

The silicone resin used as the binder resin for the coating of carrier particles may include, for example, KR271, KR282, KR311, KR255 and KR155 (straight silicone varnish), KR211, KR212, KR216, KR213, KR217 and KR9218 (modifying silicone varnish), SA-4, KR206 and KR5206 (silicone alkyd varnish), ES1001, ES1001N, ES1002T and ES1004 (silicone epoxy varnish), KR9706 (silicone acrylic varnish), and KR5203 and KR5221 (silicone polyester varnish), all available from Shin-Etsu Silicone Co., Ltd.; and SR2100, SR2101, SR2107, SR2110, SR2108, SR2109, SR2400, SR2410, SR2411, SH805, SH806A and SH8401, available from Toray Silicone Co., Ltd.

In the case when the resin is coated on or adhered to the surfaces of the carrier particles to form resin coat layers, the resin coat layers may preferably be incorporated with conductive fine particles so that the electrical resistance can be controlled.

In the present invention, methods for producing the carrier on the particle surfaces of which the resin coat layers containing conductive fine particles are formed may include a method in which carrier particles are immersed in a coat layer solution prepared by dissolving conductive fine particles and a coating resin in a suitable solvent and thereafter the solvent is evaporated using a spray dryer to form the coat layers; and a method in which carrier particles are put in a commonly available fluidized bed coating apparatus, where the coat layer solution is sprayed while forming a fluidized bed and is dried with spraying to gradually form the coat layers.

The image forming method, developing apparatus unit and process cartridge employing the toner of the present invention will be described in detail.

The image forming method employing the toner of the present invention includes a method employing a magnetic toner and a method employing a non-magnetic toner.

A developing method employing a one component type developer comprised of a magnetic toner will be described first.

Figure 5:
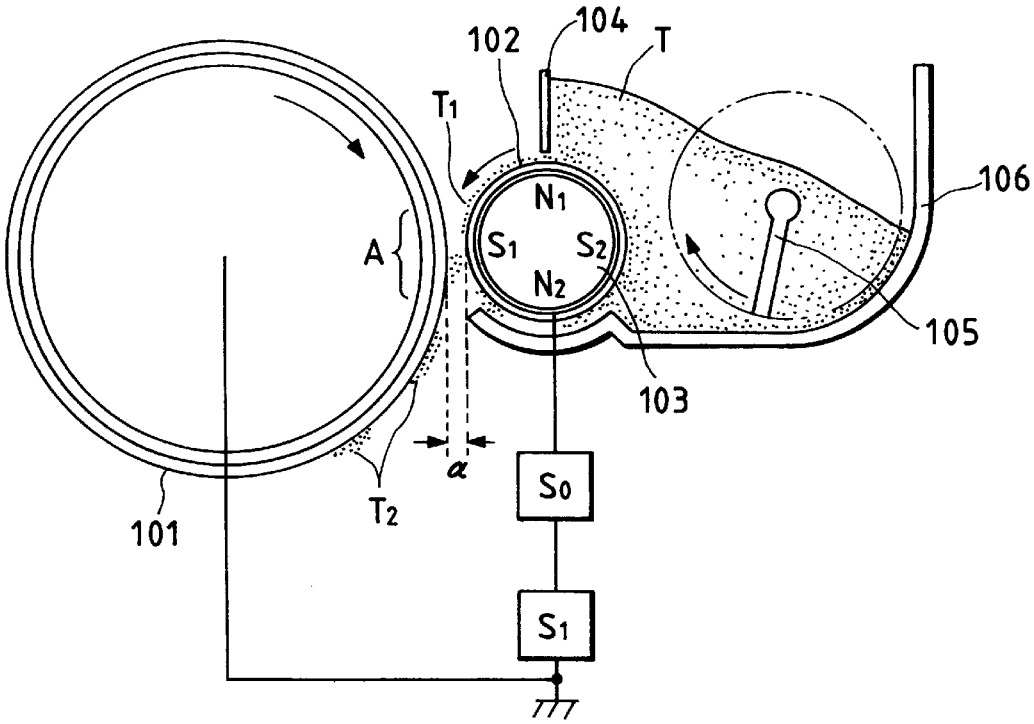
FIG. 5 is a schematic illustration of the developing apparatus unit of the present invention, employing a magnetic one component type developing system.

In FIG. 5, substantially the right-half periphery of a toner carrying member 102 always comes in contact with the toner stock inside a toner container 106. The toner in the vicinity of the surface of the toner carrying member is attracted to and carried on the surface of the toner carrying member by the action of magnetic force and/or electrostatic force, the former being produced by a magnetism generating means 103 internally provided with the toner carrying member. As the toner carrying member 102 is rotatingly driven, the magnetic toner layer formed on the surface of the toner carrying member 102 passes the position of a doctor blade 104 serving as the toner layer thickness control member, in the course of which the toner is formed into a controlled layer as a thin layer T1 with a uniform thickness at every portion. The magnetic toner is electrostatically charged chiefly by the frictional contact between the toner carrying member surface and the magnetic toner standing in the vicinity thereof in the toner stock, as the toner carrying member 102 is rotated. The magnetic toner carried on the toner carrying member 102 is, as the toner carrying member 102 is rotated, transported to a developing zone A (the place where electrostatic latent images are developed by the magnetic toner) at which a photosensitive member 101 serving as the electrostatic latent image bearing member and the toner carrying member 102 come nearest. In the course where the magnetic toner passes the developing zone A, the magnetic toner carried on the toner carrying member 102 flies by the aid of, e.g., a bias electric field formed by direct current and alternating current voltages, applied across the photosensitive member 101 and the toner carrying member 102, and reciprocates (at a gap $\alpha$) between the surface of the photosensitive member 101 and the surface of the toner carrying member 102. Finally, the magnetic toner on the side of the toner carrying member 102 is selectively transferred and attracted to the surface of the photosensitive member 101 in accordance with potential patterns of electrostatic latent images, so that toner images T2 are successively formed.

The toner thin layer on the surface of the toner carrying member 102, having passed the developing zone A and from which the magnetic toner has been selectively consumed is returned to the toner stock in the toner container 106, so that the toner carrying member 102 is again supplied with the magnetic toner and transports to the developing zone A the magnetic toner thin layer T1 carried on the toner carrying member 102. In this way, the step of development is repeated.

The toner layer thickness control member used in the present invention may be a metallic blade or a magnetic blade (e.g.,. a member 104 shown in FIG. 5), provided to leave a certain gap between it and the toner carrying member 102, or an elastic blade elastically coming into touch with the surface of the toner carrying member 102, either of which may be used.

As the elastic blade, it is possible to use rubber elastic materials such as silicone rubber, urethane rubber or NBR; synthetic resin elastic materials such as polyethylene terephthalate, or metal elastic materials such as stainless steel and steel, as well as composite materials thereof. Rubber elastic materials are preferred.

The quality of the material for the elastic blade is greatly concerned in the charging of the toner on the toner carrying member. Hence, an organic or inorganic substance may be added to, may be melt-mixed in, or may be dispersed in, the elastic material. The substance to be added may include, for example, metal oxides, metal powders, ceramics, carbon allotropes, wiskers, inorganic fibers, dyes, pigments, and surface active agents. An elastic support formed of rubber, synthetic resin or metal elastic material may also be used to which, for the purpose of controlling the chargeability of the toner, a charge controlling material such as resin, rubber, metal oxide or metal is fixed so as to touch the part coming into contact with the toner carrying member. In instances where the elastic material and the toner carrying member are required to have a durability, resin or rubber may preferably be stuck to the metal elastic material so as to touch the part coming into contact with the toner carrying member.

In the case when the toner is negatively chargeable, the elastic blade and the charging control material may preferably be those positively chargeable with ease, such as urethane rubber, urethane resin, polyamide resin and nylon resin. In the case when the toner is positively chargeable, the elastic blade and the charging control material may preferably be those negatively chargeable with ease, such as urethane rubber, urethane resin, silicone rubber, silicone resin, polyester resin, fluorine resin and polyimide resin.

In instances where the part coming into contact with the toner carrying member is formed of a molded product of resin or rubber, a metal oxide such as silica, alumina, titania, tin oxide, zirconium oxide or zinc oxide, carbon black, and a charge control agent commonly used in toners may preferably be incorporated therein in order to control the chargeability of the toner.

The base portion corresponding to the upper side of the elastic blade is fixedly held on the side of the toner container, and its lower side is brought into touch with the surface of the toner carrying member at an appropriate elastic pressure in such a state that the lower side bends in the reverse direction (see FIG. 6) of, or the same direction (see FIG. 7) as, the rotational direction of the toner carrying member against the elastic force of the blade.

It is effective for the blade to be brought into touch with the toner carrying member at a pressure of 0.98 N/m (1 g/cm) or above, preferably from 1.27 to 245 N/m (3 to 250 g/cm), and more preferably from 4.9 to 118 N/m (5 to 120 g/cm), as a linear pressure in the generatrix direction of the toner carrying member. If the touch pressure is smaller than 0.98 N/m (1 g/cm), it is difficult to uniformly coat the toner, causing fog or black spots around line images. If the touch pressure is greater than 245 N/m (250 g/cm), a great pressure is applied to the toner to tend to cause deterioration of the toner, and such a pressure is not preferable.

The gap a between the photosensitive member and the toner carrying member may preferably be set to be, e.g., from 50 to 500 $\mu$m.

The layer thickness of the magnetic toner layer formed on the toner carrying member may preferably be made smaller than the gap a between the photosensitive member and the toner carrying member in order to make fog occur with difficulty. The photosensitive member and the toner carrying member may also be used in such a form that part of the toner layer comes into contact with the surface of the photosensitive member.

In the present invention, the photosensitive member and the toner carrying member may preferably be in such a form that an electric field containing an AC component is applied across them as a developing bias. The peak-to-peak (Vpp) magnitude of the electric field of the AC component applied across the photosensitive member and the toner carrying member at the part where the both members come nearest, may preferably be 2 to 8 MV/m or above. The AC bias may be applied at a frequency of from 1.0 kHz to 5.0 kHz, and preferably from 1.5 kHz to 3.0 kHz. As the waveform of the AC bias, rectangular waveform, sine waveform, sawtooth waveform and triangle waveform can be used. An asymmetrical AC bias having different time for which regular/reverse voltages are applied may also be used.

In the present invention, the toner carrying member is formed using a material such as metal and ceramic, and a non-magnetic conductive metal such as aluminum or SUS stainless steel is preferred in view of chargeability to the toner. The toner carrying member may be formed using a pipe member merely drawn or cut. However, in order to control toner transport performance and triboelectricity-providing performance, a drawn or cut pipe member is polished, surface-roughened in the peripheral direction or longitudinal direction, blast-finished or coated. In the present invention, it is preferable to apply blast finishing, where shaped particles or amorphous particles are used as a blasting agent, and any of these may be used alone or in combination. Lap-treated members may also be used.

The surface of the toner carrying member may be covered with a resin coat layer containing conductive fine particles. As the conductive fine particles contained in such a resin coat layer, conductive metal oxides such as carbon black, graphite and conductive zinc oxide and conductive metal double oxides may preferably be used alone or in combination of two or more kinds. As the resin in which such conductive fine particles are dispersed, phenol resins, epoxy resins, polyamide resins, polyester resins, polycarbonate resins, polyolefin resins, silicone resins, fluorine resins, styrene resins or acrylic resins may be used. In particular, thermosetting or photocurable resins are preferred.

A developing method employing a non-magnetic toner will be described below.

Figure 8:
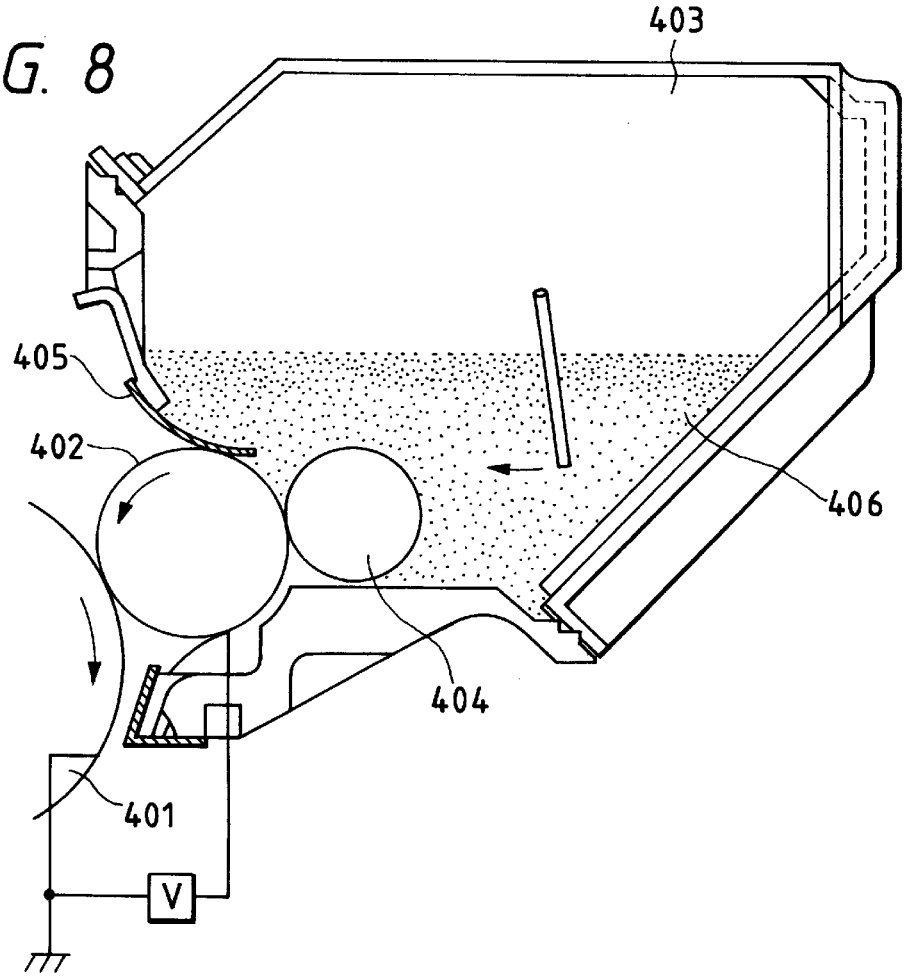
FIG. 8 is a schematic illustration of the developing apparatus unit of the present invention, employing a non-magnetic one component type developing system.

FIG. 8 illustrates an apparatus for developing an electrostatic latent image formed on a photosensitive member. Reference numeral 401 denotes a photosensitive member serving as the electrostatic latent image bearing member. The electrostatic latent image is formed by an electrophotographic processing means or electrostatic recording means (not shown). Reference numeral 402 denotes a toner carrying member, which is formed of a non-magnetic sleeve made of aluminum or stainless steel.

The toner carrying member may be formed using a crude pipe of aluminum or stainless steel as it is, and preferably using a pipe whose surface has been uniformly roughened by blowing roughening particles such as glass beads, a pipe whose surface has been mirror-finished, or a pipe whose surface has been coated with resin, as in the case of the pipe member used in the developing method employing the magnetic toner.

A toner 406 is held in a toner container 403, and is fed onto the toner carrying member by means of a feed roller 404. The feed roller 404 is formed of a foamed material such as polyurethane foam, and is rotated in the same direction as, or the reverse direction of, the rotation of the toner carrying member at a relative speed not being zero. It not only feeds the toner but also scrapes off the toner remaining on the toner carrying member after development (the toner not participated in development). The toner fed onto the toner carrying member is uniformly and thin-layer coated thereon by means of a toner coating blade 405 serving as the toner layer thickness control member.

With regard to the quality of the blade material, the touch means, the quality of the toner carrying member material, the distance between the photosensitive member and the toner carrying member and the bias applied to the toner carrying member, those in the case of the developing method employing the magnetic toner apply correspondingly to the above case.

In the present invention, among the constituent factors described in respect of the developing method employing a magnetic toner and the developing method employing a non-magnetic toner, at least the toner for developing electrostatic latent images, the toner container for holding the toner and the toner carrying member for carrying the toner held in the toner container and transporting the toner to the developing zone where the electrostatic latent images are developed may be constituted in one unit so as to be used as a developing apparatus unit.

This developing apparatus unit is mounted to the main body of the image forming apparatus described later, and is fixed by a fixing means such as bolts or pins.

The developing apparatus unit of the present invention may also have the toner layer thickness control member and the toner feed roller as one unit in addition to the toner, the toner container and the toner carrying member.

An example of a specific image forming apparatus that can be used for carrying out the image forming method of the present invention will be described with reference to FIG. 3.

Reference numeral 1 denotes a rotary drum type photosensitive member serving as the electrostatic latent image bearing member. The photosensitive member 1 is constituted basically of a conductive substrate layer 1*b* formed of aluminum and a photoconductive layer 1*a* formed on its periphery, and is rotatingly driven in the direction of an arrow at a stated peripheral speed.

Reference numeral 2 denotes a charging roller serving as the contact charging member, which is constituted basically of a mandrel 2*b* at the center and provided on its periphery a conductive elastic layer 2*a* formed of a conductive resin material such as epichlorohydrin rubber containing carbon black.

The charging roller is brought into pressure contact with the surface of the photosensitive member under a stated pressure, and is follow-up rotated with the rotation of the photosensitive member 1. As a cleaning member 12, a felt pad is also brought into touch with the charging roller 2. This cleaning member 12 may be omitted in low-speed machines or medium-speed machines that may take a small number of copies before the end of lifetime of the apparatus.

Reference numeral 3 denotes a charging bias power source for applying a voltage to the charging roller 2, and the surface of the photosensitive member 1 is uniformly charged to negative polarity upon application of charging bias to the charging roller 2.

Subsequently, as a latent image forming means, electrostatic latent images are formed by imagewise exposure 4. The electrostatic latent images formed are developed by the toner held in a developing assembly serving as the developing means and are rendered visible images one after another as toner images. Reference numeral 6 denotes a transfer roller, which is constituted basically of a mandrel 6*b* at the center and provided on its periphery a conductive elastic layer 6*a* formed of a conductive resin material such as an ethylene-propylene-butadiene copolymer containing carbon black.

The transfer roller 6 is brought into pressure contact with the surface of the photosensitive member under a stated pressure, and is rotated at the same peripheral speed as, or at a peripheral speed different from, the peripheral speed of the photosensitive member 1. As a cleaning member 13, a felt pad is also brought into touch with the transfer roller 6. This cleaning member 13 may be omitted in low-speed machines or medium-speed machines that may take a small number of copies before the end of lifetime of the apparatus.

As a transfer medium 8, e.g., an A4-size sheet of paper is used. This paper is fed to be held between the photosensitive member 1 and the transfer roller 6, and a bias with a polarity reverse to that of the toner is at the same time applied from a transfer bias power source 7, so that the toner images on the photosensitive member 1 are transferred to the surface of the transfer medium 8. Hence, at the time of transfer, the transfer roller 6 is brought into pressure contact with the photosensitive member 1 via the transfer medium 8.

Next, the transfer medium 8 is transported to a heat roller fixing assembly 11 constituted basically of a fixing roller 11*a* internally provided with a halogen heater, and an elastic material pressure roller 11*b* brought into contact therewith under pressure, and is passed between the fixing roller 11*a* and the pressure roller 11*b*, whereupon the toner images are fixed.

After the toner images have been transferred, the surface of the photosensitive member 1 is cleaned to remove the adherent contaminants such as toner remaining after transfer, by means of a cleaning device 9 having an elastic cleaning blade formed of an elastic material such as polyurethane rubber, is brought into pressure contact with the photosensitive member 1 in the counter direction, and is further destaticized by means of a charge eliminating exposure device 10. Then, images are repeatedly formed thereon.

As the charging member 6 of the photosensitive member 1, a contact charging member such as the charging roller is used which is brought into contact with the photosensitive member to charge it. This is preferable since the quantity of ozone produced at the time of charging can be decreased. Alternatively, it is also possible to use a corona charging assembly commonly widely used, on the condition that an ozone filter is provided.

As the transfer member 2 also, a contact transfer member such as the transfer roller 2 is used which is brought into contact with the photosensitive member to make transfer. This is preferable since the quantity of ozone produced at the time of transfer can be decreased. Alternatively, it is also possible to use a corona transfer assembly commonly widely used, on the condition that an ozone filter is provided.

Figure 3:
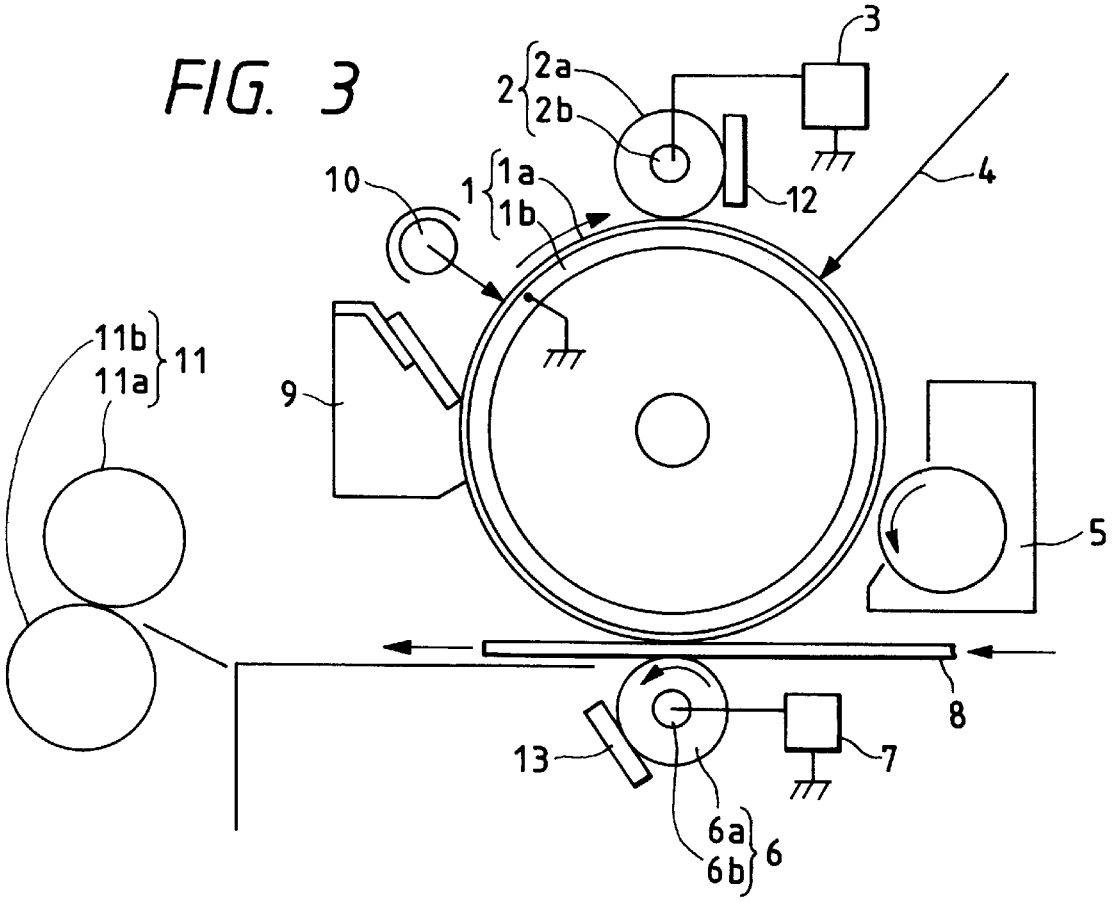
FIG. 3 is a schematic illustration of an image forming apparatus, used to describe the image forming method of the present invention.

In the present invention, in place of the heat roller fixing assembly as the fixing means of the image forming apparatus shown in FIG. 3, it is possible to use a film heat fixing assembly for heat-fixing the toner, using a heater element stationarily supported and a pressure member that stands opposite to the heater element in pressure contact and brings the transfer medium into close contact with the heater element through a film interposed between them.

Figure 4:
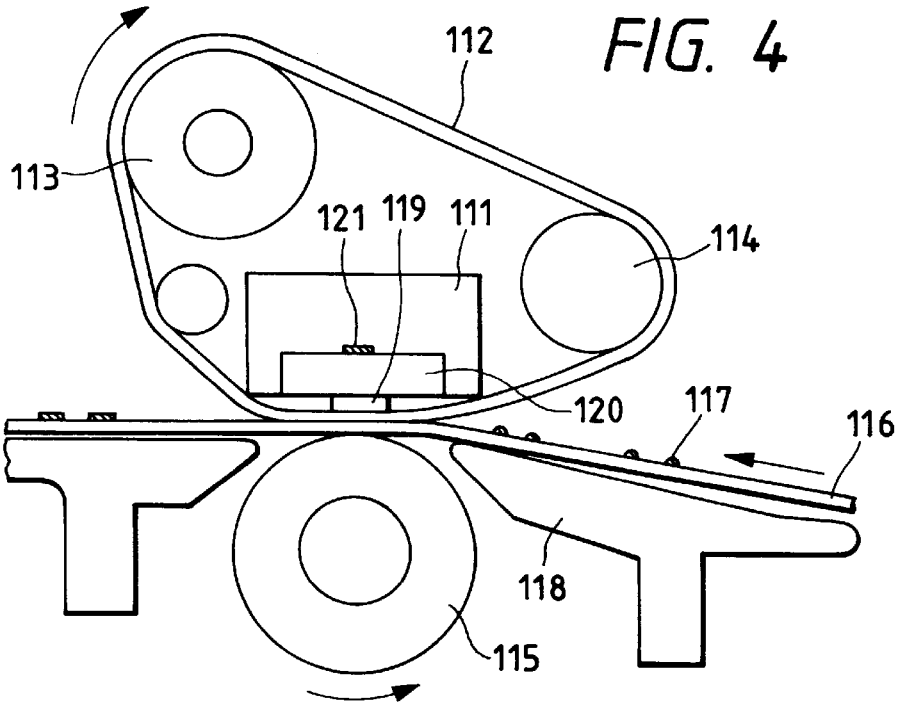
FIG. 4 is a schematic illustration used to describe a fixing means according to another embodiment applicable as the fixing means of the image forming apparatus shown in FIG. 3.

FIG. 4 illustrates an example of the film heat fixing assembly.

In the film heat fixing assembly shown in FIG. 4, the heater element has a smaller heat capacity than conventional heat rolls, and has a linear heating part. The heating part may preferably be made to have a maximum temperature of from 100° C. to 300° C.

The film interposed between the heater element and the pressure member may preferably comprise a heat-resistant sheet of from 1 to 100 $\mu$m thick. Heat-resistant sheets used therefor may include sheets of polymers having high heat-resistance, such as polyester, PET (polyethylene terephthalate), PFA (a tetrafluoroethylene-perfluoroalkyl vinyl ether copolymer), PTFE (polytetrafluoroethylene), polyimide and polyamide, sheets of metals such as aluminum, and laminate sheets comprised of a metal sheet and a polymer sheet.

In a preferred constitution of the film, these heat-resistant sheets have a release layer and/or a low-resistance layer.

A specific example of the fixing device will be described with reference to FIG. 4.

Reference numeral 111 denotes a low heat capacitance linear heater element stationarily supported in the fixing assembly. An example thereof comprises an alumina substrate 120 of 1.0 mm thick, 10 mm wide and 240 mm in longitudinal length and a resistance material 119 coated thereon to have a width of 1.0 mm, which is electrified from the both ends in the longitudinal direction. The electricity is applied under variations of pulse widths of the pulses corresponding with the desired temperatures and energy emission quantities which are controlled by a temperature sensor 121, in the pulse-like waveform with a period of, e.g., 20 msec of DC 100 V. The pulse widths range approximately from 0.5 msec to 5 msec. In contact with the heater element 111 the energy and temperature of which have been controlled in this way, a fixing film 112 moves in the direction of an arrow shown in the drawing.

An example of this fixing film includes an endless film comprised of a heat-resistant film of 20 μm thick (comprising, for example, polyimide, polyether imide, PES, or PFA) and a release layer comprising a fluorine resin such as PTFE or PFA to which a conductive material is added, coated at least on the side coming into contact with the image to have a thickness of 10 μm. In general, the total thickness of the film may preferably be less than 100 μm, and more preferably less than 40 μm. The film is moved in the direction of the arrow in a wrinkle-free state by the action of the drive of, and tension between, a drive roller 113 and a follower roller 114.

Reference numeral 115 denotes a pressure roller having on its surface an elastic layer of rubber with good release properties as exemplified by silicone rubber. This pressure roller is pressed against the heater element at a total pressure of from 4 to 20 kg through the film interposed between them and is rotated in pressure contact with the film. Toner 117 having not been fixed on a transfer medium 116 is led to the fixing zone by means of an inlet guide 118, and thus a fixed image is obtained by the heating described above.

The foregoing has been described with reference to an embodiment having the endless belt. Alternatively, using a sheet-feeding shaft and a wind-up shaft, the fixing film need not be endless.

In the image forming apparatus shown in FIG. 3 as described above, the developing apparatus unit of the present invention as previously described may be set as the developing assembly 5 serving as the developing means.

Figure 9:
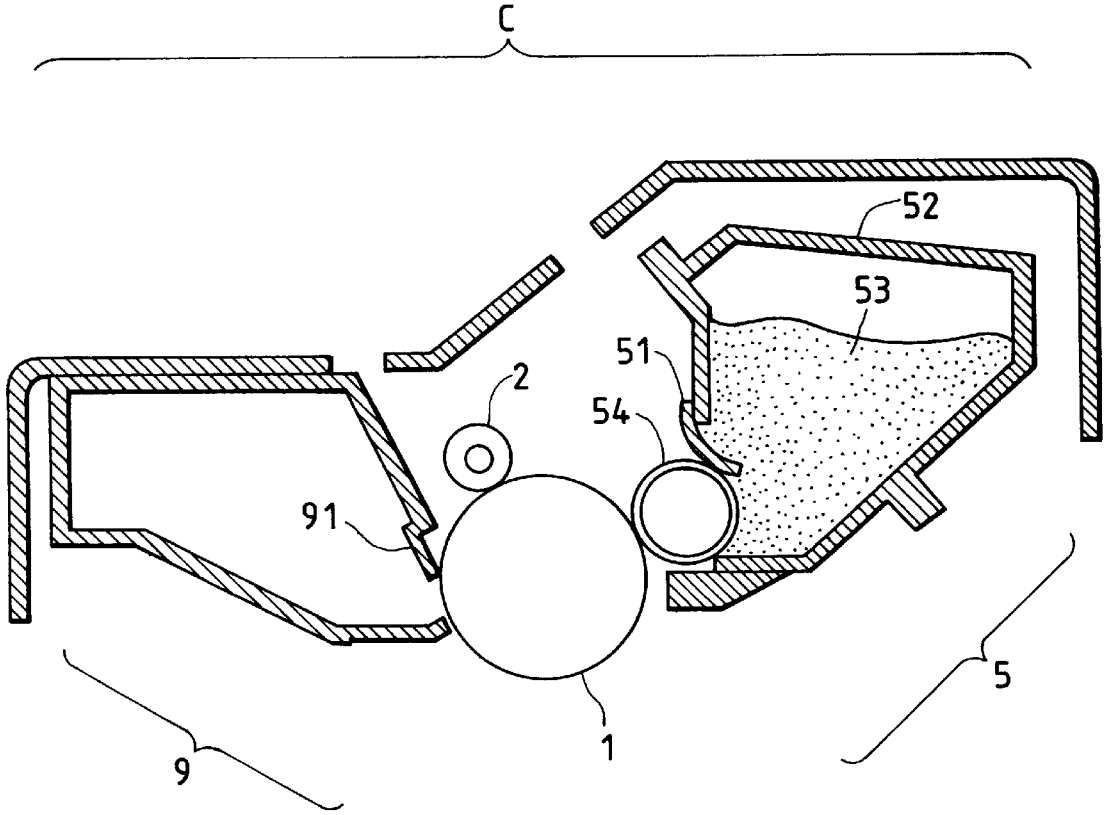
FIG. 9 is a schematic illustration used to describe an example of the process cartridge of the present invention.

FIG. 9 illustrates an example of the process cartridge of the present invention.

In the following description of the process cartridge, constituent members having the same functions as those in the image forming apparatus described with reference to FIG. 3 are denoted by the like reference numerals.

In the process cartridge of the present invention, at least the developing assembly and the latent image bearing member are joined into one unit as a cartridge, and the process cartridge is provided detachably in the body of the image forming apparatus (e.g., a copying machine, a laser beam printer or a facsimile machine).

In the embodiment shown in FIG. 9, a process cartridge C is exemplified in which a developing assembly 5, a drum-like latent image bearing member (a photosensitive drum) 1, a cleaning means 9 having a cleaning blade 91 and a charging roller 2 serving as the charging member are joined into one unit.

In this embodiment, the developing assembly 5 has an elastic blade 51 serving as the toner layer thickness control member and a toner 53 in a toner container 52 . At the time of development, a given electric field is formed across the photosensitive drum 1 and a developing sleeve 54 serving as the toner carrying member, by applying a development bias voltage from a bias applying means, to carry out the step of development. In order to preferably carried out this developing step, the distance between the photosensitive drum 1 and the developing sleeve 54 is very important.

In the foregoing, an embodiment has been described in which the four constituents, the developing assembly 5, the latent image bearing member 1, the cleaning means 9 and the charging member 2 are joined into one unit as a cartridge. In the present invention, at least two constituents, the developing assembly and the latent image bearing member, may be joined into one unit as a cartridge. It is also possible to use three constituents, the developing assembly, the latent image bearing member and the cleaning means, or three constituents, the developing assembly, the latent image bearing member and the charging member, or to add other constituent(s), so as to be joined together into one unit as a cartridge.

In the case when the image forming apparatus is used as a copying machine or a printer, in FIG. 3 the optical image exposure 4 as the latent image forming means is carried out by irradiation with light reflected from, or transmitted through, an original, or by the scanning of a laser beam, the driving of an LED array or the driving of a liquid crystal shutter array according to signals obtained by reading an original and converting the information into signals.

Figure 10:
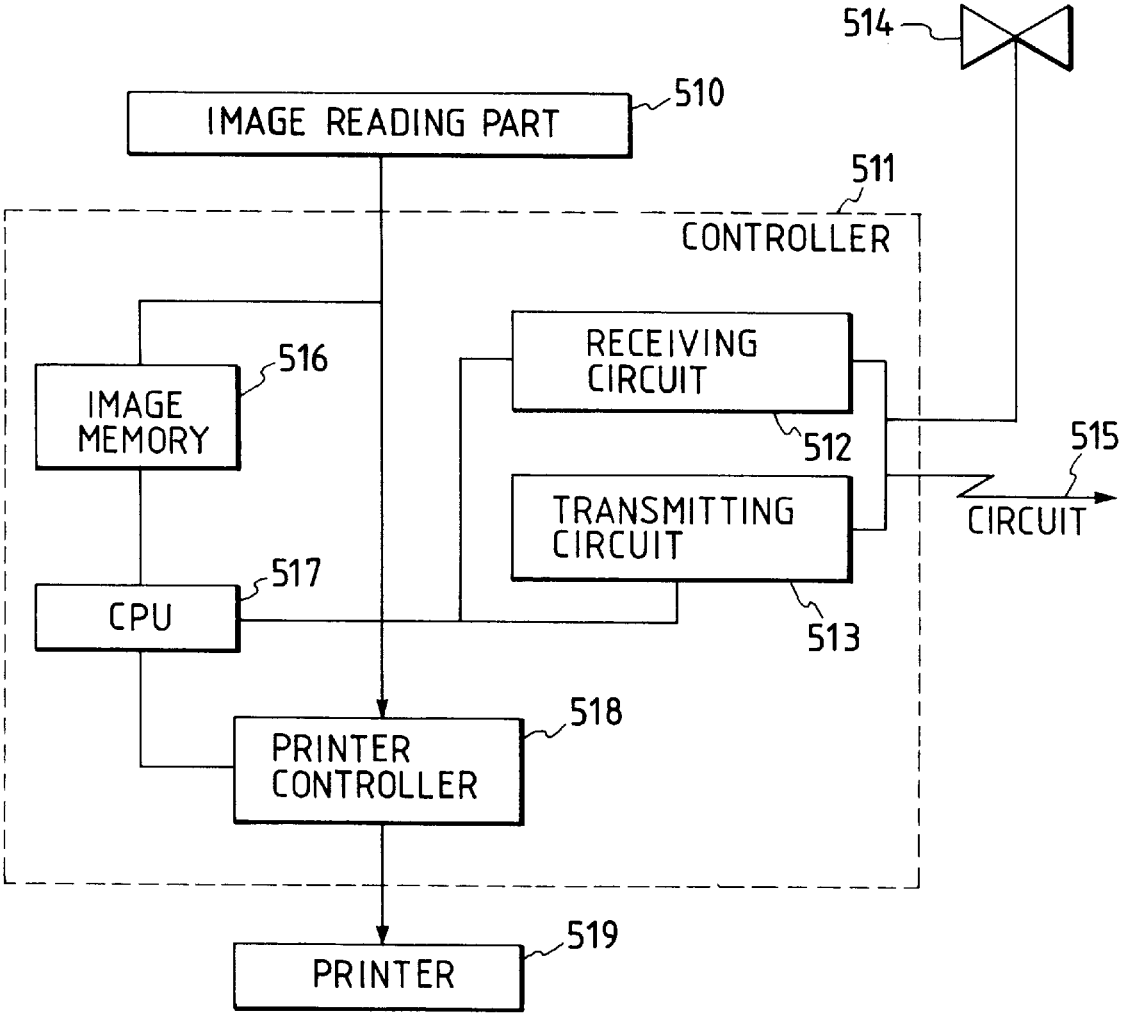
FIG. 10 is a block diagram showing an instance where the image forming method of the present invention is used in a printer of a facsimile system.

When the image forming apparatus is used as a printer of a facsimile machine, the optical image exposure 4 serves as exposing light used for the printing of received data. FIG. 10 illustrates an example thereof in the form of a block diagram.

A controller 51 controls an image reading part 510 and a printer 519. The whole of the controller 511 is controlled by CPU 517. Image data read and outputted from the image reading part are sent to the other facsimile station through a transmitting circuit 513. Data received from the other station is sent to a printer 519 through a receiving circuit 512. Given image data are stored in an image memory 516. A printer controller 518 controls the printer 519. The numeral 514 denotes a telephone.

An image received from a circuit 515 (image information from a remote terminal connected through the circuit) is demodulated in the receiving circuit 512, and then successively stored in an image memory 516 after the image information is decoded by the CPU 517. Then, when images for at least one page have been stored in the memory 516, the image recording for that page is carried out. The CPU 517 reads out the image information for one page from the memory 516 and sends the coded image information for one page to the printer controller 518. The printer controller 518, having received the image information for one page from the CPU 517, controls the printer 519 so that the image information for one page is recorded.

The CPU 517 receives image information for next page in the course of the recording by the printer 519.

Images are received and recorded in this way.

In the present invention, the toner has a mixture of i) the inorganic fine powder having been treated with the silicone oil having a specific molecular weight distribution and ii) the toner particles, and hence (i) images fog-free and having a good image quality can be formed over a long period of time, in a stable image density from the initial stage and at a high density in every environment of low temperature/low humidity, normal temperature/normal humidity and high temperature/high humidity and also at the time of toner supply and in a state free of fog, (ii) good images can be formed which are free of faulty images such as blank areas caused by poor transfer, without causing black spots around line images, offset and filming, and (iii) good images uniform and free of unevenness, white lines and blank spots can be obtained even in halftone images and solid black images.

EXAMPLES

The present invention will be described below in greater detail by giving production examples and working examples. These examples by no means limit the present invention. In the following formulation, "part(s)" refers to "part(s) by weight" in all occurrences.

Example 1

Silica Production Example 1

Silicone oil (1) was prepared by mixing 75% of dimethylsilicone oil having a peak at molecular weight of 2,000 and 25% of dimethylsilicone oil having a peak at molecular weight of 41,000. In molecular weight distribution as measured by GPC, this silicone oil (1) had peaks respectively at molecular weight of 2,100 and molecular weight of 41,000, where the distance from the vertex to its base line (height A), corresponding to the peak at molecular weight of 2,100, to the distance from the vertex to its base line (height B), corresponding to the peak value at molecular weight of 41,000 (A:B) was 1:0.30, and the distance from the bottom point to its base line (height C), corresponding to the bottom value present between the two peaks was 0.12. (see FIG. 1). The results of measurement by GPC are shown in Table 1.

While agitating 100 parts of fine silica powder produced by the dry process (trade name: AEROSIL #200; specific surface area: about 200 $m^2/g$; available from Nippon Aerosil Co., Ltd.), and keeping the temperature at about 60° C., a solution of 20 parts of the silicone oil (1) and 20 parts of hexane were sprayed to the powder. While continuing the agitation, the solvent was removed to dry the powder. Subsequently, the powder dried was heated up to 300° C. with agitation, and treated at 300° C. for 1 hour to obtain silica (1). The treatment conditions, hydrophobicity and BET specific surface area of this silica are shown in Table 2.

Toner Production Example 1

Styrene/n-butyl acrylate copolymer (St/BA: 84/16; peak molecular weight Pa: 12,000; peak molecular weight Pb: 355,000; Mn: 8,600; Mw: 178,000) 100 parts
Magnetic iron oxide 80 parts
Polypropylene wax 4 parts
Metal complex of monoazo dye 1 part The above materials were thoroughly premixed using a Henschel mixer, and then melt-kneaded using a twin-screw extruder set at 140° C. The kneaded product obtained was cooled, and then crushed with a cutter mill. Thereafter the crushed product was finely pulverized by means of a fine grinding mill utilizing jet streams, and the finely pulverized product thus obtained was classified using an air classifier to obtain toner particles (1) with a weight average particle diameter of 8.4 $\mu$m.

To 100 parts of the toner particles (1) thus obtained, 0.8 part of the silica (1) was added, followed by mixing by means of a Henschel mixer to obtain a negatively chargeable toner.

Figure 6:
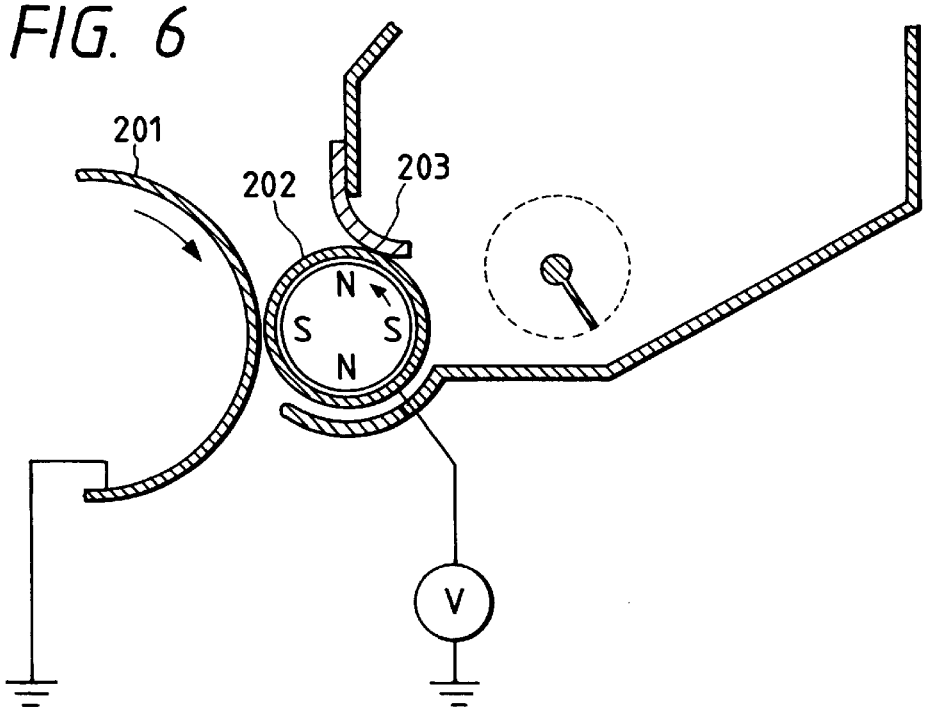
FIG. 6 is a schematic illustration of the developing apparatus unit of the present invention according to another embodiment employing an elastic blade.
Figure 7:
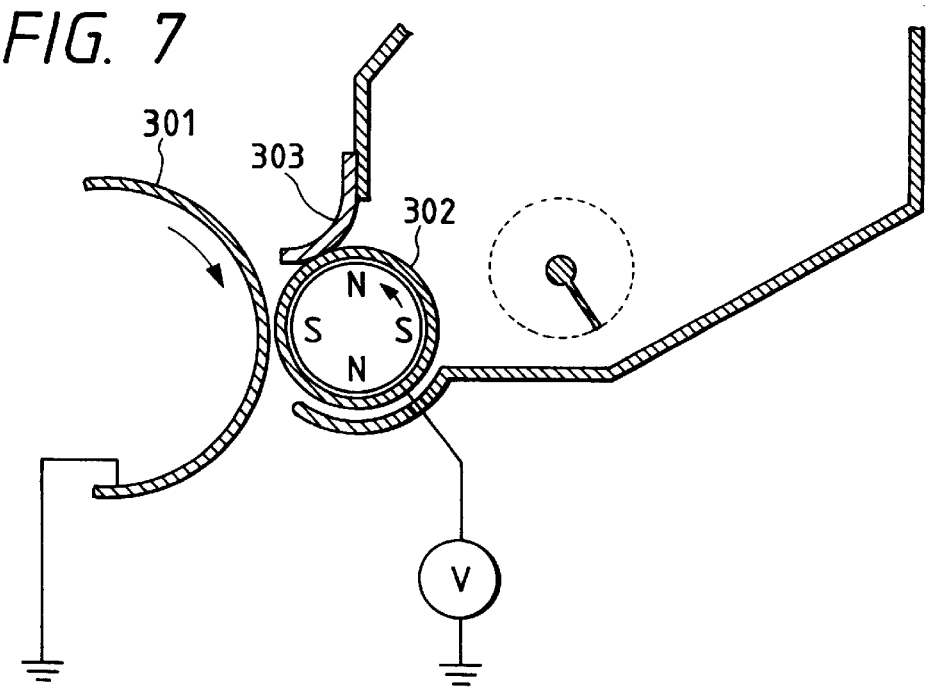
FIG. 7 is a schematic illustration of the developing apparatus unit of the present invention according to still another embodiment employing an elastic blade.

A cartridge for a commercially available laser printer LBP-A404GII (manufactured by CANON INC.) having the developing apparatus as shown in FIG. 6 was filled with this negatively chargeable toner, and images were reproduced to make evaluation.

Running test:

A 3,000 sheet running test was carried out in every environment of normal temperature/normal humidity (N/N), low temperature/low humidity (L/L), and high temperature/high humidity (H/H). Evaluation was made on image density and fog in every environment. Evaluation was also made on the level of blank images (reproducibility of character images), uniformity of halftone images, and uniformity of solid black images (unevenness, blank spots, white lines), occurrence of filming and toner melt-adhesion to the photosensitive member, and electrostatic offset, all in the environment of normal temperature/normal humidity (N/N). Evaluation was still also made on sleeve contamination after the running in the environment of high temperature/high humidity (H/H), and on negative development after the running in the environment of low temperature/low humidity (L/L).

After the running test in the environment of normal temperature/normal humidity (N/N), solid black images were continuously reproduced on five sheets of paper to make evaluation on the uniformity of solid black images at the time of continuous printing and also to make visual evaluation on any drum scratches on the photosensitive member.

Evaluation was still also made on the level of black spots around line images caused by fixing, using as transfer paper canvas note paper moisture-absorbed by leaving it to stand at least for a weak in the environment of high temperature/high humidity (H/H), and continuously printing character line images on 10 sheets.

The above evaluations were made according to the following evaluation methods.

Image Density

Square black images of 5 mm side or round black images of 5 mm diameter were formed, and their image densities were measured using an image densitometer RD918, manufactured by Macbeth Co.

Fog

The degree of developing toner quantity in non-image areas was visually evaluated.

(Evaluation criteria)

A: No fog is visually seen.

B: No fog is seen unless carefully viewed.

C: Fog is seen, but no problem in practical use.

D: Fog is conspicuous.

Sleeve Contamination

Toner was removed at some part on the surface of the developing sleeve, and that part was wiped with Silbon paper. Thereafter, solid black images were reproduced thereon to visually evaluate differences in light and shade at the part thus wiped and at the part other than that.

(Evaluation criteria)

A: No difference in density.

B: Differences in light and shade are seen when carefully viewed.

C: Differences in light and shade are seen, but no problem in practical use.

D: Differences in light and shade are conspicuous.

Negative Development

Using multi-level images formed by outputting three kinds of images composed of solid images, two-dots single-space halftone images and one-dot single-space halftone images were outputted on the same recording paper in such a way that they were continuous for every 10 mm in the feed direction, and the three kinds of images were evaluated according to the order of image density and according to the following evaluation criteria.

(Evaluation criteria)

A: Differences in light and shade appear faithfully to the gradational outputs.

B: Only a part of differences in light and shade reverses at some portion.

C: A part of differences in light and shade reverses at some part, but no problem in practical use.

D: Differences in light and shade reverse at several portions.

Uniformity of Halftone Images

Uniformity of halftone images was evaluated.

(Evaluation criteria)

A: Visually seen to be substantially uniform.

B: Slight white lines are partly seen.

C: White lines are partly seen, but no problem in practical use.

D: White lines are conspicuous.

Uniformity of Solid Black Images

Uniformity of solid black images was evaluated.

(Evaluation criteria)

A: Uniform solid black images.

B: Only very few blank spots or slight white lines or unevenness are seen.

C: Some blank spots, white lines or unevenness are seen, but no problem in practical use.

D: Blank spots, white lines or unevenness are conspicuous.

Filming and Melt-adhesion to Photosensitive Member

Solid white images were formed to examine whether or not the filming and melt-adhesion of toner occurred.

(Evaluation criteria)

A: Neither filming nor melt-adhesion is seen.

B: Partly seen when the density is increased.

C: Slightly seen in usual solid white images.

D: Conspicuous in usual solid white images.

Blank Areas Caused by Poor Transfer (Blank images)

Using cardboard (200 g/m$^2$) as a transfer medium, evaluation was made on any blank areas caused by poor transfer in line images and character images.

(Evaluation criteria)

A: Blank areas are little seen.

B: No blank areas are seen unless carefully viewed.

C: Blank areas are seen at some part, but no problem in practical use.

D: Blank areas are clearly seen.

Black Spots Caused by Fixing (Fixing blak spots)

Using transfer paper with a basis weight of 80 g/m$^2$, moisture-conditioned by leaving it in an environment of a humidity of 80%RH, line images (with 20 lines of 200 $\mu$m wide drawn at intervals of 1 cm) parallel in the fixing lengthwise direction were transferred to the paper on its side having a rougher surface, to make evaluation.

(Evaluation criteria)

A: Black spots are seen at 0 to 1 spot.

B: Black spots are seen at 10 spots or less.

C: Black spots are seen at 11 spots to 30 spots.

D: Black spots are seen at more than 30 spots.

Electrostatic Offset

Using transfer paper with a basis weight of 80 g/m$^2$ (A4-size, fed lengthwise), images having 60% halftone in the forward direction of the A4 paper were reproduced on 100 sheets, which were transferred to the paper on its side having a rougher surface, to make evaluation.

(Evaluation criteria)

A: Neither white background stains nor back-side stains are seen.

B: Neither white background stains nor back-side stains are seen unless carefully viewed.

C: White background stains and back-side stains are a little seen, but no problem in practical use.

D: White background stains and back-side stains are conspicuous.

Drum Scratches on Photosensitive Member

Solid white images and halftone images were formed to make evaluation.

A: No scratches appearing on the images are seen.

B: Scratches slightly appearing on the halftone images (3 lines or less) are seen.

C: Scratches appearing on the halftone images are seen.

D: Scratches appearing on usual images are seen.

The results of evaluation are shown in Table 3.

Example 2

Silicone oil (2) was prepared to obtain silica (2) in the same manner as in Example 1 except that 90% of dimethylsilicone oil having a peak at molecular weight of 2,000 and 10% of dimethylsilicone oil having a peak at molecular weight of 11,000 were used.

To 100 parts of the toner particles (1), 0.8 part of the silica (2) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Example 3

Silicone oil (3) was prepared to obtain silica (3) in the same manner as in Example 1 except that 73% of dimethylsilicone oil having a peak at molecular weight of 1,200 and 27% of dimethylsilicone oil having a peak at molecular weight of 7,000 were used.

To 100 parts of the toner particles (1), 0.8 part of the silica (3) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Example 4

Silicone oil (4) was prepared to obtain silica (4) in the same manner as in Example 1 except that 60% of methylphenylsilicone oil having a peak at molecular weight of 550 and 40% of dimethylsilicone oil having a peak at molecular weight of 3,500 were used.

To 100 parts of the toner particles (1), 0.8 part of the silica (4) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Example 5

Silicone oil (5) was prepared to obtain silica (5) in the same manner as in Example 1 except that 70% of dimethylsilicone oil having a peak at molecular weight of 6,000 and 30% of methylphenylsilicone oil having a peak at molecular weight of 28,000 were used.

To 100 parts of the toner particles (1), 0.8 part of the silica (5) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Example 6

Silicone oil (6) was prepared to obtain silica (6) in the same manner as in Example 1 except that 55% of dimethylsilicone oil having a peak at molecular weight of 12,000 and 45% of dimethylsilicone oil having a peak at molecular weight of 89,000 were used.

To 100 parts of the toner particles (1), 0.8 part of the silica (6) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Example 7

Silicone oil (7) was prepared to obtain silica (7) in the same manner as in Example 1 except that 65% of dimethylsilicone oil having a peak at molecular weight of 1,400 and 35% of dimethylsilicone oil having a peak at molecular weight of 89,000 were used.

To 100 parts of the toner particles (1), 0.8 part of the silica (7) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Example 8

Using titania as a fine powder matrix, it was treated with 15 parts of silicone oil (1) in the same manner as in Example 1 to obtain titania (8).

To 100 parts of the toner particles (1), 0.8 part of the titania (8) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Example 9

Using alumina as a fine powder matrix, it was treated with 12 parts of silicone oil (1) in the same manner as in Example 1 to obtain alumina (9).

To 100 parts of the toner particles (1), 0.8 part of the alumina (9) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Comparative Example 1

Silica (10) was obtained in the same manner as in Example 1 except that only dimethylsilicone oil (8) having a peak at molecular weight of 2,000 was used.

To 100 parts of the toner particles (1), 0.8 part of the silica (10) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Comparative Example 2

Silica (11) was obtained in the same manner as in Example 1 except that only dimethylsilicone oil (9) having a peak at molecular weight of 50,000 was used.

To 100 parts of the toner particles (1), 0.8 part of the silica (11) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Comparative Example 3

Silicone oil (10) was prepared to obtain silica (12) in the same manner as in Example 1 except that 60% of dimethylsilicone oil having a peak at molecular weight of 450 and 40% of dimethylsilicone oil having a peak at molecular weight of 12,500 were used.

To 100 parts of the toner particles (1), 0.8 part of the silica (12) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Comparative Example 4

Silicone oil (11) was prepared to obtain silica (13) in the same manner as in Example 1 except that 65% of dimethylsilicone oil having a peak at molecular weight of 17,500 and 35% of dimethylsilicone oil having a peak at molecular weight of 89,000 were used.

To 100 parts of the toner particles (1), 0.8 part of the silica (13) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Comparative Example 5

Silicone oil (12) was prepared to obtain silica (14) in the same manner as in Example 1 except that 75% of dimethylsilicone oil having a peak at molecular weight of 1,200 and 25% of dimethylsilicone oil having a peak at molecular weight of 2,100 were used.

To 100 parts of the toner particles (1), 0.8 part of the silica (14) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

Comparative Example 6

Silicone oil (13) was prepared to obtain silica (15) in the same manner as in Example 1 except that 65% of dimethylsilicone oil having a peak at molecular weight of 1,200 and 35% of dimethylsilicone oil having a peak at molecular weight of 105,000 were used.

To 100 parts of the toner particles (1), 0.8 part of the silica (15) was added, followed by mixing by means of a Henschel mixer to obtain a negatively chargeable toner.

Using the negatively chargeable toner obtained, images were reproduced and evaluated in the same manner as in Example 1.

The results of evaluation are shown in Table 3.

TABLE 1

| | GPC data | | | | | | | | | |
|---|---|---|---|---|---|---|---|---|---|---|
| Silicone oil | Peak molecular weight Pa | Peak or shoulder molecular weight Pb | A | B | C | Mn | Mw | Mz | Mw/Mn | Mz/Mn |
| (1) | 2,100 | *P 41,000 | 1.00 | 0.30 | 0.12 | 2,030 | 12,100 | 51,900 | 5.97 | 25.6 |
| (2) | 2,100 | S 11,000 | 1.00 | 0.11 | — | 1,690 | 3,480 | 8,880 | 2.06 | 5.25 |
| (3) | 1,400 | S 7,100 | 1.00 | 0.28 | — | 1,140 | 3,080 | 9,250 | 2.7 | 8.11 |
| (4) | 530 | P 3,800 | 1.00 | 0.10 | 0.03 | 790 | 2,020 | 5,840 | 2.56 | 7.39 |
| (5) | 6,000 | S 27,000 | 1.00 | 0.47 | — | 4,510 | 11,560 | 25,460 | 2.56 | 5.65 |
| (6) | 12,500 | P 89,000 | 1.00 | 0.67 | 0.47 | 12,840 | 46,100 | 110,200 | 3.59 | 8.58 |
| (7) | 1,400 | P 89,000 | 1.00 | 0.46 | 0.02 | 1,360 | 31,100 | 123,000 | 22.9 | 90.4 |
| (8) | 2,100 | — | — | — | — | 2,070 | 1,770 | 3,430 | 0.86 | 1.66 |
| (9) | — | P 48,000 | — | — | — | 26,300 | 47,100 | 70,000 | 1.79 | 2.66 |
| (10) | 450 | P 12,500 | 1.00 | 0.11 | 0.001 | 720 | 5,200 | 16,400 | 7.22 | 22.8 |
| (11) | 17,500 | P 89,000 | 1.00 | 0.43 | 0.40 | 14,900 | 41,700 | 99,500 | 2.8 | 6.68 |
| (12) | 1,400 | — | — | — | — | 870 | 1,440 | 2,340 | 1.66 | 2.69 |
| (13) | 1,200 | P105,000 | 1.00 | 0.46 | 0.004 | 1,170 | 35,900 | 143,300 | 30.7 | 122 |

| Silicone oil | Types of silicone oil (content: %) | |
|---|---|---|
| (1) | Dimethylsilicone oil (75) | Dimethylsilicone oil (25) |
| (2) | Dimethylsilicone oil (90) | Dimethylsilicone oil (10) |
| (3) | Dimethylsilicone oil (73) | Dimethylsilicone oil (27) |
| (4) | Methylphenylsilicone oil (60) | Dimethylsilicone oil (40) |
| (5) | Dimethylsilicone oil (70) | Methylphenylsilicone oil (30) |
| (6) | Dimethylsilicone oil (55) | Dimethylsilicone oil (45) |
| (7) | Dimethylsilicone oil (65) | Dimethylsilicone oil (35) |
| (8) | Dimethylsilicone oil (100) | |
| (9) | — | Dimethylsilicone oil (100) |
| (10) | Dimethylsilicone oil (60) | Dimethylsilicone oil (40) |
| (11) | Dimethylsilicone oil (65) | Dimethylsilicone oil (35) |
| (12) | Dimethylsilicone oil (75) | Dimethylsilicone oil (25) |
| (13) | Dimethylsilicone oil (65) | Dimethylsilicone oil (35) |

*P: Peak molecular weight;
S: Shoulder molecular weight

TABLE 2

| | | Matrix fine powder | Matrix specific surface area ($m^2/g$) | Type of silicone oil | Oil treatment quantity (pbw)* | Hydro-phobicity (%) | Specific surface area after treatment ($m^2g$) |
|---|---|---|---|---|---|---|---|
| Example: | | | | | | | |
| 1 | Silica (1) | Silica | 200 | Silicone oil (1) | 20 | 95 | 126 |
| 2 | Silica (2) | Silica | 200 | Silicone oil (2) | 20 | 93 | 128 |
| 3 | Silica (3) | Silica | 200 | Silicone oil (3) | 20 | 95 | 126 |
| 4 | Silica (4) | Silica | 200 | Silicone oil (4) | 20 | 87 | 132 |
| 5 | Silica (5) | Silica | 200 | Silicone oil (5) | 20 | 85 | 101 |
| 6 | Silica (6) | Silica | 150 | Silicone oil (6) | 29 | 82 | 107 |
| 7 | Silica (7) | Silica | 100 | Silicone oil (7) | 20 | 87 | 115 |
| 8 | Titania (8) | Titania | 200 | Silicone oil (1) | 15 | 85 | 103 |
| 9 | Alumina (9) | Alumina | 200 | Silicone oil (1) | 12 | 83 | 81 |
| Comparative Example: | | | | | | | |
| 1 | Silica (10) | Silica | 200 | Silicone oil (8) | 20 | 91 | 107 |
| 2 | Silica (11) | Silica | 200 | Silicone oil (9) | 20 | 75 | 83 |

TABLE 2-continued

| | | Matrix fine powder | Matrix specific surface area ($m^2/g$) | Type of silicone oil | Oil treatment quantity (pbw)* | Hydro-phobicity (%) | Specific surface area after treatment ($m^2g$) |
|---|---|---|---|---|---|---|---|
| 3 | Silica (12) | Silica | 200 | Silicone oil (10) | 20 | 82 | 105 |
| 4 | Silica (13) | Silica | 200 | Silicone oil (11) | 20 | 76 | 85 |
| 5 | Silica (14) | Silica | 200 | Silicone oil (12) | 20 | 90 | 120 |
| 6 | Silica (15) | Silica | 200 | Silicone oil (13) | 20 | 70 | 94 |

*Amount of treatment with silicone oil, based on 100 parts by weight of matrix powder

TABLE 3

| | Example | | | | | | | | |
|---|---|---|---|---|---|---|---|---|---|
| | 1 | 2 | 3 | 4 | 5 | 6 | 7 | 8 | 9 |
| Running performance | | | | | | | | | |
| N/N: Initial stage/ | | | | | | | | | |
| Image density: | 1.4 | 1.41 | 1.35 | 1.3 | 1.41 | 1.4 | 1.4 | 1.4 | 1.39 |
| Fog: | A | A | A | A | A | A | A | A | A |
| After running/ | | | | | | | | | |
| Image density: | 1.42 | 1.39 | 1.37 | 1.35 | 1.44 | 1.41 | 1.37 | 1.4 | 1.39 |
| Fog: | A | A | A | A | A | A | A | A | A |
| L/L: Initial stage/ | | | | | | | | | |
| Image density: | 1.44 | 1.43 | 1.4 | 1.37 | 1.42 | 1.4 | 1.43 | 1.41 | 1.41 |
| Fog: | A | A | A | A | A | A | A | A | A |
| After running/ | | | | | | | | | |
| Image density: | 1.43 | 1.42 | 1.4 | 1.4 | 1.43 | 1.38 | 1.42 | 1.4 | 1.4 |
| Fog: | A | A | A | A | A | B | A | A | A |
| H/H: Initial stage/ | | | | | | | | | |
| Image density: | 1.4 | 1.35 | 1.36 | 1.28 | 1.36 | 1.37 | 1.37 | 1.37 | 1.35 |
| Fog: | A | A | A | B | A | A | A | A | A |
| After running/ | | | | | | | | | |
| Image density: | 1.4 | 1.37 | 1.34 | 1.31 | 1.39 | 1.38 | 1.32 | 1.35 | 1.34 |
| Fog: | A | A | B | B | A | A | A | A | A |
| Sleeve contamination (H/H): | A | A | B | B | A | A | A | A | A |
| Negative development (L/L): | A | A | A | A | A | B | A | A | A |
| Halftone image uniformity (Unevenness, lines): | A | A | A | B | A | A | A | A | A |
| Solid black image uniformity | | | | | | | | | |
| (White lines, white spots): | A | A | A | A | B | B | C | A | A |
| (After continuous 5 sheets): | A | B | B | C | A | A | B | B | B |
| Filming and melt-adhesion to photosensitive member (Image quality evaluation): | A | A | C | C | A | A | B | A | A |
| Image quality evaluation | | | | | | | | | |
| Blank images: | A | B | C | C | A | A | A | A | A |
| Fixing black spots: | A | A | B | B | A | A | B | B | B |
| Electrostatic offset: | A | A | A | A | A | A | B | B | B |
| Drum scratches on photosensitive member (Visual examination of drum): | A | A | A | A | A | A | C | B | A |

| | Comparative Example | | | | | |
|---|---|---|---|---|---|---|
| | 1 | 2 | 3 | 4 | 5 | 6 |
| Running performance | | | | | | |
| N/N: Initial stage/ | | | | | | |
| Image density: | 1.2 | 1.4 | 1.35 | 1.37 | 1.28 | 1.4 |
| Fog: | C | B | B | A | A | A |

TABLE 3-continued

| | | | | | | |
|---|---|---|---|---|---|---|
| After running/ | | | | | | |
| Image density: | 1.33 | 1.44 | 1.36 | 1.35 | 1.37 | 1.34 |
| Fog: | A | B | A | A | A | A |
| L/L: Initial stage/ | | | | | | |
| Image density: | 1.32 | 1.41 | 1.25 | 1.41 | 1.29 | 1.44 |
| Fog: | A | D | D | C | D | A |
| After running/ | | | | | | |
| Image density: | 1.37 | 1.39 | 1.36 | 1.22 | 1.35 | 1.2 |
| Fog: | A | C | C | B | C | B |
| H/H: Initial stage/ | | | | | | |
| Image density: | 1.15 | 1.35 | 1.34 | 1.36 | 1.4 | 1.4 |
| Fog: | C | B | B | C | A | A |
| After running/ | | | | | | |
| Image density: | 1.22 | 1.3 | 1.19 | 1.02 | 1.15 | 1.1 |
| Fog: | B | C | C | D | B | B |
| Sleeve contamination (H/H): | D | A | D | A | D | A |
| Negative development (L/L): | A | D | A | D | C | D |
| Halftone image uniformity (Unevenness, lines): | B | D | C | C | B | C |
| Solid black image uniformity | | | | | | |
| (White lines, white spots): | A | D | C | D | A | D |
| (After continuous 5 sheets): | C | A | D | A | D | A |
| Filming and melt-adhesion to photosensitive member (Image quality evaluation): | D | D | C | D | D | C |
| Image quality evaluation | | | | | | |
| Blank images: | D | A | A | A | D | A |
| Fixing black spots: | C | B | C | A | D | A |
| Electrostatic offset: | C | B | C | A | C | A |
| Drum scratches on photosensitive member (Visual examination of drum): | C | B | A | C | C | D |

Example 10

Silica Production Example 16

Silicone oil (14) was prepared by mixing 70% of amino-modified silicone oil having a peak at molecular weight of 5,500 and 30% of amino-modified silicone oil having a peak at molecular weight of 37,000. In molecular weight distribution as measured by GPC, this silicone oil (14) had a peak at molecular weight of 5,500 and a shoulder at molecular weight of 37,000, where the distance from the vertex to its base line (height A), corresponding to the peak at molecular weight of 5,500, to the distance from the point of inflection of to its base line (height B), corresponding to the the shoulder at molecular weight of 37,000 (A:B) was 1:0.44. The results of measurement by GPC and the amine equivalent weight are shown in Table 4.

While agitating 100 parts of fine silica powder produced by the dry process (trade name: AEROSIL #200; specific surface area: about 200 $m^2/g$; available from Nippon Aerosil Co., Ltd.), and keeping the temperature at about 60° C., a solution of 20 parts of the silicone oil (14) and 20 parts of hexane were sprayed to the powder. While continuing the agitation, the solvent was removed to dry the powder. Subsequently, the powder dried was heated up to 250° C. with agitation, and treated at 250° C. for 1 hour to obtain silica (16). The treatment conditions, hydrophobicity and BET specific surface area of this silica are shown in Table 4.

Toner Production Example 2

Styrene/n-butyl acrylate copolymer (St/BA: 83/17; peak molecular weight Pa: 11,000; peak molecular weight Pb: 340,000; Mn: 8,800; Mw: 180,000) 100 parts
Magnetic iron oxide 80 parts
Polypropylene wax 4 parts
Nigrosine dye 2 part The above materials were thoroughly premixed using a Henschel mixer, and then melt-kneaded using a twin-screw extruder set at 140° C. The kneaded product obtained was cooled, and then crushed with a cutter mill. Thereafter the crushed product was finely pulverized by means of a fine grinding mill utilizing jet streams, and the finely pulverized product thus obtained was classified using an air classifier to obtain toner particles (2) with a weight average particle diameter of 8.6 $\mu$m.

To 100 parts of the toner particles (2) thus obtained, 0.8 part of the silica (16) was added, followed by mixing by means of a Henschel mixer to obtain a positively chargeable toner.

This positively chargeable toner was applied in the developing apparatus unit shown in FIG. 5, set in a modified machine of a commercially available copying machine NP6030 (manufactured by CANON INC.) from which a felt pad serving as the cleaning member for cleaning the contact charging member had been detached, and images were reproduced to make evaluation.

Running test:

A 10,000 sheet running test was carried out in every environment of normal temperature/normal humidity (N/N), low temperature/low humidity (L/L), and high temperature/high humidity (H/H). Evaluation was made on image density, fog and difference in density before and after toner supply in every environment. Evaluation was also made on the state of coat on the developing sleeve in the environment of low temperature/low humidity (L/L) and on sleeve contamination in the environment of high temperature/high humidity (H/H). Evaluation was still also made on the level of blank images (reproducibility of character images),. uniformity of halftone images, and uniformity of solid black images (unevenness, blank spots, white lines). After the running test, solid black images were continuously reproduced on five sheets of paper to make evaluation on the uniformity at the time of continuous copying.

Evaluation was still also made on occurrence of filming and toner melt-adhesion to the photosensitive member. The charging member was cleaned, and the halftone images were reproduced to make visual evaluation on occurrence of any drum scratches on the photosensitive member.

The above evaluations were made according to the same evaluation methods as in Example 1 in respect of image density, fog, sleeve contamination, blank images, uniformity of halftone images, uniformity of solid black images, occurrence of filming and toner melt-adhesion to the photosensitive member, and drum scratches of the photosensitive member. In respect of the state of coat on the developing sleeve, the evaluation was made according to the following method.

State of Coat on Sleeve

The toner was put in a hopper container. An empty developing assembly was set in the main body, and the toner was put in the developing assembly. The state of toner coat on the developing sleeve was visually observed, and also halftone images and solid white images to make evaluation from the viewpoint of images.

(Evaluation criteria)

A: Uniform on the sleeve. Images are also uniform.

B: Slightly uneven coat on the sleeve, but not appears on the images.

C: Slightly uneven halftone images are seen, but no problem in practical use.

D: Uneven images are seen.

The results of evaluation are shown in Table 6.

Example 11

Silicone oil (15) was prepared to obtain silica (17) in the same manner as in Example 10 except that 75% of amino-modified silicone oil having a peak at molecular weight of 3,500 and 25% of amino-modified silicone oil having a peak at molecular weight of 14,000 were used.

To 100 parts of the toner particles (2), 0.8 part of the silica (17) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Example 12

Silicone oil (16) was prepared to obtain silica (18) in the same manner as in Example 10 except that 70% of amino-modified silicone oil having a peak at molecular weight of 1,500 and 30% of amino-modified silicone oil having a peak at molecular weight of 6,000 were used.

To 100 parts of the toner particles (2), 0.8 part of the silica (18) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Example 13

Silicone oil (17) was prepared in the same manner as in Example 10 except that 80% of amino-modified silicone oil having a peak at molecular weight of 12,000 and 20% of amino-modified silicone oil having a peak at molecular weight of 89,000 were used. Using titania as a fine powder matrix, it was treated with 15 parts of silicone oil (17) to obtain titania (19). Treatment conditions and physical properties are shown in Table 5.

To 100 parts of the toner particles (2), 0.8 part of the titania (19) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Example 14

Silicone oil (18) was prepared to obtain silica (20) in the same manner as in Example 10 except that 85% of amino-modified silicone oil having a peak at molecular weight of 1,500 and 15% of amino-modified silicone oil having a peak at molecular weight of 89,000 were used.

To 100 parts of the toner particles (2), 0.8 part of the silica (20) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Example 15

Silicone oil (19) was prepared to obtain silica (21) in the same manner as in Example 10 except that 80% of amino-modified silicone oil having a peak at molecular weight of 5,100 and 20% of amino-modified silicone oil having a peak at molecular weight of 76,000 were used.

To 100 parts of the toner particles (2), 0.8 part of the silica (21) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Comparative Example 6A

Silicone oil (20) was prepared to obtain silica (22) in the same manner as in Example 10 except that 91% of amino-modified silicone oil having a peak at molecular weight of 1,000 and 9% of amino-modified silicone oil having a peak at molecular weight of 6,000 were used.

To 100 parts of the toner particles (2), 0.8 part of the silica (22) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Comparative Example 7

Silica (23) was obtained in the same manner as in Example 10 except that only amino-modified silicone oil (21) having a peak at molecular weight of 5,500 was used.

To 100 parts of the toner particles (2), 0.8 part of the silica (23) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Comparative Example 8

Silica (24) was obtained in the same manner as in Example 10 except that only amino-modified silicone oil (22) having a peak at molecular weight of 37,000 was used.

To 100 parts of the toner particles (2), 0.8 part of the silica (24) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Comparative Example 9

Silicone oil (23) was prepared to obtain silica (25) in the same manner as in Example 10 except that 20% of amino-modified silicone oil having a peak at molecular weight of 450 and 80% of amino-modified silicone oil having a peak at molecular weight of 27,000 were used.

To 100 parts of the toner particles (2), 0.8 part of the silica (25) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Comparative Example 10

Silicone oil (24) was prepared to obtain silica (26) in the same manner as in Example 10 except that 80% of amino-modified silicone oil having a peak at molecular weight of 17,500 and 20% of amino-modified silicone oil having a peak at molecular weight of 89,000 were used.

To 100 parts of the toner particles (2), 0.8 part of the silica (26) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Comparative Example 11

Silicone oil (25) was prepared to obtain silica (27) in the same manner as in Example 10 except that 65% of amino-modified silicone oil having a peak at molecular weight of 1,400 and 35% of amino-modified silicone oil having a peak at molecular weight of 2,100 were used.

To 100 parts of the toner particles (2), 0.8 part of the silica (27) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

Comparative Example 12

Silicone oil (26) was prepared to obtain silica (28) in the same manner as in Example 10 except that 60% of amino-modified silicone oil having a peak at molecular weight of 1,400 and 40% of amino-modified silicone oil having a peak at molecular weight of 125,000 were used.

To 100 parts of the toner particles (2), 0.8 part of the silica (28) was added, followed by mixing by means of a Henschel mixer to obtain a positively chargeable toner.

Using the positively chargeable toner obtained, images were reproduced and evaluated in the same manner as in Example 10.

The results of evaluation are shown in Table 6.

TABLE 4

| | GPC data | | | | | | | | | | |
|---|---|---|---|---|---|---|---|---|---|---|---|
| Silicone oil | Peak molecular weight Pa | Peak or shoulder molecular weight Pb | A | B | C | Mn | Mw | Mz | Mw/Mn | Mz/Mn | Amine equivalent weight (g/mol) |
| (14) | 5,500 | *S 37,000 | 1.00 | 0.44 | — | 4,650 | 14,000 | 35,700 | 3.01 | 7.68 | 3,410 |
| (15) | 3,500 | S 14,000 | 1.00 | 0.47 | — | 2,800 | 6,600 | 13,700 | 2.36 | 4.89 | 1,080 |
| (16) | 1,600 | S 6,000 | 1.00 | 0.34 | — | 1,300 | 3,100 | 7,900 | 2.38 | 6.08 | 520 |
| (17) | 12,000 | P 89,000 | 1.00 | 0.22 | 0.18 | 11,200 | 30,100 | 86,200 | 2.69 | 7.70 | 8,740 |
| (18) | 1,400 | P 90,000 | 1.00 | 0.15 | 0.03 | 1,360 | 31,100 | 123,000 | 22.9 | 90.4 | 700 |
| (19) | 5,100 | P 76,000 | 1.00 | 0.33 | 0.16 | 2,400 | 18,900 | 88,000 | 7.88 | 36.7 | 10,300 |
| (20) | 1,000 | S 6,000 | 1.00 | 0.08 | — | 730 | 1,500 | 5,200 | 2.05 | 7.12 | 280 |
| (21) | 5,500 | — | — | — | — | 3,600 | 6,600 | 10,600 | 1.83 | 2.94 | 6,000 |
| (22) | — | P 37,000 | — | — | — | 15,100 | 31,700 | 48,000 | 2.1 | 3.18 | 1,700 |
| (23) | 450 | P 27,000 | 1.00 | 1.24 | 0.03 | 2,090 | 19,300 | 35,200 | 9.23 | 16.8 | 1,900 |
| (24) | 17,500 | P 89,000 | 1.00 | 0.21 | 0.20 | 12,900 | 32,000 | 83,800 | 2.48 | 6.5 | 2,920 |
| (25) | 1,600 | — | — | — | — | 1,050 | 1,700 | 2,600 | 1.62 | 2.48 | 660 |
| (26) | 1,400 | P125,000 | 1.00 | 0.57 | 0.01 | 1,520 | 49,400 | 167,000 | 32.5 | 110 | 740 |

*P: Peak molecular weight;
S: Shoulder molecular weight

TABLE 5

| | | Matrix fine powder | Matrix specific surface area ($m^2/g$) | Type of silicone oil | Oil treatment quantity (pbw)* | Hydro-phobicity (%) | Specific surface area after treatment ($m^2/g$) |
|---|---|---|---|---|---|---|---|
| Example: | | | | | | | |
| 10 | Silica (16) | Silica | 200 | Silicone oil (14) | 20 | 89 | 118 |
| 11 | Silica (17) | Silica | 200 | Silicone oil (15) | 20 | 90 | 120 |
| 12 | Silica (18) | Silica | 200 | Silicone oil (16) | 20 | 84 | 125 |
| 13 | Titania (19) | Titania | 150 | Silicone oil (17) | 15 | 79 | 108 |
| 14 | Silica (20) | Silica | 200 | Silicone oil (18) | 20 | 83 | 117 |
| 15 | Silica (21) | Silica | 200 | Silicone oil (19) | 20 | 84 | 114 |
| | Comparative Example 6A Silica (22) | Silica | 200 | Silicone oil (20) | 20 | 83 | 115 |
| Comparative Example: | | | | | | | |
| 7 | Silica (23) | Silica | 200 | Silicone oil (21) | 20 | 84 | 119 |
| 8 | Silica (24) | Silica | 200 | Silicone oil (22) | 20 | 72 | 87 |
| 9 | Silica (25) | Silica | 200 | Silicone oil (23) | 20 | 88 | 114 |
| 10 | Silica (26) | Silica | 200 | Silicone oil (24) | 20 | 77 | 109 |
| 11 | Silica (27) | Silica | 200 | Silicone oil (25) | 20 | 88 | 121 |
| 12 | Silica (28) | Silica | 200 | Silicone oil (26) | 20 | 80 | 116 |

*Amount of treatment with silicone oil, based on 100 parts by weight of matrix powder

TABLE 6

| | Example | | | | | | Comparative Example |
|---|---|---|---|---|---|---|---|
| | 10 | 11 | 12 | 13 | 14 | 15 | 6A |
| Running performance | | | | | | | |
| N/N: Initial stage/ | | | | | | | |
| Image density: | 1.41 | 1.37 | 1.35 | 1.36 | 1.39 | 1.32 | 1.30 |
| Fog: | A | A | A | A | A | C | C |
| After running/ | | | | | | | |
| Image density: | 1.4 | 1.39 | 1.4 | 1.39 | 1.4 | 1.29 | 1.37 |
| Fog: | A | A | A | A | A | B | B |
| Density difference*: | Δ0.02 | Δ0.03 | Δ0.10 | Δ0.01 | Δ0.03 | Δ0.04 | Δ0.03 |
| L/L: Initial stage/ | | | | | | | |
| Image density: | 1.42 | 1.42 | 1.43 | 1.4 | 1.43 | 1.37 | 1.25 |
| Fog: | A | B | C | A | C | A | C |
| After running/ | | | | | | | |
| Image density: | 1.4 | 1.4 | 1.39 | 1.39 | 1.4 | 1.36 | 1.22 |
| Fog: | A | A | B | A | B | A | C |
| Density difference*: | Δ0 | Δ0.02 | Δ0.05 | Δ0 | Δ0.01 | Δ0.04 | Δ0.03 |
| H/H: Initial stage/ | | | | | | | |
| Image density: | 1.38 | 1.35 | 1.32 | 1.37 | 1.37 | 1.35 | 1.40 |
| Fog: | A | A | A | A | A | A | A |
| After running/ | | | | | | | |
| Image density: | 1.39 | 1.4 | 1.4 | 1.3 | 1.35 | 1.20 | 1.38 |
| Fog: | A | A | A | B | A | C | A |
| Density difference*: | Δ0.03 | Δ0.06 | Δ0.12 | Δ0.03 | Δ0.03 | Δ0.09 | Δ0.07 |
| Sleeve contamination (H/H): | A | B | C | A | A | A | C |
| Coat on sleeve (L/L): | A | B | C | A | C | A | C |
| Halftone image uniformity (Unevenness, lines): | B | C | C | C | C | B | B |
| Solid black image uniformity | | | | | | | |
| (White lines, white spots): | A | A | A | C | B | A | A |
| (After continuous 5 sheets): | A | B | B | B | B | A | A |
| Filming and melt-adhesion to photosensitive member | A | A | C | A | A | A | A |

TABLE 6-continued

| | | | | | | | |
|---|---|---|---|---|---|---|---|
| (Image quality evaluation): Image quality evaluation | | | | | | | |
| Blank images: | B | C | C | B | B | B | C |
| Drum scratches (Halftone lines): | B | B | B | B | C | B | B |
| | Comparative Example | | | | | | |
| | 7 | 8 | 9 | 10 | 11 | 12 | |
| Running performance | | | | | | | |
| N/N: Initial stage/ | | | | | | | |
| Image density: | 1.36 | 1.4 | 1.36 | 1.39 | 1.28 | 1.4 | |
| Fog: | A | C | C | C | A | A | |
| After running/ | | | | | | | |
| Image density: | 1.32 | 1.33 | 1.3 | 1.34 | 1.37 | 1.37 | |
| Fog: | A | B | B | B | A | A | |
| Density difference*: | Δ0.13 | Δ0.01 | Δ0.04 | Δ0.02 | Δ0.15 | Δ0.03 | |
| L/L: Initial stage/ | | | | | | | |
| Image density: | 1.4 | 1.41 | 1.35 | 1.4 | 1.36 | 1.4 | |
| Fog: | A | D | D | C | A | C | |
| After running/ | | | | | | | |
| Image density: | 1.36 | 1.38 | 1.4 | 1.37 | 1.38 | 1.4 | |
| Fog: | A | C | B | B | A | C | |
| Density difference*: | Δ0.10 | Δ0 | Δ0.06 | Δ0.01 | Δ0.12 | Δ0.04 | |
| H/H: Initial stage/ | | | | | | | |
| Image density: | 1.38 | 1.4 | 1.37 | 1.35 | 1.38 | 1.37 | |
| Fog: | A | C | D | C | A | C | |
| After running/ | | | | | | | |
| Image density: | 1.25 | 1.2 | 1.33 | 1.18 | 1.0 | 1.23 | |
| Fog: | B | B | C | C | B | B | |
| Density difference*: | Δ0.16 | Δ0.05 | Δ0.10 | Δ0.10 | Δ0.20 | Δ0.03 | |
| Sleeve contamination (H/H): | C | A | B | B | D | A | |
| Coat on sleeve (L/L): | A | D | C | D | A | C | |
| Halftone image uniformity (White lines, white spots): | C | C | C | C | C | C | |
| Solid black image uniformity | | | | | | | |
| (Unevenness, lines): | A | D | A | D | A | C | |
| (After continuous 5 sheets): | C | A | A | B | B | B | |
| Filming and melt-adhesion to photosensitive member | C | D | C | D | C | D | |
| (Image quality evaluation): Image quality evaluation | | | | | | | |
| Blank images: | D | B | B | B | D | B | |
| Drum scratches (Halftone lines): | B | B | B | B | B | D | |

*before and after toner supply

Example 17

Using alumina as a fine powder matrix, it was treated with 12 parts of silicone oil (14) shown in Table 4, in the same manner as in Example 10 to obtain alumina (29).

Toner Production Example 3

Styrene/n-butyl acrylate copolymer (St/BA: 85/15; peak molecular weight Pa: 9,000; peak molecular weight Pb: 285,000; Mn: 8,100; Mw: 169,000) 100 parts
Polyethylene wax 4 parts
Phthalocyanine 4 parts
Quaternary ammonium salt 2 parts Using these materials, the procedure of Example 10 was repeated to obtain toner particles (3) with a weight average particle diameter of 8.4 $\mu$m.

To 100 parts of the toner particles (3) thus obtained, 0.8 part of the alumina (29) was added, followed by mixing by means of a Henschel mixer to obtain a positively chargeable toner.

Using the positively chargeable toner thus obtained, images were reproduced using a commercially available copying machine FC330 (manufactured by CANON INC.), having the developing assembly shown in FIG. 8, to make evaluation.

Running test:

A 1,000 sheet running test was carried out in every environment of normal temperature/normal humidity (N/N), low temperature/low humidity (L/L), and high temperature/high humidity (H/H). Evaluation was made on image density and fog in every environment. Evaluation was also made on the level of blank images (reproducibility of character images), uniformity of halftone images, uniformity of solid black images, and occurrence of filming and toner melt-adhesion to the photosensitive member, all in the environment of normal temperature/normal humidity (N/N).

The respective evaluations were made in the same methods as the evaluations in Example 1.

The results of evaluation are shown in Table 8.

TABLE 7

| | | Matrix fine powder | Matrix specific surface area ($m^2/g$) | Type of silicone oil | Oil treatment quantity (pbw)* | Hydro-phobicity (%) | Specific surface area after treatment ($m^2/g$) |
|---|---|---|---|---|---|---|---|
| Example: | | | | | | | |
| 17 | Alumina (29) | Alumina | 100 | Silicone oil (14) | 12 | 80 | 84 |

*Amount of treatment with silicone oil, based on 100 parts by weight of matrix powder

TABLE 8

| | Example 17 |
|---|---|
| Running performance | |
| N/N: Initial stage/ | |
| Image density: | 1.2 |
| Fog: | B |
| N/N: After running/ | |
| Image density: | 1.06 |
| Fog: | A |
| L/L: Initial stage/ | |
| Image density: | 1.25 |
| Fog: | A |
| L/L: After running/ | |
| Image density: | 1.21 |
| Fog: | A |
| H/H: Initial stage/ | |
| Image density: | 1.18 |
| Fog: | B |
| H/H: After running/ | |
| Image density: | 1.17 |
| Fog: | A |
| Sleeve contamination (H/H): | A |
| Halftone image uniformity (Unevenness, lines): | C |
| Solid black image uniformity | |
| (White lines, white spots): | A |
| (After continuous 5 sheets): | A |
| Filming and melt-adhesion to photosensitive member (Image quality evaluation): | A |
| Image quality evaluation Blank images: | A |

Example 18

Silica Production Example 30

Silicone oil (27) was prepared by mixing 80% of amino-modified silicone oil having a peak at molecular weight of 4,400 and 20% of dimethylsilicone oil having a peak at molecular weight of 48,000. In molecular weight distribution as measured by GPC, this silicone oil (27) had peaks respectively at molecular weight of 4,400 and molecular weight of 48,000, where the distance from the vertex to its base line (height A), corresponding to the peak at molecular weight of 4,400, to the distance from the vertex to its base line (height B), corresponding to the peak value at molecular weight of 48,000 (A:B) was 1:0.32, and the distance from the bottom point to its base line (height C), corresponding to the bottom value present between the two peaks was 0.22. The results of measurement by GPC and the amine equivalent weight are shown in Table 9.

While agitating 100 parts of fine silica powder produced by the dry process (trade name: AEROSIL #200; specific surface area: about 200 $m^2/g$; available from Nippon Aerosil Co., Ltd.), and keeping the temperature at about 60° C., a solution of 20 parts of the silicone oil (27) as shown in Table 9 and 20 parts of hexane were sprayed to the powder. While continuing the agitation, the solvent was removed to dry the powder. Subsequently, the powder dried was heated up to 250° C. with agitation, and treated at 250° C. for 1 hour to obtain silica (30). The treatment conditions, hydrophobicity and BET specific surface area of this silica are shown in Table 10.

Toner Production Example 4

Styrene/n-butyl acrylate copolymer (St/BA: 83/17; peak molecular weight Pa: 10,500; peak molecular weight Pb: 360,000; Mn: 8,800; Mw: 180,000) 100 parts
Magnetic iron oxide 80 parts
Polypropylene wax 4 parts
Nigrosine dye 2 parts The above materials were thoroughly premixed using a Henschel mixer, and then melt-kneaded using a twin-screw extruder set at 140° C. The kneaded product obtained was cooled, and then crushed with a cutter mill. Thereafter the crushed product was finely pulverized by means of a fine grinding mill utilizing jet streams, and the finely pulverized product thus obtained was classified using an air classifier to obtain toner particles (4) with a weight average particle diameter of 8.3 $\mu$m.

To 100 parts of the toner particles (4) thus obtained, 0.8 part of the silica (30) was added, followed by mixing by means of a Henschel mixer to obtain a positively chargeable toner.

A process cartridge having the developing assembly as shown in FIG. 6, used for a commercially available copying machine NP160 (manufactured by CANON INC.) was modified so that it can be supplied with toner, and was filled with 150 g of the positively chargeable toner obtained. This process cartridge was set in the copying machine NP160, which corresponds to the image forming apparatus shown in FIG. 3, and images were reproduced to make evaluation.

Running test:

Images were reproduced on 2,000 sheets in every environment of normal temperature/normal humidity (N/N), low temperature/low humidity (L/L), and high temperature/high humidity (H/H). Thereafter, the toner was supplied in an amount of 150 g and images were further reproduced on 2,000 sheets. Then the toner was further supplied in an amount of 300 g and images were further reproduced on 6,000 sheets. Running tests were made in this way. Evaluation was made on image density and fog in every environment at the initial stage, after running on 4,000 sheets and after running on 10,000 sheets. Evaluation was also made on differences in density (minimum values on the 200th sheet after supply) before and after the toner supply made after the 2,000 sheet running. After running on 4,000 sheets, evaluation was still also made on occurrence of negative development in the environment of low temperature/low humidity (L/L) and sleeve contamination in the environment of high temperature/high humidity (H/H). Evaluation was still also made on the level of blank images (reproducibility of character images), uniformity of halftone images, and uniformity of solid black images (unevenness, blank spots, white lines) in the environment of normal temperature/normal humidity (N/N). Also, before the toner supply during the running tests, solid black images were continuously reproduced on five sheets of paper to make evaluation on the uniformity of solid black images at the time of continuous printing.

After the 2,000 sheet running was completed, evaluation was made on occurrence of filming and toner melt-adhesion to the photosensitive member. The charging member was cleaned, and the halftone images were reproduced to make evaluation on the state of occurrence of any drum scratches on the photosensitive member.

Using transfer paper left to stand for a weak in the environment of high temperature/high humidity (H/H), evaluation was made on black spots caused by fixing, and offset.

The above evaluations were made according to the same evaluation methods as in Example 1 in respect of image density, fog, sleeve contamination, blank images, uniformity of halftone images, uniformity of solid black images, occurrence of filming and toner melt-adhesion to the photosensitive member, the state of occurrence of drum scratches of the photosensitive member, black spots caused by fixing, and offset. In respect of negative development, the evaluation was made according to the following method.

Negative Development

Images formed using an original in which circles of 5 mm diameter respectively having image densities of 0.3, 0.4, 0.5, 0.75 and 1.1 are arranged at three positions, both ends and the middle, of an A4-size image, were evaluated according to the order of image density.

(Evaluation criteria)

A: Differences in light and shade are faithful to the order of image density on the original.

B: Some circles having densities of 0.75 and 1.1 on the original have a density of 0.03 or less on the reproduced image.

C: The order of image density on the original and the order thereof on the reproduced image reverse themselves in very few circles, but no problem in practical use.

D: The order of image density on the original and the order thereof on the reproduced image reverse themselves.

The results of evaluation are shown in Table 11.

Example 19

Silicone oil (28) was prepared to obtain silica (31) in the same manner as in Example 18 except that 80% of dimethylsilicone oil having a peak at molecular weight of 2,400 and 20% of amino-modified silicone oil having a peak at molecular weight of 12,000 were used.

To 100 parts of the toner particles (4), 0.8 part of the silica (31) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Example 20

Silicone oil (29) was prepared to obtain silica (32) in the same manner as in Example 18 except that 80% of amino-modified silicone oil having a peak at molecular weight of 1,600 and 20% of dimethylsilicone oil having a peak at molecular weight of 11,000 were used.

To 100 parts of the toner particles (4), 0.8 part of the silica (32) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Example 21

Silicone oil (30) was prepared to obtain silica (33) in the same manner as in Example 18 except that 60% of amino-modified silicone oil having a peak at molecular weight of 970 and 40% of dimethylsilicone oil having a peak at molecular weight of 7,000 were used.

To 100 parts of the toner particles (4), 0.8 part of the silica (33) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Example 22

Silicone oil (31) was prepared to obtain silica (34) in the same manner as in Example 18 except that 80% of amino-modified silicone oil having a peak at molecular weight of 13,500 and 20% of dimethylsilicone oil having a peak at molecular weight of 89,000 were used.

To 100 parts of the toner particles (4), 0.8 part of the silica (34) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Example 23

Using titania as a fine powder matrix, it was treated with 15 parts of silicone oil (27) in the same manner as in Example 18 to obtain titania (35). Treatment conditions and physical properties are shown in Table 5.

To 100 parts of the toner particles (4), 0.8 part of the titania (35) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Example 24

Silicone oil (32) was prepared to obtain silica (36) in the same manner as in Example 18 except that 70% of dimethylsilicone oil having a peak at molecular weight of 6,000 and 30% of amino-modified silicone oil having a peak at molecular weight of 50,000 were used.

To 100 parts of the toner particles (4), 0.8 part of the silica (36) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Example 25

Silicone oil (33) was prepared to obtain silica (37) in the same manner as in Example 18 except that 90% of amino-modified silicone oil having a peak at molecular weight of 550 and 10% of dimethylsilicone oil having a peak at molecular weight of 7,000 were used.

To 100 parts of the toner particles (4), 0.8 part of the silica (37) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Comparative Example 13

Silicone oil (34) was prepared to obtain silica (38) in the same manner as in Example 18 except that 65% of amino-modified silicone oil having a peak at molecular weight of 2,400 and 35% of dimethylsilicone oil having a peak at molecular weight of 2,100 were used.

To 100 parts of the toner particles (4), 0.8 part of the silica (38) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Comparative Example 14

Silicone oil (35) was prepared to obtain silica (39) in the same manner as in Example 18 except that 85% of amino-modified silicone oil having a peak at molecular weight of 2,400 and 15% of dimethylsilicone oil having a peak at molecular weight of 125,000 were used.

To 100 parts of the toner particles (4), 0.8 part of the silica (39) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Comparative Example 15

Silicone oil (36) was prepared to obtain silica (40) in the same manner as in Example 18 except that 90% of amino-modified silicone oil having a peak at molecular weight of 400 and 10% of methylphenylsilicone oil having a peak at molecular weight of 6,000 were used.

To 100 parts of the toner particles (4), 0.8 part of the silica (40) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Comparative Example 16

Silicone oil (37) was prepared to obtain silica (41) in the same manner as in Example 18 except that 65% of amino-modified silicone oil having a peak at molecular weight of 16,000 and 35% of dimethylsilicone oil having a peak at molecular weight of 89,000 were used.

To 100 parts of the toner particles (4), 0.8 part of the silica (41) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Comparative Example 17

Silicone oil (38) was prepared to obtain silica (42) in the same manner as in Example 18 except that 40% of amino-modified silicone oil having a peak at molecular weight of 450 and 60% of dimethylsilicone oil having a peak at molecular weight of 4,800 were used.

To 100 parts of the toner particles (4), 0.8 part of the silica (42) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Comparative Example 18

Silica (43) was obtained in the same manner as in Example 18 except that only amino-modified silicone oil (39) having a peak at molecular weight of 1,600 was used.

To 100 parts of the toner particles (4), 0.8 part of the silica (43) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

Comparative Example 19

Silica (44) was obtained in the same manner as in Example 18 except that only amino-modified silicone oil (40) having a peak at molecular weight of 28,000 was used.

To 100 parts of the toner particles (4), 0.8 part of the silica (44) was added, followed by mixing by means of a Henschel mixer to obtain a positively chargeable toner.

Using the positively chargeable toner obtained, images were reproduced and evaluated in the same manner as in Example 18.

The results of evaluation are shown in Table 11.

TABLE 9

| Silicone oil | GPC data: Peak molecular weight Pa | Peak or shoulder molecular weight Pb | A | B | C | Mn | Mw | Mz | Mw/Mn | Mz/Mn | Amine equivalent weight (g/mol) |
|---|---|---|---|---|---|---|---|---|---|---|---|
| (27) | 4,400 | *P 48,000 | 1.00 | 0.32 | 0.22 | 2,100 | 13,700 | 54,800 | 6.52 | 26.1 | 2,870 |
| (28) | 2,400 | S 12,000 | 1.00 | 0.26 | — | 2,110 | 4,700 | 11,000 | 2.22 | 5.21 | 4,200 |
| (29) | 1,600 | S 11,000 | 1.00 | 0.20 | — | 1,360 | 3,800 | 13,200 | 2.79 | 9.71 | 1 040 |
| (30) | 970 | P 7,000 | 1.00 | 0.49 | 0.41 | 1,010 | 3,600 | 10,700 | 3.56 | 10.6 | 770 |
| (31) | 13,500 | P 89,000 | 1.00 | 0.22 | 0.19 | 11,300 | 30,100 | 86,200 | 2.66 | 7.63 | 5,000 |
| (32) | 6,000 | P 50,000 | 1.00 | 0.44 | 0.41 | 4,900 | 18,700 | 55,500 | 3.82 | 11.3 | 11,600 |
| (33) | 550 | P 7,000 | 1.00 | 0.02 | 0.01 | 570 | 1,220 | 7,900 | 2.14 | 13.9 | 280 |
| (34) | 2,250 | — | — | — | — | 1,700 | 2,600 | 3,800 | 1.53 | 2.24 | 2,300 |
| (35) | 2,400 | P125,000 | 1.00 | 0.16 | 0.02 | 2,100 | 19,200 | 149,000 | 9.14 | 71 | 1,800 |
| (36) | 400 | P 6,000 | 1.00 | 0.02 | 0.002 | 430 | 1,000 | 7,100 | 2.33 | 16.5 | 360 |
| (37) | 16,000 | P 89,000 | 1.00 | 0.45 | 0.38 | 13,000 | 40,200 | 101,600 | 3.09 | 7.82 | 4,600 |
| (38) | 450 | P 8,000 | 1.00 | 0.16 | 0.04 | 950 | 5,030 | 13,200 | 5.29 | 13.9 | 8,000 |
| (39) | 1,600 | — | — | — | — | 3,600 | 6,600 | 10,600 | 1.83 | 2.94 | 830 |
| (40) | — | P 28,000 | — | — | — | 11,200 | 23,400 | 35,300 | 2.09 | 3.15 | 4,500 |

*P: Peak molecular weight;
S: Shoulder molecular weight

TABLE 10

| | | Matrix fine powder | Matrix specific surface area ($m^2/g$) | Type of silicone oil | Oil treatment quantity (pbw)* | Hydro-phobicity (%) | Specific surface area after treatment ($m^2g$) |
|---|---|---|---|---|---|---|---|
| Example: | | | | | | | |
| 18 | Silica (30) | Silica | 200 | Silicone oil (27) | 20 | 90 | 117 |
| 19 | Silica (31) | Silica | 200 | Silicone oil (28) | 20 | 89 | 114 |
| 20 | Silica (32) | Silica | 200 | Silicone oil (29) | 20 | 91 | 112 |
| 21 | Silica (33) | Silica | 200 | Silicone oil (30) | 20 | 87 | 119 |
| 22 | Silica (34) | Silica | 200 | Silicone oil (31) | 20 | 85 | 107 |
| 23 | Titania (35) | Titania | 150 | Silicone oil (27) | 15 | 80 | 97 |
| 24 | Silica (36) | Silica | 200 | Silicone oil (32) | 20 | 88 | 112 |
| 25 | Silica (37) | Silica | 200 | Silicone oil (33) | 20 | 83 | 116 |
| Comparative Example: | | | | | | | |
| 13 | Silica (38) | Silica | 200 | Silicone oil (34) | 20 | 87 | 121 |
| 14 | Silica (39) | Silica | 200 | Silicone oil (35) | 20 | 78 | 102 |
| 15 | Silica (40) | Silica | 200 | Silicone oil (36) | 20 | 85 | 117 |
| 16 | Silica (41) | Silica | 200 | Silicone oil (37) | 20 | 75 | 103 |
| 17 | Silica (42) | Silica | 200 | Silicone oil (38) | 20 | 72 | 116 |
| 18 | Silica (43) | Silica | 200 | Silicone oil (39) | 20 | 83 | 113 |
| 19 | Silica (44) | Silica | 200 | Silicone oil (40) | 20 | 42 | 76 |

*Amount of treatment with silicone oil, based on 100 parts by weight of matrix powder

TABLE 11

| | Example 18 | 19 | 20 | 21 | 22 | 23 | 24 | 25 |
|---|---|---|---|---|---|---|---|---|
| Running performance | | | | | | | | |
| N/N: Initial stage/ | | | | | | | | |
| Image density: | 1.38 | 1.35 | 1.34 | 1.31 | 1.37 | 1.37 | 1.36 | 1.4 |
| Fog: | A | A | A | A | A | A | A | B |
| After 4,000 sheet running/ | | | | | | | | |
| Image density: | 1.4 | 1.38 | 1.37 | 1.35 | 1.38 | 1.39 | 1.38 | 1.44 |

TABLE 11-continued

| | | | | | | | | |
|---|---|---|---|---|---|---|---|---|
| | Fog: | A | A | A | A | A | A | A | B |
| | After 10,000 sheet running/ | | | | | | | | |
| | Image density: | 1.39 | 1.37 | 1.35 | 1.33 | 1.30 | 1.30 | 1.29 | 1.40 |
| | Fog: | A | B | A | B | B | B | B | B |
| | Density difference*: | Δ0.01 | Δ0.03 | Δ0.03 | Δ0.05 | Δ0.01 | Δ0.02 | Δ0.02 | Δ0.07 |
| L/L: | Initial stage/ | | | | | | | | |
| | Image density: | 1.4 | 1.35 | 1.33 | 1.3 | 1.37 | 1.38 | 1.37 | 1.43 |
| | Fog: | A | A | A | B | B | A | B | B |
| | After 4,000 sheet running/ | | | | | | | | |
| | Image density: | 1.42 | 1.4 | 1.36 | 1.34 | 1.4 | 1.41 | 1.28 | 1.2 |
| | Fog: | A | A | A | B | A | A | C | C |
| | After 10,000 sheet running/ | | | | | | | | |
| | Image density: | 1.40 | 1.38 | 1.34 | 1.29 | 1.35 | 1.37 | 1.25 | 1.20 |
| | Fog: | A | B | B | B | B | B | C | C |
| | Density difference*: | Δ0.0 | Δ0.02 | Δ0.04 | Δ0.06 | Δ0.0 | Δ0.01 | Δ0.01 | Δ0.07 |
| H/H: | Initial stage/ | | | | | | | | |
| | Image density: | 1.39 | 1.34 | 1.3 | 1.3 | 1.33 | 1.38 | 1.39 | 1.4 |
| | Fog: | A | A | A | A | B | A | B | A |
| | After 4,000 sheet running/ | | | | | | | | |
| | Image density: | 1.39 | 1.36 | 1.3 | 1.23 | 1.3 | 1.37 | 1.2 | 1.15 |
| | Fog: | A | A | A | B | A | A | C | A |
| | After 10,000 sheet running/ | | | | | | | | |
| | Image density: | 1.38 | 1.34 | 1.29 | 1.22 | 1.27 | 1.35 | 1.19 | 1.14 |
| | Fog: | A | A | A | B | C | A | C | B |
| | Density difference*: | Δ0.03 | Δ0.05 | Δ0.06 | Δ0.07 | Δ0.02 | Δ0.03 | Δ0.06 | Δ0.11 |
| Sleeve contamination (H/H): | | A | A | A | B | A | A | A | B |
| Negative development (L/L): | | A | A | A | B | A | A | A | C |
| Halftone image uniformity (Unevenness, lines): | | A | A | A | A | B | A | A | C |
| Solid black image uniformity | | | | | | | | | |
| (White lines, white spots): | | A | A | A | A | B | A | A | A |
| (After continuous 5 sheets): | | A | A | A | B | A | A | A | B |
| Filming and melt-adhesion to photosensitive member (Image quality evaluation): | | A | A | A | A | A | A | A | C |
| Image quality evaluation | | | | | | | | | |
| Blank images: | | A | A | A | B | A | A | B | A |
| Drum scratches (Halftone lines): | | A | A | A | A | A | A | A | A |
| Fixing evaluation | | | | | | | | | |
| Black spots around images: | | A | A | A | B | A | A | A | A |
| Offset: | | A | A | A | A | A | A | A | A |

| | | Comparative Example | | | | | | |
|---|---|---|---|---|---|---|---|---|
| | | 13 | 14 | 15 | 16 | 17 | 18 | 19 |
| Running performance | | | | | | | | |
| N/N: | Initial stage/ | | | | | | | |
| | Image density: | 1.33 | 1.37 | 1.4 | 1.39 | 1.34 | 1.3 | 1.32 |
| | Fog: | A | A | C | A | C | A | C |
| | After 4,000 sheet running/ | | | | | | | |
| | Image density: | 1.35 | 1.4 | 1.38 | 1.4 | 1.37 | 1.37 | 1.20 |
| | Fog: | A | A | B | A | B | A | C |
| | After 10,000 sheet running/ | | | | | | | |
| | Image density: | 1.32 | 1.33 | 1.30 | 1.30 | 1.25 | 1.30 | 0.78 |
| | Fog: | B | B | B | C | C | B | D |
| | Density difference*: | Δ0.21 | Δ0.01 | Δ0.10 | Δ0.0 | Δ0.06 | Δ0.25 | Δ0.26 |
| L/L: | Initial stage/ | | | | | | | |
| | Image density: | 1.35 | 1.39 | 1.42 | 1.39 | 1.3 | 1.29 | 1.30 |
| | Fog: | A | A | B | A | C | A | C |
| | After 4,000 sheet running/ | | | | | | | |
| | Image density: | 1.38 | 1.41 | 1.22 | 1.4 | 1.34 | 1.35 | 1.27 |
| | Fog: | A | A | C | A | C | A | D |

TABLE 11-continued

| | | | | | | | |
|---|---|---|---|---|---|---|---|
| After 10,000 sheet running/ | | | | | | | |
| Image density: | 1.30 | 1.35 | 1.21 | 1.30 | 1.27 | 1.34 | 1.22 |
| Fog: | C | C | D | D | D | B | D |
| Density difference*: | Δ0.17 | Δ0.01 | Δ0.09 | Δ0.01 | Δ0.10 | Δ0.22 | Δ0.24 |
| H/H: Initial stage/ | | | | | | | |
| Image density: | 1.34 | 1.38 | 1.39 | 1.35 | 1.3 | 1.3 | 1.20 |
| Fog: | A | B | B | C | B | A | C |
| After 4,000 sheet running/ | | | | | | | |
| Image density: | 1.3 | 1.32 | 1.1 | 1.35 | 1.22 | 1.09 | 1.05 |
| Fog: | B | B | C | B | B | C | C |
| After 10,000 sheet running/ | | | | | | | |
| Image density: | 1.18 | 1.20 | 1.07 | 1.17 | 1.10 | 0.97 | 0.67 |
| Fog: | D | D | C | D | C | D | C |
| Density difference*: | Δ0.24 | Δ0.02 | Δ0.12 | Δ0.03 | Δ0.14 | Δ0.30 | Δ0.24 |
| Sleeve contamination (H/H): | B | A | C | A | C | C | C |
| Negative development (L/L): | A | A | B | A | A | A | A |
| Halftone image uniformity (Unevenness, lines): | A | B | C | C | A | C | D |
| Solid black image uniformity | | | | | | | |
| (White lines, white spots): | A | C | A | C | A | A | D |
| (After continuous 5 sheets): | C | A | B | A | B | C | C |
| Filming and melt-adhesion to photosensitive member (Image quality evaluation): | B | A | C | A | B | C | C |
| Image quality evaluation | | | | | | | |
| Blank images: | C | A | A | A | B | D | C |
| Drum scratches (Halftone lines): | B | C | A | A | A | B | C |
| Fixing evaluation | | | | | | | |
| Black spots around images: | C | A | A | A | B | D | D |
| Offset: | C | A | A | A | B | C | C |

*before and after toner supply

Example 26

Using alumina as a fine powder matrix, it was treated with 12 parts of silicone oil (27) shown in Table 9, in the same manner as in Example 18 to obtain alumina (45).

Toner Production Example 5

Styrene/n-butyl acrylate copolymer (St/BA: 83/15; peak molecular weight Pa: 10,000; peak molecular weight Pb: 345,000; Mn: 8,500; Mw: 175,000) 100 parts
Polyethylene wax 4 parts
Phthalocyanine 4 parts
Quaternary ammonium salt 2 parts Using these materials, the procedure of Example 18 was repeated to obtain toner particles (5) with a weight average particle diameter of 8.5 $\mu$m.

To 100 parts of the toner particles (5) thus obtained, 0.8 part of the alumina (45) was added, followed by mixing by means of a Henschel mixer to obtain a positively chargeable toner.

Using the positively chargeable toner thus obtained, images were reproduced using a commercially available copying machine FC330 (manufactured by CANON INC.), having the developing assembly shown in FIG. 8, to make evaluation.

Running test:

A 1,000 sheet running test was carried out in every environment of normal temperature/normal humidity (N/N), low temperature/low humidity (L/L), and high temperature/high humidity (H/H). Evaluation was made on image density and fog in every environment. Evaluation was also made on the level of blank images (reproducibility of character images), uniformity of halftone images, uniformity of solid black images, and occurrence of filming and toner melt-adhesion to the photosensitive member, all in the environment of normal temperature/normal humidity (N/N).

The respective evaluations were made in the same methods as the evaluations in Example 1.

The results of evaluation are shown in Table 13.

TABLE 12

| Example: | | Matrix fine powder | Matrix specific surface area ($m^2/g$) | Type of silicone oil | Oil treatment quantity (pbw)* | Hydro-phobicity (%) | Specific surface area treatment ($m^2/g$) |
|---|---|---|---|---|---|---|---|
| 26 | Alumina (45) | Alumina | 100 | Silicone oil (27) | 12 | 81 | 75 |

*Amount of treatment with silicone oil based on 100 parts by weight of matrix powder

TABLE 13

| | Example 26 |
|---|---|
| Running performance | |
| N/N: Initial stage/ | |
| Image density: | 1.2 |
| Fog: | A |
| N/N: After 2,000 sheet running/ | |
| Image density: | 1.16 |
| Fog: | A |
| L/L: Initial stage/ | |
| Image density: | 1.24 |
| Fog: | A |
| L/L: After 2,000 sheet running/ | |
| Image density: | 1.2 |
| Fog: | A |
| H/H: Initial stage/ | |
| Image density: | 1.17 |
| Fog: | A |
| H/H: After 2,000 running/ | |
| Image density: | 1.16 |
| Fog: | A |
| Sleeve contamination (H/H): | A |
| Negative development (L/L): | A |
| Halftone image uniformity (Unevenness, lines): | A |
| Solid black image uniformity | |
| (White lines, white spots): | A |
| (After continuous 5 sheets): | A |
| Filming and melt-adhesion to photosensitive member (Image quality evaluation): | A |
| Image quality evaluation | |
| Blank images: | A |
| Drum scratches on photosensitive member (Halftone lines): | A |
| Fixing evaluation | |
| Black spots around images: | A |
| Offset: | A |

What is claimed is:

1. A toner for developing an electrostatic image, comprising toner particles containing at least a binder resin and a colorant, and an inorganic fine powder, wherein;

(i) said inorganic fine powder has been treated with a silicone oil having, in its molecular weight distribution as measured by gel permeation chromatography, at least one peak value in the region of molecular weight of from 500 to 15,000 and having at least one peak value or shoulder in the region of molecular weight of from 3,000 to 100,000 at a value greater than the former peak value, and (ii) in the molecular weight distribution as measured by gel permeation chromatography of said silicone oil, where the distance from the vertex to its base line, corresponding to the peak value present in the region of molecular weight of from 500 to 15,000, is represented by A, the distance from the vertex to its base line, corresponding to the peak value present in the region of molecular weight of from 3,000 to 100,000 at a value greater than the former peak value, is represented by B, and the distance from the bottom point to its base line, corresponding to the bottom value present between the peak value present in the region of molecular weight of from 500 to 15,000 and the peak value present in the region of molecular weight of from 3,000 to 100,000, is represented by C, wherein the A, B and C fulfills the following condition:

A:B:C=1:0.01 to 1.0:0.001 to 0.70, or in the molecular weight distribution as measured by gel permeation chromatography of said silicone oil, where the distance from the vertex to its base line, corresponding to the peak value present in the region of molecular weight of from 500 to 15,000, is represented by A, and the distance from the inflection point of the shoulder present in the region of molecular weight of from 3,000 to 100,000 at a value greater than the former peak value, to its base line, is represented by B, wherein the A and B fulfills the following condition:

A:B=1:0.1 to 0.7.

2. The toner according to claim 1, wherein said silicone oil has a peak value in the region of molecular weight of from 1,000 to 15,000 and has at least one peak value or shoulder in the region of molecular weight of from 5,000 to 100,000 at a value greater than the former peak value.

3. The toner according to claim 1, wherein said silicone oil has a ratio of weight average molecular weight to number average molecular weight, Mw/Mn, of from 2 to 40.

4. The toner according to claim 1, wherein said silicone oil has a ratio of z-average molecular weight to number average molecular weight, Mz/Mn, of from 3 to 100.

5. The toner according to claim 1, wherein, in the molecular weight distribution as measured by gel permeation chromatography of said silicone oil, where the distance from the vertex to its base line, corresponding to the peak value present in the region of molecular weight of from 500 to 15,000, is represented by A, and the distance from the inflection point of the shoulder present in the region of molecular weight of from 3,000 to 100,000 at a value greater than the former peak value, to its base line, is represented by B, the A and B fulfills the following condition:

A:B=1:0.1 to 0.5.

6. The toner according to claim 1, wherein, in the molecular weight distribution as measured by gel permeation chromatography of said silicone oil, where the distance from the vertex to its base line, corresponding to the peak value present in the region of molecular weight of from 500 to 15,000, is represented by A, the distance from the vertex to its base line, corresponding to the peak value present in the region of molecular weight of from 3,000 to 100,000 at a value greater than the former peak value, is represented by B, and the distance from the bottom point to its base line, corresponding to the bottom value present between the peak value present in the region of molecular weight of from 500 to 15,000 and the peak value present in the region of molecular weight of from 3,000 to 100,000, is represented by C, the A, B and C fulfills the following condition:

A:B:C=1:0.08 to 0.5:0.02 to 0.45.

7. The toner according to claim 1, wherein said silicone oil comprises a silicone oil represented by the following Formula (1):

(1)

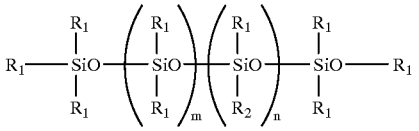

wherein $R_1$ represents a methyl group, any other alkyl group, an aryl group or a hydrogen atom, and independently therefrom $R_2$ represents a methyl group, any other alkyl group, an aryl group, a vinyl group, an alkyl group having a functional group, an aryl group having a functional group, or a hydrogen atom; and m and n each represent an integer.

8. The toner according to claim 7, wherein said silicone oil comprises a silicone oil selected from the group consisting of dimethylsilicone oil, methylphenylsilicone oil, methylhydrogensilicone oil, an alkyl-modified silicone oil, a chloroalkyl-modified silicone oil, a chlorophenyl-modified silicone oil, a fatty acid-modified silicone oil, a polyether-modified silicone oil, an alkoxy-modified silicone oil, a carbinol-modified silicone oils, an amino-modified silicone oil and a fluorine-modified silicone oil.

9. The toner according to claim 7, wherein said silicone oil comprises a silicone oil selected from the group consisting of dimethylsilicone oil, methylphenylsilicone oil, methylhydrogensilicone oil, a fluorine-modified silicone oil and an alkyl-modified silicone oil.

10. The toner according to claim 1, wherein said silicone oil has an amine equivalent weight of from 300 to 10,000.

11. The toner according to claim 10, wherein said toner has a positive chargeability.

12. The toner according to claim 10, wherein said silicone oil comprises an amino-modified silicone oil represented by the following Formula (2):

(2)

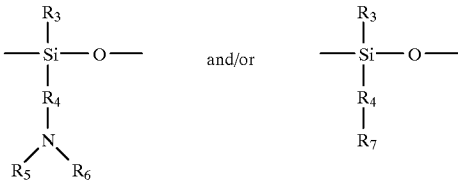

wherein $R_3$ represents a hydrogen atom, an alkyl group, an aryl group or an alkoxyl group; $R_4$ represents an alkylene group or a phenylene group; $R_5$ and $R_6$ each represent a hydrogen atom, an alkyl group or an aryl group; and $R_7$ represents a nitrogen-containing heterocyclic group.

13. The toner according to claim 10, wherein said silicone oil comprises a mixture of an amino-modified silicone oil and a silicone oil having no amino group.

14. The toner according to claim 13, wherein said silicone oil comprises a mixture of an amino-modified silicone oil and a silicone oil selected from the group consisting of dimethylsilicone oil, methylphenylsilicone oil, methylhydrogensilicone oil, an alkyl-modified silicone oil and a vinyl group-containing silicone oil.

15. The toner according to claim 14, wherein said silicone oil selected from the group consisting of dimethylsilicone oil, methylphenylsilicone oil, methylhydrogensilicone oil, an alkyl-modified silicone oil and a vinyl group-containing silicone oil has, in its molecular weight distribution as measured by gel permeation chromatography, at least one peak value in the region of molecular weight of 1000 to 100,000.

16. The toner according to claim 14, wherein said amino-modified silicone has, in its molecular weight distribution, as measured by gel permeation chromatography at least one peak value in the region of molecular weight of 500 to 15,000.

17. The toner according to claim 13, wherein said silicone oil having no amino group comprises a silicone oil represented by the following Formula (3):

(3)

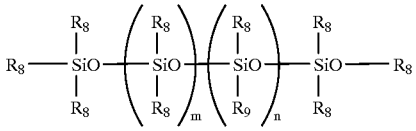

wherein $R_8$ represents a methyl group, any other alkyl group, an aryl group or a hydrogen atom, and independently therefrom $R_9$ represents a methyl group, any other alkyl group, an aryl group, a vinyl group, an alkyl group or aryl group which may have a hydroxyl group, or a hydrogen atom; and m and n each represent an integer.

18. The toner according to claim 13, wherein said amino-modified silicone oil and said silicone oil having no amino group are mixed in a proportion having the following relationship: Amino-modified silicone oil: silicone oil having no amino group=1:20 to 10:1.

19. The toner according to claim 1, wherein said inorganic fine powder is treated with said silicone oil in a treatment quantity ranging from 5 parts by weight to 70 parts by weight of the latter based on 100 parts by weight of the former.

20. The toner according to claim 1, wherein said inorganic fine powder comprises a member selected from the group consisting of silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, calcium titanate, magnesium titanate, strontium titanate, tungstophosphoric acid, molybdophosphoric acid, calcium carbonate, magnesium carbonate and aluminum carbonate.

21. The toner according to claim 1, wherein said inorganic fine powder is contained in an amount ranging from 0.01 part by weight to 10 parts by weight based on 100 parts by weight of said toner particles.

22. The toner according to claim 1, wherein said toner is a color toner having toner particles containing as said colorant a dye, a pigment or a mixture thereof.

23. The toner according to claim 1, wherein said toner is a magnetic toner having toner particles containing as said colorant a magnetic material.

24. An image forming method comprising the steps of;

electrostatically charging an electrostatic latent image bearing member by means of a charging member, forming on the electrostatic latent image bearing member thus charged an electrostatic latent image through a latent image forming means;

developing the electrostatic latent image by the use of a toner to form a toner image; said toner comprising toner particles containing at least a binder resin and a colorant, and an inorganic fine powder, wherein;

(i) said inorganic fine powder has been treated with a silicone oil having, in its molecular weight distribution as measured by gel permeation chromatography, at least one peak value in the region of molecular weight of from 500 to 15,000 and having at least one peak value or shoulder in the region of molecular weight of from 3,000 to 100,000 at a value greater than the former peak value, and transferring the toner image to a transfer medium by means of a transfer member, and (ii) in the molecular weight distribution as measured by gel permeation chromatography of said silicone oil, where the distance from the vertex to its base line, corresponding to the peak value present in the region of molecular weight of from 500 to 15,000, is represented by A, the distance from the vertex to its base line, corresponding to the peak value present in the region of molecular weight of from 3,000 to 100,000 at a value greater than the former peak value, is represented by B, and the distance from the bottom point to its base line, corresponding to the bottom value present between the peak value present in the region of molecular weight of from 500 to 15,000 and the peak value present in the region of molecular weight of from 3,000 to 100,000, is represented by C, wherein the A, B and C fulfills the following condition:

A:B:C=1:0.01 to 1.0:0.001 to 0.70, or in the molecular weight distribution as measured by gel permeation chromatography of said silicone oil, where the distance from the vertex to its base line, corresponding to the peak value present in the region of molecular weight of from 500 to 15,000, is represented by A, and the distance from the inflection point of the shoulder present in the region of molecular weight of from 3,000 to 100,000 at a value greater than the former peak value, to its base line, is represented by B, wherein the A and B fulfills the following condition:

A:B=1:0.1 to 0.7.

25. The image forming method according to claim 24, wherein said silicone oil has a peak value in the region of molecular weight of from 1,000 to 15,000 and has a peak value or shoulder in the region of molecular weight of from 5,000 to 100,000 at a value greater than the former peak value.

26. The image forming method according to claim 24, wherein said silicone oil has a ratio of weight average molecular weight to number average molecular weight, Mw/Mn, of from 2 to 40.

27. The image forming method according to claim 24, wherein said silicone oil has a ratio of z-average molecular weight to number average molecular weight, Mz/Mn, of from 3 to 100.

28. The image forming method according to claim 24, wherein, in the molecular weight distribution as measured by gel permeation chromatography of said silicone oil, where the distance from the vertex to its base line, corresponding to the peak value present in the region of molecular weight of from 500 to 15,000, is represented by A, and the distance from the inflection point of the shoulder present in the region of molecular weight of from 3,000 to 100,000 at a value greater than the former peak value, to its base line, is represented by B, the A and B fulfills the following condition:

A:B=1:0.1 to 0.5.

29. The image forming method according to claim 24, wherein, in the molecular weight distribution as measured by gel permeation chromatography of said silicone oil, where the distance from the vertex to its base line, corresponding to the peak value present in the region of molecular weight of from 500 to 15,000, is represented by A, the distance from the vertex to its base line, corresponding to the peak value present in the region of molecular weight of from 3,000 to 100,000 at a value greater than the former peak value, is represented by B, and the distance from the bottom point to its base line, corresponding to the bottom value present between the peak value present in the region of molecular weight of from 500 to 15,000 and the peak value present in the region of molecular weight of from 3,000 to 100,000, is represented by C, the A, B and C fulfills the following condition:

A:B:C=1:0.08 to 0.5:0.02 to 0.45.

30. The image forming method according to claim 24, wherein said silicone oil comprises a silicone oil represented by the following Formula (1):

(1)

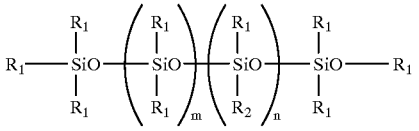

wherein $R_1$ represents a methyl group, any other alkyl group, an aryl group or a hydrogen atom, and independently therefrom $R_2$ represents a methyl group, any other alkyl group, an aryl group, a vinyl group, an alkyl group having a functional group, an aryl group having a functional group, or a hydrogen atom; and m and n each represent an integer.

31. The image forming method according to claim 30, wherein said silicone oil comprises a silicone oil selected from the group consisting of dimethylsilicone oil, methylphenylsilicone oil, methylhydrogensilicone oil, an alkyl-modified silicone oil, a chloroalkyl-modified silicone oil, a chlorophenyl-modified silicone oil, a fatty acid-modified silicone oil, a polyether-modified silicone oil, an alkoxy-modified silicone oil, a carbinol-modified silicone oils, an amino-modified silicone oil and a fluorine-modified silicone oil.

32. The image forming method according to claim 30, wherein said silicone oil comprises a silicone oil selected from the group consisting of dimethylsilicone oil, methylphenylsilicone oil, methylhydrogensilicone oil, a fluorine-modified silicone oil and an alkyl-modified silicone oil.

33. The image forming method according to claim 24, wherein said silicone oil has an amine equivalent weight of from 300 to 10,000.

34. The image forming method according to claim 33, wherein said toner has a positive chargeability.

35. The image forming method according to claim 33, wherein said silicone oil comprises an amino-modified silicone oil represented by the following Formula (2):

(2)

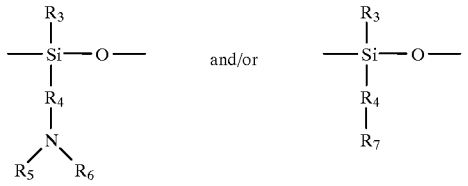

wherein $R_3$ represents a hydrogen atom, an alkyl group, an aryl group or an alkoxyl group; $R_4$ represents an alkylene group or a phenylene group; $R_5$ and $R_6$ each represent a hydrogen atom, an alkyl group or an aryl group; and $R_7$ represents a nitrogen-containing heterocyclic group.

36. The image forming method according to claim 33, wherein said silicone oil comprises a mixture of an amino-modified silicone oil and a silicone oil having no amino group.

37. The image forming method according to claim 36, wherein said silicone oil comprises a mixture of an amino-modified silicone oil and a silicone oil selected from the group consisting of dimethylsilicone oil, methylphenylsilicone oil, methylhydrogensilicone oil, an alkyl-modified silicone oil and a vinyl group-containing silicone oil.

38. The image forming method according to claim 37, wherein said silicone oil selected from the group consisting of dimethylsilicone oil, methylphenylsilicone oil, methylhydrogensilicone oil, an alkyl-modified silicone oil and a vinyl group-containing silicone oil has, in its molecular weight distribution as measured by gel permeation chromatography, at least one peak value in the region of molecular weight of 1000 to 100,000.

39. The image forming method according to claim 37, wherein said amino-modified silicone oil has, in its molecular weight distribution as measured by gel permeation chromatography, at least one peak value in the region of molecular weight of 500 to 15,000.

40. The image forming method according to claim 36, wherein said silicone oil having no amino group comprises a silicone oil represented by the following Formula (3):

(3)

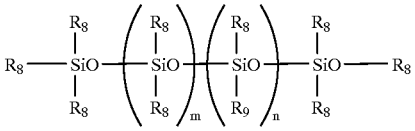

wherein $R_8$ represents a methyl group, any other alkyl group, an aryl group or a hydrogen atom, and independently therefrom $R_9$ represents a methyl group, any other alkyl group, an aryl group, a vinyl group, an alkyl group or aryl group which may have a hydroxyl group, or a hydrogen atom; and m and n each represent an integer.

41. The image forming method according to claim 36, wherein said amino-modified silicone oil and said silicone oil having no amino group are mixed in a proportion having the following relationship: Amino-modified silicone oil: silicone oil having no amino group=1:20 to 10:1.

42. The image forming method according to claim 24, wherein said inorganic fine powder is treated with said silicone oil in a treatment quantity ranging from 5 parts by weight to 70 parts by weight of the latter based on 100 parts by weight of the former.

43. The image forming method according to claim 24, wherein said inorganic fine powder comprises a member selected from the group consisting of silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, calcium titanate, magnesium titanate, strontium titanate, tungstophosphoric acid, molybdophosphoric acid, calcium carbonate, magnesium carbonate and aluminum carbonate.

44. The image forming method according to claim 24, wherein said inorganic fine powder is contained in an amount ranging from 0.01 part by weight to 10 parts by weight based on 100 parts by weight of said toner particles.

45. The image forming method according to claim 24, wherein said toner is a color toner having toner particles containing as said colorant a dye, a pigment or a mixture thereof.

46. The image forming method according to claim 24, wherein said toner is a magnetic toner having toner particles containing as said colorant a magnetic material.

47. A developing apparatus unit comprising;

a toner for developing an electrostatic latent image;

a toner container for holding the toner; and a toner carrying member for carrying the toner held in the toner container and transporting the toner to a developing zone where the electrostatic latent image is developed;

wherein said toner comprises toner particles containing at least a binder resin and a colorant, and an inorganic fine powder;

(i) said inorganic fine powder having been treated with a silicone oil having, in its molecular weight distribution as measured by gel permeation chromatography, at least one peak value in the region of molecular weight of from 500 to 15,000 and having at least one peak value or shoulder in the region of molecular weight of from 3,000 to 100,000 at a value greater than the former peak value, and (ii) in the molecular weight distribution as measured by gel permeation chromatography of said silicone oil, where the distance from the vertex to its base line corresponding to the peak value present in the region of molecular weight of from 500 to 15,000, is represented by A, the distance from the vertex to its base line, corresponding to the peak value present in the region of molecular weight of from 3,000 to 1000,000 at a value greater than the former peak value, is represented by B, and the distance from the bottom point to its base line, corresponding to the bottom value present between the peak value present in the region of molecular weight of from 500 to 15,000 and the peak value present in the region of molecular weight of from 3,000 to 100,000, is represented by C, wherein the A, B and C fulfills the following condition:

A:B:C=1:0.01 to 1.0:0.001 to 0.70, or in the molecular weight distribution as measured by gel permeation chromatography of said silicone oil, where the distance from the vertex to its base line, corresponding to the peak value present in the region of molecular weight of from 500 to 15,000, is represented by A, and the distance from the inflection point of the shoulder present in the region of molecular weight of from 3,000 to 100,000 at a value greater than the former peak value, to its base line, is represented by B, wherein the A and B fulfills the following condition;

A:B=1:0.1 to 0.7.

48. The developing apparatus unit according to claim 47, wherein said silicone oil has a peak value in the region of molecular weight of from 1,000 to 15,000 and has at least one peak value or shoulder in the region of molecular weight of from 5,000 to 100,000 at a value greater than the former peak value.

49. The developing apparatus unit according to claim 47, wherein said silicone oil has a ratio of weight average molecular weight to number average molecular weight, Mw/Mn, of from 2 to 40.

50. The developing apparatus unit according to claim 47, wherein said silicone oil has a ratio of z-average molecular weight to number average molecular weight, Mz/Mn, of from 3 to 100.

51. The developing apparatus unit according to claim 47, wherein, in the molecular weight distribution as measured by gel permeation chromatography of said silicone oil, where the distance from the vertex to its base line, corresponding to the peak value present in the region of molecular weight of from 500 to 15,000, is represented by A, and the distance from the inflection point of the shoulder present in the region of molecular weight of from 3,000 to 100,000 at a value greater than the former peak value, to its base line, is represented by B, the A and B fulfills the following condition:

A:B=1:0.1 to 0.5.

52. The developing apparatus unit according to claim 47, wherein, in the molecular weight distribution as measured by gel permeation chromatography of said silicone oil, where the distance from the vertex to its base line, corresponding to the peak value present in the region of molecular weight of from 500 to 15,000, is represented by A, the distance from the vertex to its base line, corresponding to the peak value present in the region of molecular weight of from 3,000 to 100,000 at a value greater than the former peak value, is represented by B, and the distance from the bottom point to its base line, corresponding to the bottom value present between the peak value present in the region of molecular weight of from 500 to 15,000 and the peak value present in the region of molecular weight of from 3,000 to 100,000, is represented by C, the A, B and C fulfills the following condition:

A:B:C=1:0.08 to 0.5:0.02 to 0.45.

53. The developing apparatus unit according to claim 47, wherein said silicone oil comprises a silicone oil represented by the following Formula (1):

(1)

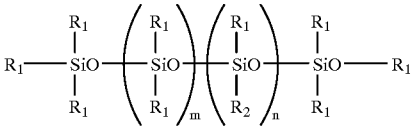

wherein $R_1$ represents a methyl group, any other alkyl group, an aryl group or a hydrogen atom, and independently therefrom $R_2$ represents a methyl group, any other alkyl group, an aryl group, a vinyl group, an alkyl group having a functional group, an aryl group having a functional group, or a hydrogen atom; and m and n each represent an integer.

54. The developing apparatus unit according to claim 53, wherein said silicone oil comprises a silicone oil selected from the group consisting of dimethylsilicone oil, methylphenylsilicone oil, methylhydrogensilicone oil, an alkyl-modified silicone oil, a chloroalkyl-modified silicone oil, a chlorophenyl-modified silicone oil, a fatty acid-modified silicone oil, a polyether-modified silicone oil, an alkoxy-modified silicone oil, a carbinol-modified silicone oils, an amino-modified silicone oil and a fluorine-modified silicone oil.

55. The developing apparatus unit according to claim 53, wherein said silicone oil comprises a silicone oil selected from the group consisting of dimethylsilicone oil, methylphenylsilicone oil, methylhydrogensilicone oil, a fluorine-modified silicone oil and an alkyl-modified silicone oil.

56. The developing apparatus unit according to claim 47, wherein said silicone oil has an amine equivalent weight of from 300 to 10,000.

57. The developing apparatus unit according to claim 56, wherein said toner has a positive chargeability.

58. The developing apparatus unit according to claim 56, wherein said silicone oil comprises an amino-modified silicone oil represented by the following Formula (2):

(2)

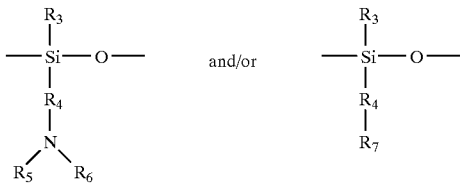

wherein $R_3$ represents a hydrogen atom, an alkyl group, an aryl group or an alkoxyl group; $R_4$ represents an alkylene group or a phenylene group; $R_5$ and $R_6$ each represent a hydrogen atom, an alkyl group or an aryl group; and $R_7$ represents a nitrogen-containing heterocyclic group.

59. The developing apparatus unit according to claim 56, wherein said silicone oil comprises a mixture of an amino-modified silicone oil and a silicone oil having no amino group.

60. The developing apparatus unit according to claim 59, wherein said silicone oil comprises a mixture of an amino-modified silicone oil and a silicone oil selected from the group consisting of dimethylsilicone oil, methylphenylsilicone oil, methylhydrogensilicone oil, an alkyl-modified silicone oil and a vinyl group-containing silicone oil.

61. The developing apparatus unit according to claim 60, wherein said silicone oil selected from the group consisting of dimethylsilicone oil, methylphenylsilicone oil, methylhydrogensilicone oil, an alkyl-modified silicone oil and a vinyl group-containing silicone oil has, in its molecular weight distribution as measured by gel permeation chromatography, at least one peak value in the region of molecular weight of 1000 to 100,000.

62. The developing apparatus unit according to claim 60, wherein said amino-modified silicone oil has, in its molecular weight distribution, as measured by gel permeation chromatography at least one peak value in the region of molecular weight of 500 to 15,000.

63. The developing apparatus unit according to claim 59, wherein said silicone oil having no amino group comprises a silicone oil represented by the following Formula (3):

(3)

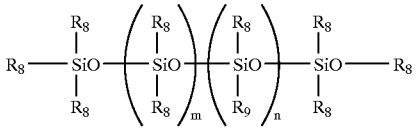

wherein $R_8$ represents a methyl group, any other alkyl group, an aryl group or a hydrogen atom, and independently therefrom $R_9$ represents a methyl group, any other alkyl group, an aryl group, a vinyl group, an alkyl group or aryl group which may have a hydroxyl group, or a hydrogen atom; and m and n each represent an integer.

64. The developing apparatus unit according to claim 59, wherein said amino-modified silicone oil and said silicone oil having no amino group are mixed in a proportion having the following relationship: Amino-modified silicone oil: silicone oil having no amino group=1:20 to 10:1.

65. The developing apparatus unit according to claim 47, wherein said inorganic fine powder is treated with said silicone oil in a treatment quantity ranging from 5 parts by weight to 70 parts by weight of the latter based on 100 parts by weight of the former.

66. The developing apparatus unit according to claim 47, wherein said inorganic fine powder comprises a member selected from the group consisting of silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, calcium titanate, magnesium titanate, strontium titanate, tungstophosphoric acid, molybdophosphoric acid, calcium carbonate, magnesium carbonate and aluminum carbonate.

67. The developing apparatus unit according to claim 47, wherein said inorganic fine powder is contained in an amount ranging from 0.01 part by weight to 10 parts by weight based on 100 parts by weight of said toner particles.

68. The developing apparatus unit according to claim 47, wherein said toner is a color toner having toner particles containing as said colorant a dye, a pigment or a mixture thereof.

69. The developing apparatus unit according to claim 47, wherein said toner is a magnetic toner having toner particles containing as said colorant a magnetic material.

70. The developing apparatus unit according to claim 47, which, in addition to said toner, said toner container and said toner carrying member, further comprises in one unit a toner layer thickness control member for controlling the layer thickness of said toner to be carried on said toner carrying member.

71. The developing apparatus unit according to claim 47, which, in addition to said toner, said toner container and said toner carrying member, further comprises in one unit a toner feed roller for feeding said toner to said toner carrying member.

72. The developing apparatus unit according to claim 47, which, in addition to said toner, said toner container and said toner carrying member, further comprises in one unit a toner layer thickness control member for controlling the layer thickness of said toner to be carried on said toner carrying member and a toner feed roller for feeding said toner to said toner carrying member.

73. A process cartridge detachably mountable to the main body of an image forming apparatus, comprising:

an electrostatic latent image bearing member for holding thereon an electrostatic latent image; and a developing assembly for developing the electrostatic latent image held on the electrostatic latent image bearing member;

said developing assembly comprising;

a toner for developing an electrostatic latent image;

a toner container for holding the toner; and a toner carrying member for carrying the toner held in the toner container and transporting the toner to a developing zone where the electrostatic latent image is developed;

wherein said toner comprises toner particles containing at least a binder resin and a colorant, and an inorganic fine powder;

(i) said inorganic fine powder having been treated with a silicone oil having, in its molecular weight distribution an measured by gel permeation chromatography, at least one peak value in the region of molecular weight of from 500 to 15,000 and having at least one peak value or shoulder in the region of molecular weight of from 3,000 to 100,000 at a value greater than the former peak value, and (ii) in the molecular weight distribution as measured by gel permeation chromatography of said silicone oil, where the distance from the vertex to its base line, corresponding to the peak value present in the region of molecular weight of from 500 to 15,000, is represented by A, the distance from the vertex to its base line, corresponding to the peak value present in the region of molecular weight of from 3,000 to 100,000 at a value greater than the former peak value, is represented by B, and the distance from the bottom point to its base line, corresponding to the bottom value present between the Peak value present in the region of molecular weight of from 500 to 15,000 and the peak value present in the region of molecular weight of from 3,000 to 100,000, is represented by C, wherein the A, B and C fulfills the following condition:

A:B:C=1:0.01 to 1.0:0.001 to 0.70, or in the molecular weight distribution as measured by gel permeation chromatography of said silicone oil, where the distance from the vertex to its base line, corresponding to the peak value Present in the region of molecular weight of from 500 to 15,000, is represented by A, and the distance from the inflection point of the shoulder present in the region of molecular weight of from 3000 to 100,000 at a value greater than the former peak value, to its base line, is represented by B, wherein the A and B fulfills the following condition:

A:B=1:0.1 to 0.7.

74. The process cartridge according to claim 73, wherein said silicone oil has a peak value in the region of molecular weight of from 1,000 to 15,000 and has at least one peak value or shoulder in the region of molecular weight of from 5,000 to 100,000 at a value greater than the former peak value.

75. The process cartridge according to claim 73, wherein said silicone oil has a ratio of weight average molecular weight to number average molecular weight, Mw/Mn, of from 2 to 40.

76. The process cartridge according to claim 73, wherein said silicone oil has a ratio of z-average molecular weight to number average molecular weight, Mz/Mn, of from 3 to 100.

77. The process cartridge according to claim 73, wherein, in the molecular weight distribution as measured by gel permeation chromatography of said silicone oil, where the distance from the vertex to its base line, corresponding to the peak value present in the region of molecular weight of from 500 to 15,000, is represented by A, and the distance from the inflection point of the shoulder present in the region of molecular weight of from 3,000 to 100,000 at a value greater than the former peak value, to its base line, is represented by B, the A and B fulfills the following condition:

A:B=1:0.1 to 0.5.

78. The process cartridge according to claim 73, wherein, in the molecular weight distribution as measured by gel permeation chromatography of said silicone oil, where the distance from the vertex to its base line, corresponding to the peak value present in the region of molecular weight of from 500 to 15,000, is represented by A, the distance from the vertex to its base line, corresponding to the peak value present in the region of molecular weight of from 3,000 to 100,000 at a value greater than the former peak valuer, is represented by B, and the distance from the bottom point to its base line, corresponding to the bottom value present between the peak value present in the region of molecular weight of from 500 to 15,000 and the peak value present in the region of molecular weight of from 3,000 to 100,000, is represented by C, the A, B and C fulfills the following condition:

A:B:C=1:0.08 to 0.5:0.02 to 0.45.

79. The process cartridge according to claim 73, wherein said silicone oil comprises a silicone oil represented by the following Formula (1):

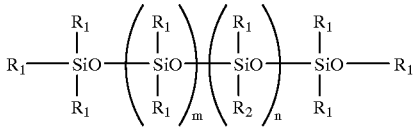

(1)

wherein $R_1$ represents a methyl group, any other alkyl group, an aryl group or a hydrogen atom, and independently therefrom $R_2$ represents a methyl group, any other alkyl group, an aryl group, a vinyl group, an alkyl group having a functional group, an aryl group having a functional group, or a hydrogen atom; and m and n each represent an integer.

80. The process cartridge according to claim 79, wherein said silicone oil comprises a silicone oil selected from the group consisting of dimethylsilicone oil, methylphenylsilicone oil, methylhydrogensilicone oil, an alkyl-modified silicone oil, a chloroalkyl-modified silicone oil, a chlorophenyl-modified silicone oil, a fatty acid-modified silicone oil, a polyether-modified silicone oil, an alkoxy-modified silicone oil, a carbinol-modified silicone oils, an amino-modified silicone oil and a fluorine-modified silicone oil.

81. The process cartridge according to claim 79, wherein said silicone oil comprises a silicone oil selected from the group consisting of dimethylsilicone oil, methylphenylsilicone oil, methylhydrogensilicone oil, a fluorine-modified silicone oil and an alkyl-modified silicone oil.

82. The process cartridge according to claim 73, wherein said silicone oil has an amine equivalent weight of from 300 to 10,000.

83. The process cartridge according to claim 82, wherein said toner has a positive chargeability.

84. The process cartridge according to claim 82, wherein said silicone oil comprises an amino-modified silicone oil represented by the following Formula (2):

(2)

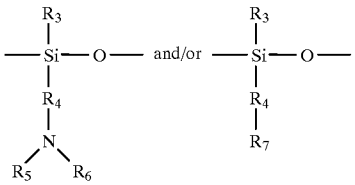

wherein $R_3$ represents a hydrogen atom, an alkyl group, an aryl group or an alkoxyl group; $R_4$ represents an alkylene group or a phenylene group; $R_5$ and $R_6$ each represent a hydrogen atom, an alkyl group or an aryl group; and $R_7$ represents a nitrogen-containing heterocyclic group.

85. The process cartridge according to claim 82, wherein said silicone oil comprises a mixture of an amino-modified silicone oil and a silicone oil having no amino group.

86. The process cartridge according to claim 85, wherein said silicone oil comprises a mixture of an amino-modified silicone oil and a silicone oil selected from the group consisting of dimethylsilicone oil, methylphenylsilicone oil, methylhydrogensilicone oil, an alkyl-modified silicone oil and a vinyl group-containing silicone oil.

87. The process cartridge according to claim 86, wherein said silicone oil selected from the group consisting of dimethylsilicone oil, methylphenylsilicone oil, methylhydrogensilicone oil, an alkyl-modified silicone oil and a vinyl group-containing silicone oil has, in its molecular weight distribution as measured by gel permeation chromatography, at least one peak value in the region of molecular weight of 1,000 to 100,000.

88. The process cartridge according to claim 86, wherein said amino-modified silicone has, in its molecular weight distribution, as measured by gel permeation chromatography at least one peak value in the region of molecular weight of 500 to 15,000.

89. The process cartridge according to claim 85, wherein said silicone oil having no amino group comprises a silicone oil represented by the following Formula (3):

(3)

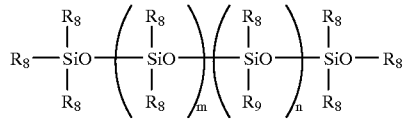

wherein $R_8$ represents a methyl group, any other alkyl group, an aryl group or a hydrogen atom, and independently therefrom $R_9$ represents a methyl group, any other alkyl group, an aryl group, a vinyl group, an alkyl group or aryl group which may have a hydroxyl group, or a hydrogen atom; and m and n each represent an integer.

90. The process cartridge according to claim 85, wherein said amino-modified silicone oil and said silicone oil having no amino group are mixed in a proportion having the following relationship: Amino-modified silicone oil: silicone oil having no amino group=1:20 to 10:1.

91. The process cartridge according to claim 73, wherein said inorganic fine powder is treated with said silicone oil in a treatment quantity ranging from 5 parts by weight to 70 parts by weight of the latter based on 100 parts by weight of the former.

92. The process cartridge according to claim 73, wherein said inorganic fine powder comprises a member selected from the group consisting of silicon oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, calcium titanate, magnesium titanate, strontium titanate, tungstophosphoric acid, molybdophosphoric acid, calcium carbonate, magnesium carbonate and aluminum carbonate.

93. The process cartridge according to claim 73, wherein said inorganic fine powder is contained in an amount ranging from 0.01 part by weight to 10 parts by weight based on 100 parts by weight of said toner particles.

94. The process cartridge according to claim 73, wherein said toner is a color toner having toner particles containing as said colorant a dye, a pigment or a mixture thereof.

95. The process cartridge according to claim 73, wherein said toner is a magnetic toner having toner particles containing as said colorant a magnetic material.

96. The process cartridge according to claim 73, which, in addition to said electrostatic latent image bearing member and said developing assembly, further comprises in one unit a cleaning means for cleaning the surface of said electrostatic latent image bearing member.

97. The process cartridge according to claim 96, wherein said cleaning means is a cleaning blade.

98. The process cartridge according to claim 73, which, in addition to said electrostatic latent image bearing member and said developing assembly, further comprises in one unit a charging member for electrostatically charging said electrostatic latent image bearing member.

99. The process cartridge according to claim 73, which, in addition to said electrostatic latent image bearing member and said developing assembly, further comprises in one unit a cleaning means for cleaning the surface of said electrostatic latent image bearing member and a charging member for electrostatically charging said electrostatic latent image bearing member.

100. The process cartridge according to claim 99, wherein said cleaning means is a cleaning blade.

* * * * *

UNITED STATES PATENT AND TRADEMARK OFFICE

CERTIFICATE OF CORRECTION

PATENT NO. : 6,057,073

DATED : May 2, 2000

INVENTOR(S) : KAZUYOSHI HAGIWARA

It is certified that error appears in the above-identified patent and that said Letters Patent is hereby corrected as shown below:

ON THE TITLE PAGE [56] References Cited:

Attorney, Agent or Firm, "Fitzpatric, Cella, Harper & Scinto" should read --Fitzpatrick, Cella, Harper & Scinto--.

COLUMN 7:

Line 28, "form" should read --from--;
Line 63, "less scatters" should read --scatters less--; and
Line 64, ""less occur." should read --occur less.--.

COLUMN 9:

Line 35, "The" (second occurrence) should read --the--.

COLUMN 11:

Line 42, "less occur." should read --occur less.--.

COLUMN 15:

Line 51, "Ltd." should read --Ltd.,--;
Line 61, "Ltd." should read --Ltd.,--; and
Line 62, "The" (second occurrence) should read --the--.

COLUMN 16:

Line 4, "Ltd." should read --Ltd.,--; and
Line 45, "part" should read --parts--.

UNITED STATES PATENT AND TRADEMARK OFFICE

CERTIFICATE OF CORRECTION

PATENT NO. : 6,057,073

DATED : May 2, 2000

INVENTOR(S) : KAZUYOSHI HAGIWARA

It is certified that error appears in the above-identified patent and that said Letters Patent is hereby corrected as shown below:

COLUMN 17:

Line 54, "include" should read --includes--.

COLUMN 25:

Line 60, "carried" should read --carry--.

COLUMN 29:

Line 50, "blak" should read --black--.

COLUMN 34:

Table 2, "($m^2g$)" should read --($m^2/g$)--.

COLUMN 35:

Table 2, "($m^2g$)" should read --($m^2/g$)--.

COLUMN 37:

Line 49, "of" should be deleted and "the" (second occurrence) should be deleted.

COLUMN 38:

Line 39, "part" should read --parts--.

COLUMN 39:

Line 4, "images),." should read --images),--; and
Line 35, "but not appears" should read --but does not appear--.

UNITED STATES PATENT AND TRADEMARK OFFICE

CERTIFICATE OF CORRECTION

PATENT NO. : 6,057,073

DATED : May 2, 2000

INVENTOR(S) : KAZUYOSHI HAGIWARA

It is certified that error appears in the above-identified patent and that said Letters Patent is hereby corrected as shown below:

COLUMN 58:

Table 12, " Specific surface area treatment ($m^2/g$) " should read -- Specific surface area after treatment ($m^2/g$) --.

COLUMN 61:

Line 12, "oils," should read --oil,--.

COLUMN 62:

Line 44, "of;" should read --of:--.

COLUMN 64:

Line 26, "oils," should read --oil,--.

COLUMN 65:

Line 51, "part" should read --parts--;
Line 60, "comprising;" should read --comprising:--;
Line 67, "developed;" should ----developed,--.

UNITED STATES PATENT AND TRADEMARK OFFICE

CERTIFICATE OF CORRECTION

PATENT NO. : 6,057,073

DATED : May 2, 2000

INVENTOR(S) : KAZUYOSHI HAGIWARA

It is certified that error appears in the above-identified patent and that said Letters Patent is hereby corrected as shown below:

COLUMN 66:

Line 18, "1000,000" should read --100,000--.

COLUMN 67:

Line 39, "oils," should read --oil,--.

COLUMN 68:

Line 62, "part" should read --parts--.

COLUMN 69:

Line 28, "member;" should read --member,--;
Line 29, "comprising;" should read --comprising:--;
Line 36, "developed;" should read --developed,--; and
Line 59, "Peak" should read --peak--.

COLUMN 70:

Line 2, "Present" should read --present--; and
Line 41, "valuer," should read --value,--.

UNITED STATES PATENT AND TRADEMARK OFFICE

CERTIFICATE OF CORRECTION

PATENT NO. : 6,057,073

DATED : May 2, 2000

INVENTOR(S) : KAZUYOSHI HAGIWARA

It is certified that error appears in the above-identified patent and that said Letters Patent is hereby corrected as shown below:

COLUMN 71:

Line 8, "oils," should read --oil,--.

Signed and Sealed this

Seventeenth Day of April, 2001

Nicholas P. Godici

*Attest:*

NICHOLAS P. GODICI

*Attesting Officer*

*Acting Director of the United States Patent and Trademark Office*